US007391391B2

(12) United States Patent
Ohshima

(10) Patent No.: US 7,391,391 B2
(45) Date of Patent: Jun. 24, 2008

(54) DISPLAY APPARATUS

(75) Inventor: Yoshinori Ohshima, Yamato (JP)

(73) Assignee: Victor Company of Japan, Limited, Yokohama, Kanagawa-ken (JP)

( * ) Notice: Subject to any disclaimer, the term of this patent is extended or adjusted under 35 U.S.C. 154(b) by 605 days.

(21) Appl. No.: 10/983,265

(22) Filed: Nov. 8, 2004

(65) Prior Publication Data

US 2005/0104812 A1 May 19, 2005

(30) Foreign Application Priority Data

Nov. 13, 2003 (JP) ..... P2003-383917
Feb. 12, 2004 (JP) ..... P2004-034431

(51) Int. Cl.
*G09G 3/28* (2006.01)
*G09G 5/10* (2006.01)

(52) U.S. Cl. ..... 345/60; 345/692

(58) Field of Classification Search ..... 345/60, 345/204, 72, 692, 690
See application file for complete search history.

(56) References Cited

U.S. PATENT DOCUMENTS 5,818,419 A * 10/1998 Tajima et al. ..... 345/691
6,008,793 A * 12/1999 Shigeta ..... 345/204
6,018,329 A * 1/2000 Kida et al. ..... 345/60
6,064,356 A * 5/2000 Shigeta ..... 345/63
6,088,012 A * 7/2000 Shigeta et al. ..... 345/63
2003/0076283 A1 * 4/2003 Lai et al. ..... 345/60

FOREIGN PATENT DOCUMENTS

| | | |
|---|---|---|
| JP | 07-271325 | 10/1995 |
| JP | 09-258689 | 10/1997 |
| JP | 09-311662 | 12/1997 |
| JP | 10-116053 | 5/1998 |
| JP | 10-171402 | 6/1998 |
| JP | 11-073157 | 3/1999 |
| JP | 11-282403 | 10/1999 |
| JP | 2001-051641 | 2/2001 |
| JP | 2002-366085 | 12/2002 |
| JP | 2003-015587 | 1/2003 |
| JP | 2003-066892 | 3/2003 |
| JP | 2003-228319 | 8/2003 |

* cited by examiner

*Primary Examiner*—Amr Awad
*Assistant Examiner*—Stephen G Sherman
(74) *Attorney, Agent, or Firm*—The Nath Law Group; Jerald L. Meyer; Jonathan A. Kidney

(57) ABSTRACT

A display apparatus divides each frame period of an input image signal into a plurality of subframes and selects the subframes according to a gray-scale level of the input signal, to display a gray-scale image. The display apparatus alternately employs two sets of tables having different gray-scale-level input/output characteristics, to move locations to cause false contours frame by frame, thereby minimizing false contours.

2 Claims, 31 Drawing Sheets

| INPUT GRAY-SCALE LEVEL | SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 46 | | ○ | | ○ | | ○ | | ○ | | | | 46 |
| 47 | | | ○ | ○ | | ○ | | ○ | | | | 47 |
| 48 | ○ | | ○ | ○ | | ○ | | ○ | | | | 48 |
| 49 | | ○ | ○ | ○ | | ○ | | ○ | | | | 49 |
| 50 | ○ | ○ | | | ○ | ○ | | ○ | | | | 50 |
| 51 | ○ | | ○ | | ○ | ○ | | ○ | | | | 51 |
| 52 | | ○ | ○ | | ○ | ○ | | ○ | | | | 52 |
| 53 | ○ | | ○ | ○ | | | ○ | ○ | | | | 53 |
| 54 | | ○ | ○ | ○ | | | ○ | ○ | | | | 54 |
| 55 | ○ | ○ | | | ○ | | ○ | ○ | | | | 55 |
| 56 | ○ | | ○ | | ○ | | ○ | ○ | | | | 56 |
| 57 | | ○ | ○ | | ○ | | ○ | ○ | | | | 57 |
| 58 | ○ | | | ○ | ○ | | ○ | ○ | | | | 58 |
| 59 | | ○ | | ○ | ○ | | ○ | ○ | | | | 59 |
| 60 | | | ○ | ○ | ○ | | ○ | ○ | | | | 60 |
| 61 | ○ | | ○ | | | ○ | ○ | ○ | | | | 61 |
| 62 | | ○ | ○ | | | ○ | ○ | ○ | | | | 62 |
| 63 | ○ | | | ○ | | ○ | ○ | ○ | | | | 63 |
| 64 | | ○ | | ○ | | ○ | ○ | ○ | | | | 64 |
| 65 | | | ○ | ○ | | ○ | ○ | ○ | | | | 65 |
| 66 | ○ | | ○ | ○ | | | ○ | | ○ | | | 66 |
| 67 | | ○ | ○ | ○ | | | ○ | | ○ | | | 67 |
| 68 | ○ | ○ | | | ○ | | ○ | | ○ | | | 68 |
| 69 | ○ | | ○ | | ○ | | ○ | | ○ | | | 69 |
| 70 | | ○ | ○ | | ○ | | ○ | | ○ | | | 70 |
| 71 | ○ | | | ○ | ○ | | ○ | | ○ | | | 71 |
| 72 | | ○ | | ○ | ○ | | ○ | | ○ | | | 72 |
| 73 | | | ○ | ○ | ○ | | ○ | | ○ | | | 73 |
| 74 | ○ | | ○ | | | ○ | ○ | | ○ | | | 74 |
| 75 | | ○ | ○ | | | ○ | ○ | | ○ | | | 75 |
| 76 | ○ | | | ○ | | ○ | ○ | | ○ | | | 76 |
| 77 | | ○ | | ○ | | ○ | ○ | | ○ | | | 77 |
| 78 | | | ○ | ○ | | ○ | ○ | | ○ | | | 78 |
| 79 | ○ | | | ○ | ○ | | | ○ | ○ | | | 79 |
| 80 | | ○ | | ○ | ○ | | | ○ | ○ | | | 80 |
| 81 | | | ○ | ○ | ○ | | | ○ | ○ | | | 81 |
| 82 | ○ | | ○ | | | ○ | | ○ | ○ | | | 82 |
| 83 | | ○ | ○ | | | ○ | | ○ | ○ | | | 83 |
| 84 | ○ | | | ○ | | ○ | | ○ | ○ | | | 84 |
| 85 | | ○ | | ○ | | ○ | | ○ | ○ | | | 85 |
| 86 | | | ○ | ○ | | ○ | | ○ | ○ | | | 86 |
| 87 | ○ | | | | ○ | ○ | | ○ | ○ | | | 87 |
| 88 | | ○ | | | ○ | ○ | | ○ | ○ | | | 88 |
| 89 | | | ○ | | ○ | ○ | | ○ | ○ | | | 89 |
| 90 | | ○ | | ○ | | | ○ | ○ | ○ | | | 90 |
| 91 | | | ○ | ○ | | | ○ | ○ | ○ | | | 91 |

(A) FIRST TABLE (CODING a)

| INPUT GRAY-SCALE LEVEL | SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 46 | | ○ | | | ○ | ○ | ○ | | | | | 41 |
| 47 | | | ○ | | ○ | ○ | ○ | | | | | 42 |
| 48 | ○ | | ○ | | | ○ | | ○ | | | | 43 |
| 49 | | ○ | ○ | | | ○ | | ○ | | | | 44 |
| 50 | ○ | | | ○ | | ○ | | ○ | | | | 45 |
| 51 | | ○ | | ○ | | ○ | | ○ | | | | 46 |
| 52 | | | ○ | ○ | | ○ | | ○ | | | | 47 |
| 53 | ○ | | ○ | ○ | | ○ | | ○ | | | | 48 |
| 54 | | ○ | ○ | ○ | | ○ | | ○ | | | | 49 |
| 55 | | ○ | ○ | ○ | | ○ | | ○ | | | | 49 |
| 56 | ○ | ○ | | | ○ | ○ | | ○ | | | | 50 |
| 57 | ○ | | ○ | | ○ | ○ | | ○ | | | | 51 |
| 58 | | ○ | ○ | | ○ | ○ | | ○ | | | | 52 |
| 59 | ○ | | ○ | ○ | | | ○ | ○ | | | | 53 |
| 60 | | ○ | ○ | ○ | | | ○ | ○ | | | | 54 |
| 61 | | ○ | ○ | ○ | | | ○ | ○ | | | | 54 |
| 62 | ○ | ○ | | | ○ | | ○ | ○ | | | | 55 |
| 63 | ○ | | ○ | | ○ | | ○ | ○ | | | | 56 |
| 64 | | ○ | ○ | | ○ | | ○ | ○ | | | | 57 |
| 65 | ○ | | | ○ | ○ | | ○ | ○ | | | | 58 |
| 66 | | ○ | | ○ | ○ | | ○ | ○ | | | | 59 |
| 67 | | ○ | | ○ | ○ | | ○ | ○ | | | | 59 |
| 68 | | | ○ | ○ | ○ | | ○ | ○ | | | | 60 |
| 69 | ○ | | ○ | | | ○ | ○ | ○ | | | | 61 |
| 70 | | ○ | ○ | | | ○ | ○ | ○ | | | | 62 |
| 71 | ○ | | | ○ | | ○ | ○ | ○ | | | | 63 |
| 72 | | ○ | | ○ | | ○ | ○ | ○ | | | | 64 |
| 73 | | | ○ | ○ | | ○ | ○ | ○ | | | | 65 |
| 74 | ○ | | ○ | | ○ | ○ | | ○ | | ○ | | 66 |
| 75 | | ○ | ○ | | ○ | ○ | | ○ | | ○ | | 67 |
| 76 | ○ | ○ | | | ○ | | ○ | ○ | | ○ | | 68 |
| 77 | ○ | | | ○ | ○ | | ○ | ○ | | ○ | | 69 |
| 78 | ○ | | | ○ | ○ | | ○ | ○ | | ○ | | 69 |
| 79 | | ○ | ○ | | ○ | | ○ | ○ | | ○ | | 70 |
| 80 | ○ | | | ○ | ○ | | ○ | ○ | | ○ | | 71 |
| 81 | | ○ | | ○ | ○ | | ○ | ○ | | ○ | | 72 |
| 82 | | | ○ | ○ | ○ | | ○ | ○ | | ○ | | 73 |
| 83 | ○ | | ○ | | | ○ | ○ | ○ | | ○ | | 74 |
| 84 | | ○ | ○ | | | ○ | ○ | ○ | | ○ | | 75 |
| 85 | ○ | | | ○ | | ○ | ○ | ○ | | ○ | | 76 |
| 86 | | ○ | | ○ | | ○ | ○ | ○ | | ○ | | 77 |
| 87 | | | ○ | ○ | | ○ | ○ | ○ | | ○ | | 78 |
| 88 | ○ | | | ○ | ○ | | | ○ | ○ | ○ | | 79 |
| 89 | ○ | | | ○ | ○ | | | ○ | ○ | ○ | | 79 |
| 90 | | ○ | | ○ | ○ | | | ○ | ○ | ○ | | 80 |
| 91 | | | ○ | ○ | ○ | | | ○ | ○ | ○ | | 81 |

(B) SECOND TABLE (CODING b)

FIG.7

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 0 | | | | | | | | | | | | 0 | 0 |
| 1 | ○ | | | | | | | | | | | 1 | 1 |
| 2 | | ○ | | | | | | | | | | 2 | 1 |
| 3 | ○ | ○ | | | | | | | | | | 3 | 2 |
| 4 | ○ | | ○ | | | | | | | | | 4 | 2 |
| 5 | | ○ | ○ | | | | | | | | | 5 | 2 |
| 6 | ○ | | | ○ | | | | | | | | 6 | 2 |
| 7 | | ○ | | ○ | | | | | | | | 7 | 2 |
| 8 | | | ○ | ○ | | | | | | | | 8 | 2 |
| 9 | ○ | | ○ | ○ | | | | | | | | 9 | 3 |
| 10 | | ○ | ○ | ○ | | | | | | | | 10 | 3 |
| 11 | ○ | ○ | | | ○ | | | | | | | 11 | 3 |
| 12 | ○ | | ○ | | ○ | | | | | | | 12 | 3 |
| 13 | | ○ | ○ | | ○ | | | | | | | 13 | 3 |
| 14 | ○ | | | ○ | ○ | | | | | | | 14 | 3 |
| 15 | | ○ | | ○ | ○ | | | | | | | 15 | 3 |
| 16 | | | ○ | ○ | ○ | | | | | | | 16 | 3 |
| 17 | ○ | | ○ | | | ○ | | | | | | 17 | 3 |
| 18 | | ○ | ○ | | | ○ | | | | | | 18 | 3 |
| 19 | ○ | | | ○ | | ○ | | | | | | 19 | 3 |
| 20 | | ○ | | ○ | | ○ | | | | | | 20 | 3 |
| 21 | | | ○ | ○ | | ○ | | | | | | 21 | 3 |
| 22 | ○ | | ○ | ○ | | ○ | | | | | | 22 | 4 |
| 23 | | ○ | ○ | ○ | | ○ | | | | | | 23 | 4 |
| 24 | ○ | ○ | | | ○ | ○ | | | | | | 24 | 4 |
| 25 | ○ | | ○ | | ○ | ○ | | | | | | 25 | 4 |
| 26 | | ○ | ○ | | ○ | ○ | | | | | | 26 | 4 |
| 27 | ○ | | | ○ | ○ | ○ | | | | | | 27 | 4 |
| 28 | | ○ | | ○ | ○ | ○ | | | | | | 28 | 4 |
| 29 | ○ | ○ | | | ○ | | ○ | | | | | 29 | 4 |
| 30 | ○ | | ○ | | ○ | | ○ | | | | | 30 | 4 |
| 31 | | ○ | ○ | | ○ | | ○ | | | | | 31 | 4 |
| 32 | ○ | | | ○ | ○ | | ○ | | | | | 32 | 4 |
| 33 | | ○ | | ○ | ○ | | ○ | | | | | 33 | 4 |
| 34 | | | ○ | ○ | ○ | | ○ | | | | | 34 | 4 |
| 35 | ○ | | ○ | | | ○ | ○ | | | | | 35 | 4 |
| 36 | | ○ | ○ | | | ○ | ○ | | | | | 36 | 4 |
| 37 | ○ | | | ○ | | ○ | ○ | | | | | 37 | 4 |
| 38 | | ○ | | ○ | | ○ | ○ | | | | | 38 | 4 |
| 39 | | | ○ | ○ | | ○ | ○ | | | | | 39 | 4 |
| 40 | ○ | | | | ○ | ○ | ○ | | | | | 40 | 4 |
| 41 | | ○ | | | ○ | ○ | ○ | | | | | 41 | 4 |
| 42 | | | ○ | | ○ | ○ | ○ | | | | | 42 | 4 |
| 43 | ○ | | ○ | | | ○ | | ○ | | | | 43 | 4 |
| 44 | | ○ | ○ | | | ○ | | ○ | | | | 44 | 4 |
| 45 | ○ | | | ○ | | ○ | | ○ | | | | 45 | 4 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 46 | | ○ | | ○ | | ○ | | ○ | | | | 46 | 4 |
| 47 | | | ○ | ○ | | ○ | | ○ | | | | 47 | 4 |
| 48 | ○ | | ○ | ○ | | ○ | | ○ | | | | 48 | 5 |
| 49 | | ○ | ○ | ○ | | ○ | | ○ | | | | 49 | 5 |
| 50 | ○ | ○ | | | ○ | ○ | | ○ | | | | 50 | 5 |
| 51 | ○ | | ○ | | ○ | ○ | | ○ | | | | 51 | 5 |
| 52 | | ○ | ○ | | ○ | ○ | | ○ | | | | 52 | 5 |
| 53 | ○ | | ○ | ○ | | | ○ | ○ | | | | 53 | 5 |
| 54 | | ○ | ○ | ○ | | | ○ | ○ | | | | 54 | 5 |
| 55 | ○ | ○ | | | ○ | | ○ | ○ | | | | 55 | 5 |
| 56 | ○ | | ○ | | ○ | | ○ | ○ | | | | 56 | 5 |
| 57 | | ○ | ○ | | ○ | | ○ | ○ | | | | 57 | 5 |
| 58 | ○ | | | ○ | ○ | | ○ | ○ | | | | 58 | 5 |
| 59 | | ○ | | ○ | ○ | | ○ | ○ | | | | 59 | 5 |
| 60 | | | ○ | ○ | ○ | | ○ | ○ | | | | 60 | 5 |
| 61 | ○ | | ○ | | | ○ | ○ | ○ | | | | 61 | 5 |
| 62 | | ○ | ○ | | | ○ | ○ | ○ | | | | 62 | 5 |
| 63 | ○ | | | ○ | | ○ | ○ | ○ | | | | 63 | 5 |
| 64 | | ○ | | ○ | | ○ | ○ | ○ | | | | 64 | 5 |
| 65 | | | ○ | ○ | | ○ | ○ | ○ | | | | 65 | 5 |
| 66 | ○ | | ○ | ○ | | | ○ | | ○ | | | 66 | 5 |
| 67 | | ○ | ○ | ○ | | | ○ | | ○ | | | 67 | 5 |
| 68 | ○ | ○ | | | ○ | | ○ | | ○ | | | 68 | 5 |
| 69 | ○ | | ○ | | ○ | | ○ | | ○ | | | 69 | 5 |
| 70 | | ○ | ○ | | ○ | | ○ | | ○ | | | 70 | 5 |
| 71 | ○ | | | ○ | ○ | | ○ | | ○ | | | 71 | 5 |
| 72 | | ○ | | ○ | ○ | | ○ | | ○ | | | 72 | 5 |
| 73 | | | ○ | ○ | ○ | | ○ | | ○ | | | 73 | 5 |
| 74 | ○ | | ○ | | | ○ | ○ | | ○ | | | 74 | 5 |
| 75 | | ○ | ○ | | | ○ | ○ | | ○ | | | 75 | 5 |
| 76 | ○ | | | ○ | | ○ | ○ | | ○ | | | 76 | 5 |
| 77 | | ○ | | ○ | | ○ | ○ | | ○ | | | 77 | 5 |
| 78 | | | ○ | ○ | | ○ | ○ | | ○ | | | 78 | 5 |
| 79 | ○ | | | ○ | ○ | | | ○ | ○ | | | 79 | 5 |
| 80 | | ○ | | ○ | ○ | | | ○ | ○ | | | 80 | 5 |
| 81 | | | ○ | ○ | ○ | | | ○ | ○ | | | 81 | 5 |
| 82 | ○ | | ○ | | | ○ | | ○ | ○ | | | 82 | 5 |
| 83 | | ○ | ○ | | | ○ | | ○ | ○ | | | 83 | 5 |
| 84 | ○ | | | ○ | | ○ | | ○ | ○ | | | 84 | 5 |
| 85 | | ○ | | ○ | | ○ | | ○ | ○ | | | 85 | 5 |
| 86 | | | ○ | ○ | | ○ | | ○ | ○ | | | 86 | 5 |
| 87 | ○ | | | | ○ | ○ | | ○ | ○ | | | 87 | 5 |
| 88 | | ○ | | | ○ | ○ | | ○ | ○ | | | 88 | 5 |
| 89 | | | ○ | | ○ | ○ | | ○ | ○ | | | 89 | 5 |
| 90 | | ○ | | ○ | | | ○ | ○ | ○ | | | 90 | 5 |
| 91 | | | ○ | ○ | | | ○ | ○ | ○ | | | 91 | 5 |

FIG.8

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 92 | ○ | | | | ○ | | ○ | ○ | ○ | | | 92 | 5 |
| 93 | | ○ | | | ○ | | ○ | ○ | ○ | | | 93 | 5 |
| 94 | | | ○ | | ○ | | ○ | ○ | ○ | | | 94 | 5 |
| 95 | ○ | | ○ | | ○ | | | ○ | | ○ | | 95 | 5 |
| 96 | | ○ | ○ | | ○ | | | ○ | | ○ | | 96 | 5 |
| 97 | ○ | | | ○ | ○ | | | ○ | | ○ | | 97 | 5 |
| 98 | | ○ | | ○ | ○ | | | ○ | | ○ | | 98 | 5 |
| 99 | | | ○ | ○ | ○ | | | ○ | | ○ | | 99 | 5 |
| 100 | ○ | | ○ | | | ○ | | ○ | | ○ | | 100 | 5 |
| 101 | | ○ | ○ | | | ○ | | ○ | | ○ | | 101 | 5 |
| 102 | ○ | | | ○ | | ○ | | ○ | | ○ | | 102 | 5 |
| 103 | | ○ | | ○ | | ○ | | ○ | | ○ | | 103 | 5 |
| 104 | | | ○ | ○ | | ○ | | ○ | | ○ | | 104 | 5 |
| 105 | ○ | | ○ | ○ | | ○ | | ○ | | ○ | | 105 | 6 |
| 106 | | ○ | ○ | ○ | | ○ | | ○ | | ○ | | 106 | 6 |
| 107 | ○ | ○ | | | ○ | ○ | | ○ | | ○ | | 107 | 6 |
| 108 | ○ | | ○ | | ○ | ○ | | ○ | | ○ | | 108 | 6 |
| 109 | | ○ | ○ | | ○ | ○ | | ○ | | ○ | | 109 | 6 |
| 110 | ○ | | ○ | ○ | | | ○ | ○ | | ○ | | 110 | 6 |
| 111 | | ○ | ○ | ○ | | | ○ | ○ | | ○ | | 111 | 6 |
| 112 | ○ | ○ | | | ○ | | ○ | ○ | | ○ | | 112 | 6 |
| 113 | ○ | | ○ | | ○ | | ○ | ○ | | ○ | | 113 | 6 |
| 114 | | ○ | ○ | | ○ | | ○ | ○ | | ○ | | 114 | 6 |
| 115 | ○ | | | ○ | ○ | | ○ | ○ | | ○ | | 115 | 6 |
| 116 | | ○ | | ○ | ○ | | ○ | ○ | | ○ | | 116 | 6 |
| 117 | ○ | ○ | | ○ | | ○ | | | ○ | ○ | | 117 | 6 |
| 118 | ○ | | ○ | ○ | | ○ | | | ○ | ○ | | 118 | 6 |
| 119 | | ○ | ○ | ○ | | ○ | | | ○ | ○ | | 119 | 6 |
| 120 | ○ | ○ | | | ○ | ○ | | | ○ | ○ | | 120 | 6 |
| 121 | ○ | | ○ | | ○ | ○ | | | ○ | ○ | | 121 | 6 |
| 122 | ○ | ○ | | ○ | | | ○ | | ○ | ○ | | 122 | 6 |
| 123 | ○ | | ○ | ○ | | | ○ | | ○ | ○ | | 123 | 6 |
| 124 | | ○ | ○ | ○ | | | ○ | | ○ | ○ | | 124 | 6 |
| 125 | ○ | ○ | | | ○ | | ○ | | ○ | ○ | | 125 | 6 |
| 126 | ○ | | ○ | | ○ | | ○ | | ○ | ○ | | 126 | 6 |
| 127 | | ○ | ○ | | ○ | | ○ | | ○ | ○ | | 127 | 6 |
| 128 | ○ | | | ○ | ○ | | ○ | | ○ | ○ | | 128 | 6 |
| 129 | | ○ | | ○ | ○ | | ○ | | ○ | ○ | | 129 | 6 |
| 130 | | | ○ | ○ | ○ | | ○ | | ○ | ○ | | 130 | 6 |
| 131 | ○ | | ○ | | | ○ | ○ | | ○ | ○ | | 131 | 6 |
| 132 | | ○ | ○ | | | ○ | ○ | | ○ | ○ | | 132 | 6 |
| 133 | ○ | | | ○ | | ○ | ○ | | ○ | ○ | | 133 | 6 |
| 134 | | ○ | | ○ | | ○ | ○ | | ○ | ○ | | 134 | 6 |
| 135 | | | ○ | ○ | | ○ | ○ | | ○ | ○ | | 135 | 6 |
| 136 | ○ | | | ○ | ○ | | | ○ | ○ | ○ | | 136 | 6 |
| 137 | | ○ | | ○ | ○ | | | ○ | ○ | ○ | | 137 | 6 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 138 | | | ○ | ○ | ○ | | | ○ | ○ | ○ | | 138 | 6 |
| 139 | ○ | | ○ | | | ○ | | ○ | ○ | ○ | | 139 | 6 |
| 140 | | ○ | ○ | | | ○ | | ○ | ○ | ○ | | 140 | 6 |
| 141 | ○ | | | ○ | | ○ | | ○ | ○ | ○ | | 141 | 6 |
| 142 | | ○ | | ○ | | ○ | | ○ | ○ | ○ | | 142 | 6 |
| 143 | ○ | ○ | | ○ | | ○ | | | ○ | | ○ | 143 | 6 |
| 144 | ○ | | ○ | ○ | | ○ | | | ○ | | ○ | 144 | 6 |
| 145 | | ○ | ○ | ○ | | ○ | | | ○ | | ○ | 145 | 6 |
| 146 | ○ | ○ | | | ○ | ○ | | | ○ | | ○ | 146 | 6 |
| 147 | ○ | | ○ | | ○ | ○ | | | ○ | | ○ | 147 | 6 |
| 148 | ○ | ○ | | ○ | | | ○ | | ○ | | ○ | 148 | 6 |
| 149 | ○ | | ○ | ○ | | | ○ | | ○ | | ○ | 149 | 6 |
| 150 | | ○ | ○ | ○ | | | ○ | | ○ | | ○ | 150 | 6 |
| 151 | ○ | ○ | | | ○ | | ○ | | ○ | | ○ | 151 | 6 |
| 152 | ○ | | ○ | | ○ | | ○ | | ○ | | ○ | 152 | 6 |
| 153 | | ○ | ○ | | ○ | | ○ | | ○ | | ○ | 153 | 6 |
| 154 | ○ | | | ○ | ○ | | ○ | | ○ | | ○ | 154 | 6 |
| 155 | | ○ | | ○ | ○ | | ○ | | ○ | | ○ | 155 | 6 |
| 156 | | | ○ | ○ | ○ | | ○ | | ○ | | ○ | 156 | 6 |
| 157 | ○ | | ○ | | | ○ | ○ | | ○ | | ○ | 157 | 6 |
| 158 | | ○ | ○ | | | ○ | ○ | | ○ | | ○ | 158 | 6 |
| 159 | ○ | | | ○ | | ○ | ○ | | ○ | | ○ | 159 | 6 |
| 160 | | ○ | | ○ | | ○ | ○ | | ○ | | ○ | 160 | 6 |
| 161 | | | ○ | ○ | | ○ | ○ | | ○ | | ○ | 161 | 6 |
| 162 | ○ | | | ○ | ○ | | | ○ | ○ | | ○ | 162 | 6 |
| 163 | | ○ | | ○ | ○ | | | ○ | ○ | | ○ | 163 | 6 |
| 164 | | | ○ | ○ | ○ | | | ○ | ○ | | ○ | 164 | 6 |
| 165 | ○ | | ○ | | | ○ | | ○ | ○ | | ○ | 165 | 6 |
| 166 | | ○ | ○ | | | ○ | | ○ | ○ | | ○ | 166 | 6 |
| 167 | ○ | | | ○ | | ○ | | ○ | ○ | | ○ | 167 | 6 |
| 168 | | ○ | | ○ | | ○ | | ○ | ○ | | ○ | 168 | 6 |
| 169 | | | ○ | ○ | | ○ | | ○ | ○ | | ○ | 169 | 6 |
| 170 | ○ | | ○ | | ○ | | ○ | | | ○ | ○ | 170 | 6 |
| 171 | | ○ | ○ | | ○ | | ○ | | | ○ | ○ | 171 | 6 |
| 172 | ○ | | | ○ | ○ | | ○ | | | ○ | ○ | 172 | 6 |
| 173 | | ○ | | ○ | ○ | | ○ | | | ○ | ○ | 173 | 6 |
| 174 | | | ○ | ○ | ○ | | ○ | | | ○ | ○ | 174 | 6 |
| 175 | ○ | | ○ | | | ○ | ○ | | | ○ | ○ | 175 | 6 |
| 176 | | ○ | ○ | | | ○ | ○ | | | ○ | ○ | 176 | 6 |
| 177 | ○ | | | ○ | | ○ | ○ | | | ○ | ○ | 177 | 6 |
| 178 | | ○ | | ○ | | ○ | ○ | | | ○ | ○ | 178 | 6 |
| 179 | | | ○ | ○ | | ○ | ○ | | | ○ | ○ | 179 | 6 |
| 180 | ○ | | | ○ | ○ | | | ○ | | ○ | ○ | 180 | 6 |
| 181 | | ○ | | ○ | ○ | | | ○ | | ○ | ○ | 181 | 6 |
| 182 | | | ○ | ○ | ○ | | | ○ | | ○ | ○ | 182 | 6 |
| 183 | ○ | | ○ | | | ○ | | ○ | | ○ | ○ | 183 | 6 |

FIG.9

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 184 | | ○ | ○ | | | ○ | | ○ | | ○ | ○ | 184 | 6 |
| 185 | ○ | | | ○ | | ○ | | ○ | | ○ | ○ | 185 | 6 |
| 186 | | ○ | | ○ | | ○ | | ○ | | ○ | ○ | 186 | 6 |
| 187 | | | ○ | ○ | | ○ | | ○ | | ○ | ○ | 187 | 6 |
| 188 | ○ | | ○ | ○ | | ○ | | ○ | | ○ | ○ | 188 | 7 |
| 189 | | ○ | ○ | ○ | | ○ | | ○ | | ○ | ○ | 189 | 7 |
| 190 | ○ | ○ | | | ○ | ○ | | ○ | | ○ | ○ | 190 | 7 |
| 191 | ○ | | ○ | | ○ | ○ | | ○ | | ○ | ○ | 191 | 7 |
| 192 | ○ | ○ | | ○ | | | ○ | ○ | | ○ | ○ | 192 | 7 |
| 193 | ○ | | ○ | ○ | | | ○ | ○ | | ○ | ○ | 193 | 7 |
| 194 | | ○ | ○ | ○ | | | ○ | ○ | | ○ | ○ | 194 | 7 |
| 195 | ○ | ○ | | | ○ | | ○ | ○ | | ○ | ○ | 195 | 7 |
| 196 | ○ | | ○ | | ○ | | ○ | ○ | | ○ | ○ | 196 | 7 |
| 197 | | ○ | ○ | | ○ | | ○ | ○ | | ○ | ○ | 197 | 7 |
| 198 | ○ | | | ○ | ○ | | ○ | ○ | | ○ | ○ | 198 | 7 |
| 199 | | ○ | | ○ | ○ | | ○ | ○ | | ○ | ○ | 199 | 7 |
| 200 | | | ○ | ○ | ○ | | ○ | ○ | | ○ | ○ | 200 | 7 |
| 201 | ○ | | ○ | | | ○ | ○ | ○ | | ○ | ○ | 201 | 7 |
| 202 | | ○ | ○ | | | ○ | ○ | ○ | | ○ | ○ | 202 | 7 |
| 203 | ○ | | | ○ | | ○ | ○ | ○ | | ○ | ○ | 203 | 7 |
| 204 | ○ | | ○ | | ○ | ○ | | | ○ | ○ | ○ | 204 | 7 |
| 205 | ○ | ○ | | ○ | | | ○ | | ○ | ○ | ○ | 205 | 7 |
| 206 | ○ | | ○ | ○ | | | ○ | | ○ | ○ | ○ | 206 | 7 |
| 207 | | ○ | ○ | ○ | | | ○ | | ○ | ○ | ○ | 207 | 7 |
| 208 | ○ | ○ | | | ○ | | ○ | | ○ | ○ | ○ | 208 | 7 |
| 209 | ○ | | ○ | | ○ | | ○ | | ○ | ○ | ○ | 209 | 7 |
| 210 | | ○ | ○ | | ○ | | ○ | | ○ | ○ | ○ | 210 | 7 |
| 211 | ○ | | | ○ | ○ | | ○ | | ○ | ○ | ○ | 211 | 7 |
| 212 | | ○ | | ○ | ○ | | ○ | | ○ | ○ | ○ | 212 | 7 |
| 213 | | | ○ | ○ | ○ | | ○ | | ○ | ○ | ○ | 213 | 7 |
| 214 | ○ | | ○ | | | ○ | ○ | | ○ | ○ | ○ | 214 | 7 |
| 215 | | ○ | ○ | | | ○ | ○ | | ○ | ○ | ○ | 215 | 7 |
| 216 | ○ | | | ○ | | ○ | ○ | | ○ | ○ | ○ | 216 | 7 |
| 217 | ○ | | ○ | | ○ | | | ○ | ○ | ○ | ○ | 217 | 7 |
| 218 | | ○ | ○ | | ○ | | | ○ | ○ | ○ | ○ | 218 | 7 |
| 219 | ○ | | | ○ | ○ | | | ○ | ○ | ○ | ○ | 219 | 7 |
| 220 | | ○ | | ○ | ○ | | | ○ | ○ | ○ | ○ | 220 | 7 |
| 221 | | | ○ | ○ | ○ | | | ○ | ○ | ○ | ○ | 221 | 7 |
| 222 | ○ | | ○ | | | ○ | | ○ | ○ | ○ | ○ | 222 | 7 |
| 223 | | ○ | ○ | | | ○ | | ○ | ○ | ○ | ○ | 223 | 7 |
| 224 | ○ | | | ○ | | ○ | | ○ | ○ | ○ | ○ | 224 | 7 |
| 225 | | ○ | | ○ | | ○ | | ○ | ○ | ○ | ○ | 225 | 7 |
| 226 | ○ | ○ | | ○ | | ○ | | ○ | ○ | ○ | ○ | 226 | 8 |
| 227 | ○ | | ○ | ○ | | ○ | | ○ | ○ | ○ | ○ | 227 | 8 |
| 228 | | ○ | ○ | ○ | | ○ | | ○ | ○ | ○ | ○ | 228 | 8 |
| 229 | ○ | ○ | | | ○ | ○ | | ○ | ○ | ○ | ○ | 229 | 8 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 230 | ○ | | ○ | | ○ | ○ | | ○ | ○ | ○ | ○ | 230 | 8 |
| 231 | | ○ | ○ | | ○ | ○ | | ○ | ○ | ○ | ○ | 231 | 8 |
| 232 | ○ | | | ○ | ○ | ○ | | ○ | ○ | ○ | ○ | 232 | 8 |
| 233 | | ○ | | ○ | ○ | ○ | | ○ | ○ | ○ | ○ | 233 | 8 |
| 234 | ○ | ○ | | | ○ | | ○ | ○ | ○ | ○ | ○ | 234 | 8 |
| 235 | ○ | | ○ | | ○ | | ○ | ○ | ○ | ○ | ○ | 235 | 8 |
| 236 | | ○ | ○ | | ○ | | ○ | ○ | ○ | ○ | ○ | 236 | 8 |
| 237 | ○ | | | ○ | ○ | | ○ | ○ | ○ | ○ | ○ | 237 | 8 |
| 238 | | ○ | | ○ | ○ | | ○ | ○ | ○ | ○ | ○ | 238 | 8 |
| 239 | | | ○ | ○ | ○ | | ○ | ○ | ○ | ○ | ○ | 239 | 8 |
| 240 | ○ | | ○ | | | ○ | ○ | ○ | ○ | ○ | ○ | 240 | 8 |
| 241 | | ○ | ○ | | | ○ | ○ | ○ | ○ | ○ | ○ | 241 | 8 |
| 242 | ○ | | | ○ | | ○ | ○ | ○ | ○ | ○ | ○ | 242 | 8 |
| 243 | | ○ | | ○ | | ○ | ○ | ○ | ○ | ○ | ○ | 243 | 8 |
| 244 | ○ | ○ | | ○ | | ○ | ○ | ○ | ○ | ○ | ○ | 244 | 9 |
| 245 | ○ | | ○ | ○ | | ○ | ○ | ○ | ○ | ○ | ○ | 245 | 9 |
| 246 | | ○ | ○ | ○ | | ○ | ○ | ○ | ○ | ○ | ○ | 246 | 9 |
| 247 | ○ | ○ | | | ○ | ○ | ○ | ○ | ○ | ○ | ○ | 247 | 9 |
| 248 | ○ | | ○ | | ○ | ○ | ○ | ○ | ○ | ○ | ○ | 248 | 9 |
| 249 | | ○ | ○ | | ○ | ○ | ○ | ○ | ○ | ○ | ○ | 249 | 9 |
| 250 | ○ | | | ○ | ○ | ○ | ○ | ○ | ○ | ○ | ○ | 250 | 9 |
| 251 | | ○ | | ○ | ○ | ○ | ○ | ○ | ○ | ○ | ○ | 251 | 9 |
| 252 | ○ | ○ | | ○ | ○ | ○ | ○ | ○ | ○ | ○ | ○ | 252 | 10 |
| 253 | ○ | | ○ | ○ | ○ | ○ | ○ | ○ | ○ | ○ | ○ | 253 | 10 |
| 254 | | ○ | ○ | ○ | ○ | ○ | ○ | ○ | ○ | ○ | ○ | 254 | 10 |
| 255 | ○ | ○ | ○ | ○ | ○ | ○ | ○ | ○ | ○ | ○ | ○ | 255 | 11 |

FIG.10

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 0 | | | | | | | | | | | | 0 | 0 |
| 1 | O | | | | | | | | | | | 1 | 1 |
| 2 | | O | | | | | | | | | | 2 | 1 |
| 3 | O | O | | | | | | | | | | 3 | 2 |
| 4 | O | | O | | | | | | | | | 4 | 2 |
| 5 | | O | O | | | | | | | | | 5 | 2 |
| 6 | O | | | O | | | | | | | | 6 | 2 |
| 7 | | O | | O | | | | | | | | 7 | 2 |
| 8 | | | O | O | | | | | | | | 8 | 2 |
| 9 | O | | O | O | | | | | | | | 9 | 3 |
| 10 | O | | O | O | | | | | | | | 9 | 3 |
| 11 | | O | O | O | | | | | | | | 10 | 3 |
| 12 | O | O | | | O | | | | | | | 11 | 3 |
| 13 | O | | O | | O | | | | | | | 12 | 3 |
| 14 | | O | O | | O | | | | | | | 13 | 3 |
| 15 | O | | | O | O | | | | | | | 14 | 3 |
| 16 | | O | | O | O | | | | | | | 15 | 3 |
| 17 | | | O | O | O | | | | | | | 16 | 3 |
| 18 | O | | O | | | O | | | | | | 17 | 3 |
| 19 | | O | O | | | O | | | | | | 18 | 3 |
| 20 | O | | | O | | O | | | | | | 19 | 3 |
| 21 | O | | | O | | O | | | | | | 19 | 3 |
| 22 | | O | | O | | O | | | | | | 20 | 4 |
| 23 | | | O | O | | O | | | | | | 21 | 4 |
| 24 | O | | O | O | | O | | | | | | 22 | 4 |
| 25 | | O | O | O | | O | | | | | | 23 | 4 |
| 26 | O | O | | | O | O | | | | | | 24 | 4 |
| 27 | O | O | | | O | O | | | | | | 24 | 4 |
| 28 | O | | O | | O | O | | | | | | 25 | 4 |
| 29 | | O | O | | O | O | | | | | | 26 | 4 |
| 30 | O | | | O | O | O | | | | | | 27 | 4 |
| 31 | | O | | O | O | O | | | | | | 28 | 4 |
| 32 | O | O | | | O | | O | | | | | 29 | 4 |
| 33 | O | O | | | O | | O | | | | | 29 | 4 |
| 34 | O | | O | | O | | O | | | | | 30 | 4 |
| 35 | | O | O | | O | | O | | | | | 31 | 4 |
| 36 | O | | | O | O | | O | | | | | 32 | 4 |
| 37 | | O | | O | O | | O | | | | | 33 | 4 |
| 38 | | | O | O | O | | O | | | | | 34 | 4 |
| 39 | O | | O | | | O | O | | | | | 35 | 4 |
| 40 | | O | O | | | O | O | | | | | 36 | 4 |
| 41 | O | | | O | | O | O | | | | | 37 | 4 |
| 42 | | O | | O | | O | O | | | | | 38 | 4 |
| 43 | | | O | O | | O | O | | | | | 39 | 4 |
| 44 | | | O | O | | O | O | | | | | 39 | 4 |
| 45 | O | | | | O | O | O | | | | | 40 | 4 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 46 | | O | | | O | O | O | | | | | 41 | 4 |
| 47 | | | O | | O | O | O | | | | | 42 | 4 |
| 48 | O | | O | | | O | | O | | | | 43 | 5 |
| 49 | | O | O | | | O | | O | | | | 44 | 5 |
| 50 | O | | | O | | O | | O | | | | 45 | 5 |
| 51 | | O | | O | | O | | O | | | | 46 | 5 |
| 52 | | | O | O | | O | | O | | | | 47 | 5 |
| 53 | O | | O | O | | O | | O | | | | 48 | 5 |
| 54 | | O | O | O | | O | | O | | | | 49 | 5 |
| 55 | | O | O | O | | O | | O | | | | 49 | 5 |
| 56 | O | O | | | O | O | | O | | | | 50 | 5 |
| 57 | O | | O | | O | O | | O | | | | 51 | 5 |
| 58 | | O | O | | O | O | | O | | | | 52 | 5 |
| 59 | O | | O | O | | | O | O | | | | 53 | 5 |
| 60 | | O | O | O | | | O | O | | | | 54 | 5 |
| 61 | | O | O | O | | | O | O | | | | 54 | 5 |
| 62 | O | O | | | O | | O | O | | | | 55 | 5 |
| 63 | O | | O | | O | | O | O | | | | 56 | 5 |
| 64 | | O | O | | O | | O | O | | | | 57 | 5 |
| 65 | O | | | O | O | | O | O | | | | 58 | 5 |
| 66 | | O | | O | O | | O | O | | | | 59 | 5 |
| 67 | | O | | O | O | | O | O | | | | 59 | 5 |
| 68 | | | O | O | O | | O | O | | | | 60 | 5 |
| 69 | O | | O | | | O | O | O | | | | 61 | 5 |
| 70 | | O | O | | | O | O | O | | | | 62 | 5 |
| 71 | O | | | O | | O | O | O | | | | 63 | 5 |
| 72 | | O | | O | | O | O | O | | | | 64 | 5 |
| 73 | | | O | O | | O | O | O | | | | 65 | 5 |
| 74 | O | | O | O | | | O | | O | | | 66 | 5 |
| 75 | | O | O | O | | | O | | O | | | 67 | 5 |
| 76 | O | O | | | O | | O | | O | | | 68 | 5 |
| 77 | O | | O | | O | | O | | O | | | 69 | 5 |
| 78 | O | | O | | O | | O | | O | | | 69 | 5 |
| 79 | | O | O | | O | | O | | O | | | 70 | 5 |
| 80 | O | | | O | O | | O | | O | | | 71 | 5 |
| 81 | | O | | O | O | | O | | O | | | 72 | 5 |
| 82 | | | O | O | O | | O | | O | | | 73 | 5 |
| 83 | O | | O | | | O | O | | O | | | 74 | 5 |
| 84 | | O | O | | | O | O | | O | | | 75 | 5 |
| 85 | O | | | O | | O | O | | O | | | 76 | 5 |
| 86 | | O | | O | | O | O | | O | | | 77 | 5 |
| 87 | | | O | O | | O | O | | O | | | 78 | 5 |
| 88 | O | | | O | O | | | O | O | | | 79 | 5 |
| 89 | O | | | O | O | | | O | O | | | 79 | 5 |
| 90 | | O | | O | O | | | O | O | | | 80 | 5 |
| 91 | | | O | O | O | | | O | O | | | 81 | 5 |

FIG.11

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 92 | ○ | | ○ | | | ○ | | ○ | ○ | | | 82 | 5 |
| 93 | | ○ | ○ | | | ○ | | ○ | ○ | | | 83 | 5 |
| 94 | ○ | | | ○ | | ○ | | ○ | ○ | | | 84 | 5 |
| 95 | | ○ | | ○ | | ○ | | ○ | ○ | | | 85 | 5 |
| 96 | | | ○ | ○ | | ○ | | ○ | ○ | | | 86 | 5 |
| 97 | ○ | | | | ○ | ○ | | ○ | ○ | | | 87 | 5 |
| 98 | | ○ | | | ○ | ○ | | ○ | ○ | | | 88 | 5 |
| 99 | | | ○ | | ○ | ○ | | ○ | ○ | | | 89 | 5 |
| 100 | | | ○ | | ○ | ○ | | ○ | ○ | | | 89 | 5 |
| 101 | | ○ | | ○ | | | ○ | ○ | ○ | | | 90 | 5 |
| 102 | | | ○ | ○ | | | ○ | ○ | ○ | | | 91 | 5 |
| 103 | ○ | | | | ○ | | ○ | ○ | ○ | | | 92 | 5 |
| 104 | | ○ | | | ○ | | ○ | ○ | ○ | | | 93 | 5 |
| 105 | | | ○ | | ○ | | ○ | ○ | ○ | | | 94 | 6 |
| 106 | ○ | | ○ | | ○ | | | ○ | | ○ | | 95 | 6 |
| 107 | | ○ | ○ | | ○ | | | ○ | | ○ | | 96 | 6 |
| 108 | ○ | | | ○ | ○ | | | ○ | | ○ | | 97 | 6 |
| 109 | | ○ | | ○ | ○ | | | ○ | | ○ | | 98 | 6 |
| 110 | | | ○ | ○ | ○ | | | ○ | | ○ | | 99 | 6 |
| 111 | | | ○ | ○ | ○ | | | ○ | | ○ | | 99 | 6 |
| 112 | ○ | | ○ | | | ○ | | ○ | | ○ | | 100 | 6 |
| 113 | | ○ | ○ | | | ○ | | ○ | | ○ | | 101 | 6 |
| 114 | ○ | | | ○ | | ○ | | ○ | | ○ | | 102 | 6 |
| 115 | | ○ | | ○ | | ○ | | ○ | | ○ | | 103 | 6 |
| 116 | | | ○ | ○ | | ○ | | ○ | | ○ | | 104 | 6 |
| 117 | | | ○ | ○ | | ○ | | ○ | | ○ | | 104 | 6 |
| 118 | ○ | | ○ | ○ | | ○ | | ○ | | ○ | | 105 | 6 |
| 119 | | ○ | ○ | ○ | | ○ | | ○ | | ○ | | 106 | 6 |
| 120 | ○ | ○ | | | ○ | ○ | | ○ | | ○ | | 107 | 6 |
| 121 | ○ | | ○ | | ○ | ○ | | ○ | | ○ | | 108 | 6 |
| 122 | | ○ | ○ | | ○ | ○ | | ○ | | ○ | | 109 | 6 |
| 123 | | ○ | ○ | | ○ | ○ | | ○ | | ○ | | 109 | 6 |
| 124 | ○ | | ○ | ○ | | | ○ | ○ | | ○ | | 110 | 6 |
| 125 | | ○ | ○ | ○ | | | ○ | ○ | | ○ | | 111 | 6 |
| 126 | ○ | ○ | | | ○ | | ○ | ○ | | ○ | | 112 | 6 |
| 127 | ○ | | ○ | | ○ | | ○ | ○ | | ○ | | 113 | 6 |
| 128 | | ○ | ○ | | ○ | | ○ | ○ | | ○ | | 114 | 6 |
| 129 | | ○ | ○ | | ○ | | ○ | ○ | | ○ | | 114 | 6 |
| 130 | ○ | | | ○ | ○ | | ○ | ○ | | ○ | | 115 | 6 |
| 131 | | ○ | | ○ | ○ | | ○ | ○ | | ○ | | 116 | 6 |
| 132 | ○ | ○ | | ○ | | ○ | | | ○ | ○ | | 117 | 6 |
| 133 | ○ | | ○ | ○ | | ○ | | | ○ | ○ | | 118 | 6 |
| 134 | | ○ | ○ | ○ | | ○ | | | ○ | ○ | | 119 | 6 |
| 135 | | ○ | ○ | ○ | | ○ | | | ○ | ○ | | 119 | 6 |
| 136 | ○ | ○ | | | ○ | ○ | | | ○ | ○ | | 120 | 6 |
| 137 | ○ | | ○ | | ○ | ○ | | | ○ | ○ | | 121 | 6 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 138 | ○ | ○ | | ○ | | | ○ | | ○ | ○ | | 122 | 6 |
| 139 | ○ | | ○ | ○ | | | ○ | | ○ | ○ | | 123 | 6 |
| 140 | | ○ | ○ | ○ | | | ○ | | ○ | ○ | | 124 | 6 |
| 141 | ○ | ○ | | | ○ | | ○ | | ○ | ○ | | 125 | 6 |
| 142 | ○ | | ○ | | ○ | | ○ | | ○ | ○ | | 126 | 6 |
| 143 | | ○ | ○ | | ○ | | ○ | | ○ | ○ | | 127 | 6 |
| 144 | ○ | | | ○ | ○ | | ○ | | ○ | ○ | | 128 | 6 |
| 145 | | ○ | | ○ | ○ | | ○ | | ○ | ○ | | 129 | 6 |
| 146 | | ○ | | ○ | ○ | | ○ | | ○ | ○ | | 129 | 6 |
| 147 | | | ○ | ○ | ○ | | ○ | | ○ | ○ | | 130 | 6 |
| 148 | ○ | | ○ | | ○ | ○ | ○ | | ○ | ○ | | 131 | 6 |
| 149 | | ○ | ○ | | | ○ | ○ | | ○ | ○ | | 132 | 6 |
| 150 | ○ | | | ○ | | ○ | ○ | | ○ | ○ | | 133 | 6 |
| 151 | | ○ | | ○ | | ○ | ○ | | ○ | ○ | | 134 | 6 |
| 152 | | | ○ | ○ | | ○ | ○ | | ○ | ○ | | 135 | 6 |
| 153 | ○ | | | ○ | ○ | | | ○ | ○ | ○ | | 136 | 6 |
| 154 | | ○ | | ○ | ○ | | | ○ | ○ | ○ | | 137 | 6 |
| 155 | | | ○ | ○ | ○ | | | ○ | ○ | ○ | | 138 | 6 |
| 156 | ○ | | ○ | | | ○ | | ○ | ○ | ○ | | 139 | 6 |
| 157 | ○ | | ○ | | | ○ | | ○ | ○ | ○ | | 139 | 6 |
| 158 | | ○ | ○ | | | ○ | | ○ | ○ | ○ | | 140 | 6 |
| 159 | ○ | | | ○ | | ○ | | ○ | ○ | ○ | | 141 | 6 |
| 160 | | ○ | | ○ | | ○ | | ○ | ○ | ○ | | 142 | 6 |
| 161 | ○ | ○ | | ○ | | ○ | | | ○ | | ○ | 143 | 6 |
| 162 | ○ | | ○ | ○ | | ○ | | | ○ | | ○ | 144 | 6 |
| 163 | | ○ | ○ | ○ | | ○ | | | ○ | | ○ | 145 | 6 |
| 164 | ○ | ○ | | | ○ | ○ | | | ○ | | ○ | 146 | 6 |
| 165 | ○ | | ○ | | ○ | ○ | | | ○ | | ○ | 147 | 6 |
| 166 | ○ | ○ | | ○ | | | ○ | | ○ | | ○ | 148 | 6 |
| 167 | ○ | | ○ | ○ | | | ○ | | ○ | | ○ | 149 | 6 |
| 168 | ○ | | ○ | ○ | | | ○ | | ○ | | ○ | 149 | 6 |
| 169 | | ○ | ○ | ○ | | | ○ | | ○ | | ○ | 150 | 6 |
| 170 | ○ | ○ | | | ○ | | ○ | | ○ | | ○ | 151 | 6 |
| 171 | ○ | | ○ | | ○ | | ○ | | ○ | | ○ | 152 | 6 |
| 172 | | ○ | ○ | | ○ | | ○ | | ○ | | ○ | 153 | 6 |
| 173 | ○ | | | ○ | ○ | | ○ | | ○ | | ○ | 154 | 6 |
| 174 | | ○ | | ○ | ○ | | ○ | | ○ | | ○ | 155 | 6 |
| 175 | | | ○ | ○ | ○ | | ○ | | ○ | | ○ | 156 | 6 |
| 176 | ○ | | ○ | | | ○ | ○ | | ○ | | ○ | 157 | 6 |
| 177 | | ○ | ○ | | | ○ | ○ | | ○ | | ○ | 158 | 6 |
| 178 | ○ | | | ○ | | ○ | ○ | | ○ | | ○ | 159 | 6 |
| 179 | ○ | | | ○ | | ○ | ○ | | ○ | | ○ | 159 | 6 |
| 180 | | ○ | | ○ | | ○ | ○ | | ○ | | ○ | 160 | 6 |
| 181 | | | ○ | ○ | | ○ | ○ | | ○ | | ○ | 161 | 6 |
| 182 | ○ | | | ○ | ○ | | | ○ | ○ | | ○ | 162 | 6 |
| 183 | | ○ | | ○ | ○ | | | ○ | ○ | | ○ | 163 | 6 |

FIG.12

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 184 | | | ○ | ○ | ○ | | | ○ | ○ | | ○ | 164 | 6 |
| 185 | ○ | | ○ | | | ○ | | ○ | ○ | | ○ | 165 | 6 |
| 186 | | ○ | ○ | | | ○ | | ○ | ○ | | ○ | 166 | 6 |
| 187 | ○ | | | ○ | | ○ | | ○ | ○ | | ○ | 167 | 6 |
| 188 | | ○ | | ○ | | ○ | | ○ | ○ | | ○ | 168 | 7 |
| 189 | | | ○ | ○ | | ○ | | ○ | ○ | | ○ | 169 | 7 |
| 190 | | | ○ | ○ | | ○ | | ○ | ○ | | ○ | 169 | 7 |
| 191 | ○ | | ○ | | ○ | | ○ | | | ○ | ○ | 170 | 7 |
| 192 | | ○ | ○ | | ○ | | ○ | | | ○ | ○ | 171 | 7 |
| 193 | ○ | | | ○ | ○ | | ○ | | | ○ | ○ | 172 | 7 |
| 194 | | ○ | | ○ | ○ | | ○ | | | ○ | ○ | 173 | 7 |
| 195 | | | ○ | ○ | ○ | | ○ | | | ○ | ○ | 174 | 7 |
| 196 | ○ | | ○ | | | ○ | ○ | | | ○ | ○ | 175 | 7 |
| 197 | | ○ | ○ | | | ○ | ○ | | | ○ | ○ | 176 | 7 |
| 198 | ○ | | | ○ | | ○ | ○ | | | ○ | ○ | 177 | 7 |
| 199 | | ○ | | ○ | | ○ | ○ | | | ○ | ○ | 178 | 7 |
| 200 | | | ○ | ○ | | ○ | ○ | | | ○ | ○ | 179 | 7 |
| 201 | | | ○ | ○ | | ○ | ○ | | | ○ | ○ | 179 | 7 |
| 202 | ○ | | | ○ | ○ | | | ○ | | ○ | ○ | 180 | 7 |
| 203 | | ○ | | ○ | ○ | | | ○ | | ○ | ○ | 181 | 7 |
| 204 | | | ○ | ○ | ○ | | | ○ | | ○ | ○ | 182 | 7 |
| 205 | ○ | | ○ | | | ○ | | ○ | | ○ | ○ | 183 | 7 |
| 206 | | ○ | ○ | | | ○ | | ○ | | ○ | ○ | 184 | 7 |
| 207 | ○ | | | ○ | | ○ | | ○ | | ○ | ○ | 185 | 7 |
| 208 | | ○ | | ○ | | ○ | | ○ | | ○ | ○ | 186 | 7 |
| 209 | | | ○ | ○ | | ○ | | ○ | | ○ | ○ | 187 | 7 |
| 210 | ○ | | ○ | ○ | | ○ | | ○ | | ○ | ○ | 188 | 7 |
| 211 | | ○ | ○ | ○ | | ○ | | ○ | | ○ | ○ | 189 | 7 |
| 212 | | ○ | ○ | ○ | | ○ | | ○ | | ○ | ○ | 189 | 7 |
| 213 | ○ | ○ | | | ○ | ○ | | ○ | | ○ | ○ | 190 | 7 |
| 214 | ○ | | ○ | | ○ | ○ | | ○ | | ○ | ○ | 191 | 7 |
| 215 | ○ | ○ | | ○ | | | ○ | ○ | | ○ | ○ | 192 | 7 |
| 216 | ○ | | ○ | ○ | | | ○ | ○ | | ○ | ○ | 193 | 7 |
| 217 | | ○ | ○ | ○ | | | ○ | ○ | | ○ | ○ | 194 | 7 |
| 218 | ○ | ○ | | | ○ | | ○ | ○ | | ○ | ○ | 195 | 7 |
| 219 | ○ | | ○ | | ○ | | ○ | ○ | | ○ | ○ | 196 | 7 |
| 220 | | ○ | ○ | | ○ | | ○ | ○ | | ○ | ○ | 197 | 7 |
| 221 | ○ | | | ○ | ○ | | ○ | ○ | | ○ | ○ | 198 | 7 |
| 222 | | ○ | | ○ | ○ | | ○ | ○ | | ○ | ○ | 199 | 7 |
| 223 | | ○ | | ○ | ○ | | ○ | ○ | | ○ | ○ | 199 | 7 |
| 224 | | | ○ | ○ | ○ | | ○ | ○ | | ○ | ○ | 200 | 7 |
| 225 | ○ | | ○ | | | ○ | ○ | ○ | | ○ | ○ | 201 | 7 |
| 226 | | ○ | ○ | | | ○ | ○ | ○ | | ○ | ○ | 202 | 8 |
| 227 | ○ | | | ○ | | ○ | ○ | ○ | | ○ | ○ | 203 | 8 |
| 228 | ○ | | ○ | | ○ | ○ | | | ○ | ○ | ○ | 204 | 8 |
| 229 | ○ | ○ | | ○ | | | ○ | | ○ | ○ | ○ | 205 | 8 |

| Input Gray-Scale Level | Subframe (SF) | | | | | | | | | | | Output Gray-Scale Level | Number of Selected SFs |
|---|---|---|---|---|---|---|---|---|---|---|---|---|---|
| | SF1 | SF2 | SF3 | SF4 | SF5 | SF6 | SF7 | SF8 | SF9 | SF10 | SF11 | | |
| | 1 | 2 | 3 | 5 | 8 | 13 | 18 | 26 | 39 | 57 | 83 | | |
| 230 | ○ | | ○ | ○ | | | ○ | | ○ | ○ | ○ | 206 | 8 |
| 231 | | ○ | ○ | ○ | | | ○ | | ○ | ○ | ○ | 207 | 8 |
| 232 | ○ | ○ | | | ○ | | ○ | | ○ | ○ | ○ | 208 | 8 |
| 233 | ○ | | ○ | | ○ | | ○ | | ○ | ○ | ○ | 209 | 8 |
| 234 | ○ | | ○ | | ○ | | ○ | | ○ | ○ | ○ | 209 | 8 |
| 235 | | ○ | ○ | | ○ | | ○ | | ○ | ○ | ○ | 210 | 8 |
| 236 | ○ | | | ○ | ○ | | ○ | | ○ | ○ | ○ | 211 | 8 |
| 237 | | ○ | | ○ | ○ | | ○ | | ○ | ○ | ○ | 212 | 8 |
| 238 | | | ○ | ○ | ○ | | ○ | | ○ | ○ | ○ | 213 | 8 |
| 239 | ○ | | ○ | | | ○ | ○ | | ○ | ○ | ○ | 214 | 8 |
| 240 | | ○ | ○ | | | ○ | ○ | | ○ | ○ | ○ | 215 | 8 |
| 241 | ○ | | | ○ | | ○ | ○ | | ○ | ○ | ○ | 216 | 8 |
| 242 | ○ | | ○ | | ○ | | | ○ | ○ | ○ | ○ | 217 | 8 |
| 243 | | ○ | ○ | | ○ | | | ○ | ○ | ○ | ○ | 218 | 8 |
| 244 | ○ | | | ○ | ○ | | | ○ | ○ | ○ | ○ | 219 | 9 |
| 245 | ○ | | | ○ | ○ | | | ○ | ○ | ○ | ○ | 219 | 9 |
| 246 | | ○ | | ○ | ○ | | | ○ | ○ | ○ | ○ | 220 | 9 |
| 247 | | | ○ | ○ | ○ | | | ○ | ○ | ○ | ○ | 221 | 9 |
| 248 | ○ | | ○ | | | ○ | | ○ | ○ | ○ | ○ | 222 | 9 |
| 249 | | ○ | ○ | | | ○ | | ○ | ○ | ○ | ○ | 223 | 9 |
| 250 | ○ | | | ○ | | ○ | | ○ | ○ | ○ | ○ | 224 | 9 |
| 251 | | ○ | | ○ | | ○ | | ○ | ○ | ○ | ○ | 225 | 9 |
| 252 | ○ | ○ | | ○ | | ○ | | ○ | ○ | ○ | ○ | 226 | 10 |
| 253 | ○ | | ○ | ○ | | ○ | | ○ | ○ | ○ | ○ | 227 | 10 |
| 254 | | ○ | ○ | ○ | | ○ | | ○ | ○ | ○ | ○ | 228 | 10 |
| 255 | ○ | ○ | | | ○ | ○ | | ○ | ○ | ○ | ○ | 229 | 11 |

FIG.24

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 0 | | | | | | | | | | | | 0 |
| 1 | ○ | | | | | | | | | | | 1 |
| 2 | | ○ | | | | | | | | | | 2 |
| 3 | ○ | ○ | | | | | | | | | | 3 |
| 4 | ○ | | ○ | | | | | | | | | 4 |
| 5 | | ○ | ○ | | | | | | | | | 5 |
| 6 | ○ | | | ○ | | | | | | | | 6 |
| 7 | | ○ | | ○ | | | | | | | | 7 |
| 8 | | | ○ | ○ | | | | | | | | 8 |
| 9 | ○ | | ○ | ○ | | | | | | | | 9 |
| 10 | | ○ | ○ | ○ | | | | | | | | 10 |
| 11 | ○ | ○ | | | ○ | | | | | | | 11 |
| 12 | ○ | | ○ | | ○ | | | | | | | 12 |
| 13 | | ○ | ○ | | ○ | | | | | | | 13 |
| 14 | ○ | | | ○ | ○ | | | | | | | 14 |
| 15 | | ○ | | ○ | ○ | | | | | | | 15 |
| 16 | | | ○ | ○ | ○ | | | | | | | 16 |
| 17 | ○ | | ○ | | | ○ | | | | | | 17 |
| 18 | | ○ | ○ | | | ○ | | | | | | 18 |
| 19 | ○ | | | ○ | | ○ | | | | | | 19 |
| 20 | | ○ | | ○ | | ○ | | | | | | 20 |
| 21 | | | ○ | ○ | | ○ | | | | | | 21 |
| 22 | ○ | | ○ | ○ | | ○ | | | | | | 22 |
| 23 | | ○ | ○ | ○ | | ○ | | | | | | 23 |
| 24 | ○ | ○ | | | ○ | ○ | | | | | | 24 |
| 25 | ○ | | ○ | | ○ | ○ | | | | | | 25 |
| 26 | | ○ | ○ | | ○ | ○ | | | | | | 26 |
| 27 | ○ | | | ○ | ○ | ○ | | | | | | 27 |
| 28 | | ○ | | ○ | ○ | ○ | | | | | | 28 |
| 29 | ○ | ○ | | | ○ | | ○ | | | | | 29 |
| 30 | ○ | | ○ | | ○ | | ○ | | | | | 30 |
| 31 | | ○ | ○ | | ○ | | ○ | | | | | 31 |
| 32 | ○ | | | ○ | ○ | | ○ | | | | | 32 |
| 33 | | ○ | | ○ | ○ | | ○ | | | | | 33 |
| 34 | | | ○ | ○ | ○ | | ○ | | | | | 34 |
| 35 | ○ | | ○ | | | ○ | ○ | | | | | 35 |
| 36 | | ○ | ○ | | | ○ | ○ | | | | | 36 |
| 37 | ○ | | | ○ | | ○ | ○ | | | | | 37 |
| 38 | | ○ | | ○ | | ○ | ○ | | | | | 38 |
| 39 | | | ○ | ○ | | ○ | ○ | | | | | 39 |
| 40 | ○ | | | | ○ | ○ | ○ | | | | | 40 |
| 41 | | ○ | | | ○ | ○ | ○ | | | | | 41 |
| 42 | | | ○ | | ○ | ○ | ○ | | | | | 42 |
| 43 | ○ | | ○ | | | ○ | | ○ | | | | 43 |
| 44 | | ○ | ○ | | | ○ | | ○ | | | | 44 |
| 45 | ○ | | | ○ | | ○ | | ○ | | | | 45 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 0 | | | | | | | | | | | | 0 |
| 1 | ○ | | | | | | | | | | | 1 |
| 2 | | ○ | | | | | | | | | | 2 |
| 3 | ○ | ○ | | | | | | | | | | 3 |
| 4 | ○ | | ○ | | | | | | | | | 4 |
| 5 | | ○ | ○ | | | | | | | | | 5 |
| 6 | ○ | | | ○ | | | | | | | | 6 |
| 7 | | ○ | | ○ | | | | | | | | 7 |
| 8 | | | ○ | ○ | | | | | | | | 8 |
| 9 | ○ | | ○ | ○ | | | | | | | | 9 |
| 10 | ○ | | ○ | ○ | | | | | | | | 9 |
| 11 | | ○ | ○ | ○ | | | | | | | | 10 |
| 12 | ○ | ○ | | | ○ | | | | | | | 11 |
| 13 | ○ | | ○ | | ○ | | | | | | | 12 |
| 14 | | ○ | ○ | | ○ | | | | | | | 13 |
| 15 | ○ | | | ○ | ○ | | | | | | | 14 |
| 16 | | ○ | | ○ | ○ | | | | | | | 15 |
| 17 | | | ○ | ○ | ○ | | | | | | | 16 |
| 18 | ○ | | ○ | | | ○ | | | | | | 17 |
| 19 | | ○ | ○ | | | ○ | | | | | | 18 |
| 20 | ○ | | | ○ | | ○ | | | | | | 19 |
| 21 | ○ | | | ○ | | ○ | | | | | | 19 |
| 22 | | ○ | | ○ | | ○ | | | | | | 20 |
| 23 | | | ○ | ○ | | ○ | | | | | | 21 |
| 24 | ○ | | ○ | ○ | | ○ | | | | | | 22 |
| 25 | | ○ | ○ | ○ | | ○ | | | | | | 23 |
| 26 | ○ | ○ | | | ○ | ○ | | | | | | 24 |
| 27 | ○ | ○ | | | ○ | ○ | | | | | | 24 |
| 28 | ○ | | ○ | | ○ | ○ | | | | | | 25 |
| 29 | | ○ | ○ | | ○ | ○ | | | | | | 26 |
| 30 | ○ | | | ○ | ○ | ○ | | | | | | 27 |
| 31 | | ○ | | ○ | ○ | ○ | | | | | | 28 |
| 32 | ○ | ○ | | | ○ | | ○ | | | | | 29 |
| 33 | ○ | ○ | | | ○ | | ○ | | | | | 29 |
| 34 | ○ | | ○ | | ○ | | ○ | | | | | 30 |
| 35 | | ○ | ○ | | ○ | | ○ | | | | | 31 |
| 36 | ○ | | | ○ | ○ | | ○ | | | | | 32 |
| 37 | | ○ | | ○ | ○ | | ○ | | | | | 33 |
| 38 | | | ○ | ○ | ○ | | ○ | | | | | 34 |
| 39 | ○ | | ○ | | | ○ | ○ | | | | | 35 |
| 40 | | ○ | ○ | | | ○ | ○ | | | | | 36 |
| 41 | ○ | | | ○ | | ○ | ○ | | | | | 37 |
| 42 | | ○ | | ○ | | ○ | ○ | | | | | 38 |
| 43 | | | ○ | ○ | | ○ | ○ | | | | | 39 |
| 44 | | | ○ | ○ | | ○ | ○ | | | | | 39 |
| 45 | ○ | | | | ○ | ○ | ○ | | | | | 40 |

(B) SECOND TABLE (CODING b)

FIG.25

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 46 | | ○ | | ○ | | ○ | | ○ | | | | 46 |
| 47 | | | ○ | ○ | | ○ | | ○ | | | | 47 |
| 48 | ○ | | ○ | ○ | | ○ | | ○ | | | | 48 |
| 49 | | ○ | ○ | ○ | | ○ | | ○ | | | | 49 |
| 50 | ○ | ○ | | | ○ | ○ | | ○ | | | | 50 |
| 51 | ○ | | ○ | | ○ | ○ | | ○ | | | | 51 |
| 52 | | ○ | ○ | | ○ | ○ | | ○ | | | | 52 |
| 53 | ○ | | ○ | ○ | | | ○ | ○ | | | | 53 |
| 54 | | ○ | ○ | ○ | | | ○ | ○ | | | | 54 |
| 55 | ○ | ○ | | | ○ | | ○ | ○ | | | | 55 |
| 56 | ○ | | ○ | | ○ | | ○ | ○ | | | | 56 |
| 57 | | ○ | ○ | | ○ | | ○ | ○ | | | | 57 |
| 58 | ○ | | | ○ | ○ | | ○ | ○ | | | | 58 |
| 59 | | ○ | | ○ | ○ | | ○ | ○ | | | | 59 |
| 60 | | | ○ | ○ | ○ | | ○ | ○ | | | | 60 |
| 61 | ○ | | ○ | | | ○ | ○ | ○ | | | | 61 |
| 62 | | ○ | ○ | | | ○ | ○ | ○ | | | | 62 |
| 63 | ○ | | | ○ | | ○ | ○ | ○ | | | | 63 |
| 64 | | ○ | | ○ | | ○ | ○ | ○ | | | | 64 |
| 65 | | | ○ | ○ | | ○ | ○ | ○ | | | | 65 |
| 66 | ○ | | ○ | ○ | | | ○ | | ○ | | | 66 |
| 67 | | ○ | ○ | ○ | | | ○ | | ○ | | | 67 |
| 68 | ○ | ○ | | | ○ | | ○ | | ○ | | | 68 |
| 69 | ○ | | ○ | | ○ | | ○ | | ○ | | | 69 |
| 70 | | ○ | ○ | | ○ | | ○ | | ○ | | | 70 |
| 71 | ○ | | | ○ | ○ | | ○ | | ○ | | | 71 |
| 72 | | ○ | | ○ | ○ | | ○ | | ○ | | | 72 |
| 73 | | | ○ | ○ | ○ | | ○ | | ○ | | | 73 |
| 74 | ○ | | ○ | | | ○ | ○ | | ○ | | | 74 |
| 75 | | ○ | ○ | | | ○ | ○ | | ○ | | | 75 |
| 76 | ○ | | | ○ | | ○ | ○ | | ○ | | | 76 |
| 77 | | ○ | | ○ | | ○ | ○ | | ○ | | | 77 |
| 78 | | | ○ | ○ | | ○ | ○ | | ○ | | | 78 |
| 79 | ○ | | | ○ | ○ | | | ○ | ○ | | | 79 |
| 80 | | ○ | | ○ | ○ | | | ○ | ○ | | | 80 |
| 81 | | | ○ | ○ | ○ | | | ○ | ○ | | | 81 |
| 82 | ○ | | ○ | | | ○ | | ○ | ○ | | | 82 |
| 83 | | ○ | ○ | | | ○ | | ○ | ○ | | | 83 |
| 84 | ○ | | | ○ | | ○ | | ○ | ○ | | | 84 |
| 85 | | ○ | | ○ | | ○ | | ○ | ○ | | | 85 |
| 86 | | | ○ | ○ | | ○ | | ○ | ○ | | | 86 |
| 87 | ○ | | | | ○ | ○ | | ○ | ○ | | | 87 |
| 88 | | ○ | | | ○ | ○ | | ○ | ○ | | | 88 |
| 89 | | | ○ | | ○ | ○ | | ○ | ○ | | | 89 |
| 90 | | ○ | | ○ | | | ○ | ○ | ○ | | | 90 |
| 91 | | | ○ | ○ | | | ○ | ○ | ○ | | | 91 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 46 | | ○ | | | ○ | ○ | ○ | | | | | 41 |
| 47 | | | ○ | | ○ | ○ | ○ | | | | | 42 |
| 48 | ○ | | ○ | | | ○ | | ○ | | | | 43 |
| 49 | | ○ | ○ | | | ○ | | ○ | | | | 44 |
| 50 | ○ | | | ○ | | ○ | | ○ | | | | 45 |
| 51 | | ○ | | ○ | | ○ | | ○ | | | | 46 |
| 52 | | | ○ | ○ | | ○ | | ○ | | | | 47 |
| 53 | ○ | | ○ | ○ | | ○ | | ○ | | | | 48 |
| 54 | | ○ | ○ | ○ | | ○ | | ○ | | | | 49 |
| 55 | | ○ | ○ | ○ | | ○ | | ○ | | | | 49 |
| 56 | ○ | ○ | | | ○ | ○ | | ○ | | | | 50 |
| 57 | ○ | | ○ | | ○ | ○ | | ○ | | | | 51 |
| 58 | | ○ | ○ | | ○ | ○ | | ○ | | | | 52 |
| 59 | ○ | | ○ | ○ | | | ○ | ○ | | | | 53 |
| 60 | | ○ | ○ | ○ | | | ○ | ○ | | | | 54 |
| 61 | | ○ | ○ | ○ | | | ○ | ○ | | | | 54 |
| 62 | ○ | ○ | | | ○ | | ○ | ○ | | | | 55 |
| 63 | ○ | | ○ | | ○ | | ○ | ○ | | | | 56 |
| 64 | | ○ | ○ | | ○ | | ○ | ○ | | | | 57 |
| 65 | ○ | | | ○ | ○ | | ○ | ○ | | | | 58 |
| 66 | | ○ | | ○ | ○ | | ○ | ○ | | | | 59 |
| 67 | | ○ | | ○ | ○ | | ○ | ○ | | | | 59 |
| 68 | | | ○ | ○ | ○ | | ○ | ○ | | | | 60 |
| 69 | ○ | | ○ | | | ○ | ○ | ○ | | | | 61 |
| 70 | | ○ | ○ | | | ○ | ○ | ○ | | | | 62 |
| 71 | ○ | | | ○ | | ○ | ○ | ○ | | | | 63 |
| 72 | | ○ | | ○ | | ○ | ○ | ○ | | | | 64 |
| 73 | | | ○ | ○ | | ○ | ○ | ○ | | | | 65 |
| 74 | ○ | | ○ | ○ | | | ○ | | ○ | | | 66 |
| 75 | | ○ | ○ | ○ | | | ○ | | ○ | | | 67 |
| 76 | ○ | ○ | | | ○ | | ○ | | ○ | | | 68 |
| 77 | ○ | | ○ | | ○ | | ○ | | ○ | | | 69 |
| 78 | ○ | | ○ | | ○ | | ○ | | ○ | | | 69 |
| 79 | | ○ | ○ | | ○ | | ○ | | ○ | | | 70 |
| 80 | ○ | | | ○ | ○ | | ○ | | ○ | | | 71 |
| 81 | | ○ | | ○ | ○ | | ○ | | ○ | | | 72 |
| 82 | | | ○ | ○ | ○ | | ○ | | ○ | | | 73 |
| 83 | ○ | | ○ | | | ○ | ○ | | ○ | | | 74 |
| 84 | | ○ | ○ | | | ○ | ○ | | ○ | | | 75 |
| 85 | ○ | | | ○ | | ○ | ○ | | ○ | | | 76 |
| 86 | | ○ | | ○ | | ○ | ○ | | ○ | | | 77 |
| 87 | | | ○ | ○ | | ○ | ○ | | ○ | | | 78 |
| 88 | ○ | | | ○ | ○ | | | ○ | ○ | | | 79 |
| 89 | ○ | | | ○ | ○ | | | ○ | ○ | | | 79 |
| 90 | | ○ | | ○ | ○ | | | ○ | ○ | | | 80 |
| 91 | | | ○ | ○ | ○ | | | ○ | ○ | | | 81 |

(B) SECOND TABLE (CODING b)

FIG.26

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 92 | ○ | | | | ○ | | ○ | ○ | ○ | | | 92 |
| 93 | | ○ | | | ○ | | ○ | ○ | ○ | | | 93 |
| 94 | | | ○ | | ○ | | ○ | ○ | ○ | | | 94 |
| 95 | ○ | | ○ | | ○ | | | ○ | | ○ | | 95 |
| 96 | | ○ | ○ | | ○ | | | ○ | | ○ | | 96 |
| 97 | ○ | | | ○ | ○ | | | ○ | | ○ | | 97 |
| 98 | | ○ | | ○ | ○ | | | ○ | | ○ | | 98 |
| 99 | | | ○ | ○ | ○ | | | ○ | | ○ | | 99 |
| 100 | ○ | | ○ | | | ○ | | ○ | | ○ | | 100 |
| 101 | | ○ | ○ | | | ○ | | ○ | | ○ | | 101 |
| 102 | ○ | | | ○ | | ○ | | ○ | | ○ | | 102 |
| 103 | | ○ | | ○ | | ○ | | ○ | | ○ | | 103 |
| 104 | | | ○ | ○ | | ○ | | ○ | | ○ | | 104 |
| 105 | ○ | | ○ | ○ | | ○ | | ○ | | ○ | | 105 |
| 106 | | ○ | ○ | ○ | | ○ | | ○ | | ○ | | 106 |
| 107 | ○ | ○ | | | ○ | ○ | | ○ | | ○ | | 107 |
| 108 | ○ | | ○ | | ○ | ○ | | ○ | | ○ | | 108 |
| 109 | | ○ | ○ | | ○ | ○ | | ○ | | ○ | | 109 |
| 110 | ○ | | ○ | ○ | | | ○ | ○ | | ○ | | 110 |
| 111 | | ○ | ○ | ○ | | | ○ | ○ | | ○ | | 111 |
| 112 | ○ | ○ | | | ○ | | ○ | ○ | | ○ | | 112 |
| 113 | ○ | | ○ | | ○ | | ○ | ○ | | ○ | | 113 |
| 114 | | ○ | ○ | | ○ | | ○ | ○ | | ○ | | 114 |
| 115 | ○ | | | ○ | ○ | | ○ | ○ | | ○ | | 115 |
| 116 | | ○ | | ○ | ○ | | ○ | ○ | | ○ | | 116 |
| 117 | ○ | ○ | | ○ | | ○ | | | ○ | ○ | | 117 |
| 118 | ○ | | ○ | ○ | | ○ | | | ○ | ○ | | 118 |
| 119 | | ○ | ○ | ○ | | ○ | | | ○ | ○ | | 119 |
| 120 | ○ | ○ | | | ○ | ○ | | | ○ | ○ | | 120 |
| 121 | ○ | | ○ | | ○ | ○ | | | ○ | ○ | | 121 |
| 122 | ○ | ○ | | ○ | | | ○ | | ○ | ○ | | 122 |
| 123 | ○ | | ○ | ○ | | | ○ | | ○ | ○ | | 123 |
| 124 | | ○ | ○ | ○ | | | ○ | | ○ | ○ | | 124 |
| 125 | ○ | ○ | | | ○ | | ○ | | ○ | ○ | | 125 |
| 126 | ○ | | ○ | | ○ | | ○ | | ○ | ○ | | 126 |
| 127 | | ○ | ○ | | ○ | | ○ | | ○ | ○ | | 127 |
| 128 | ○ | | | ○ | ○ | | ○ | | ○ | ○ | | 128 |
| 129 | | ○ | | ○ | ○ | | ○ | | ○ | ○ | | 129 |
| 130 | | | ○ | ○ | ○ | | ○ | | ○ | ○ | | 130 |
| 131 | ○ | | ○ | | | ○ | ○ | | ○ | ○ | | 131 |
| 132 | | ○ | ○ | | | ○ | ○ | | ○ | ○ | | 132 |
| 133 | ○ | | | ○ | | ○ | ○ | | ○ | ○ | | 133 |
| 134 | | ○ | | ○ | | ○ | ○ | | ○ | ○ | | 134 |
| 135 | | | ○ | ○ | | ○ | ○ | | ○ | ○ | | 135 |
| 136 | ○ | | | ○ | ○ | | | ○ | ○ | ○ | | 136 |
| 137 | | ○ | | ○ | ○ | | | ○ | ○ | ○ | | 137 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 92 | ○ | | ○ | | | ○ | | ○ | ○ | | | 82 |
| 93 | | ○ | ○ | | | ○ | | ○ | ○ | | | 83 |
| 94 | ○ | | | ○ | | ○ | | ○ | ○ | | | 84 |
| 95 | | ○ | | ○ | | ○ | | ○ | ○ | | | 85 |
| 96 | | | ○ | ○ | | ○ | | ○ | ○ | | | 86 |
| 97 | ○ | | | | ○ | ○ | | ○ | ○ | | | 87 |
| 98 | | ○ | | | ○ | ○ | | ○ | ○ | | | 88 |
| 99 | | | ○ | | ○ | ○ | | ○ | ○ | | | 89 |
| 100 | | | ○ | | ○ | ○ | | ○ | ○ | | | 89 |
| 101 | | ○ | | ○ | | | ○ | ○ | ○ | | | 90 |
| 102 | | | ○ | ○ | | | ○ | ○ | ○ | | | 91 |
| 103 | ○ | | | | ○ | | ○ | ○ | ○ | | | 92 |
| 104 | | ○ | | | ○ | | ○ | ○ | ○ | | | 93 |
| 105 | | | ○ | | ○ | | ○ | ○ | ○ | | | 94 |
| 106 | ○ | | ○ | | ○ | | | ○ | | ○ | | 95 |
| 107 | | ○ | ○ | | ○ | | | ○ | | ○ | | 96 |
| 108 | ○ | | | ○ | ○ | | | ○ | | ○ | | 97 |
| 109 | | ○ | | ○ | ○ | | | ○ | | ○ | | 98 |
| 110 | | | ○ | ○ | ○ | | | ○ | | ○ | | 99 |
| 111 | | | ○ | ○ | ○ | | | ○ | | ○ | | 99 |
| 112 | ○ | | ○ | | | ○ | | ○ | | ○ | | 100 |
| 113 | | ○ | ○ | | | ○ | | ○ | | ○ | | 101 |
| 114 | ○ | | | ○ | | ○ | | ○ | | ○ | | 102 |
| 115 | | ○ | | ○ | | ○ | | ○ | | ○ | | 103 |
| 116 | | | ○ | ○ | | ○ | | ○ | | ○ | | 104 |
| 117 | | | ○ | ○ | | ○ | | ○ | | ○ | | 104 |
| 118 | ○ | | ○ | ○ | | ○ | | ○ | | ○ | | 105 |
| 119 | | ○ | ○ | ○ | | ○ | | ○ | | ○ | | 106 |
| 120 | ○ | ○ | | | ○ | ○ | | ○ | | ○ | | 107 |
| 121 | ○ | | ○ | | ○ | ○ | | ○ | | ○ | | 108 |
| 122 | | ○ | ○ | | ○ | ○ | | ○ | | ○ | | 109 |
| 123 | | ○ | ○ | | ○ | ○ | | ○ | | ○ | | 109 |
| 124 | ○ | | ○ | ○ | | | ○ | ○ | | ○ | | 110 |
| 125 | | ○ | ○ | ○ | | | ○ | ○ | | ○ | | 111 |
| 126 | ○ | ○ | | | ○ | | ○ | ○ | | ○ | | 112 |
| 127 | ○ | | ○ | | ○ | | ○ | ○ | | ○ | | 113 |
| 128 | | ○ | ○ | | ○ | | ○ | ○ | | ○ | | 114 |
| 129 | | ○ | ○ | | ○ | | ○ | ○ | | ○ | | 114 |
| 130 | ○ | | | ○ | ○ | | ○ | ○ | | ○ | | 115 |
| 131 | | ○ | | ○ | ○ | | ○ | ○ | | ○ | | 116 |
| 132 | ○ | ○ | | ○ | | ○ | | | ○ | ○ | | 117 |
| 133 | ○ | | ○ | ○ | | ○ | | | ○ | ○ | | 118 |
| 134 | | ○ | ○ | ○ | | ○ | | | ○ | ○ | | 119 |
| 135 | | ○ | ○ | ○ | | ○ | | | ○ | ○ | | 119 |
| 136 | ○ | ○ | | | ○ | ○ | | | ○ | ○ | | 120 |
| 137 | ○ | | ○ | | ○ | ○ | | | ○ | ○ | | 121 |

(B) SECOND TABLE (CODING b)

FIG.27

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 138 | | | ○ | ○ | ○ | | | ○ | ○ | ○ | | 138 |
| 139 | ○ | | ○ | | | ○ | | ○ | ○ | ○ | | 139 |
| 140 | | ○ | ○ | | | ○ | | ○ | ○ | ○ | | 140 |
| 141 | ○ | | | ○ | | ○ | | ○ | ○ | ○ | | 141 |
| 142 | | ○ | | ○ | | ○ | | ○ | ○ | ○ | | 142 |
| 143 | ○ | ○ | | ○ | | ○ | | | ○ | | ○ | 143 |
| 144 | ○ | | ○ | ○ | | ○ | | | ○ | | ○ | 144 |
| 145 | | ○ | ○ | ○ | | ○ | | | ○ | | ○ | 145 |
| 146 | ○ | ○ | | | ○ | ○ | | | ○ | | ○ | 146 |
| 147 | ○ | | ○ | | ○ | ○ | | | ○ | | ○ | 147 |
| 148 | ○ | ○ | | ○ | | | ○ | | ○ | | ○ | 148 |
| 149 | ○ | | ○ | ○ | | | ○ | | ○ | | ○ | 149 |
| 150 | | ○ | ○ | ○ | | | ○ | | ○ | | ○ | 150 |
| 151 | ○ | ○ | | | ○ | | ○ | | ○ | | ○ | 151 |
| 152 | ○ | | ○ | | ○ | | ○ | | ○ | | ○ | 152 |
| 153 | | ○ | ○ | | ○ | | ○ | | ○ | | ○ | 153 |
| 154 | ○ | | | ○ | ○ | | ○ | | ○ | | ○ | 154 |
| 155 | | ○ | | ○ | ○ | | ○ | | ○ | | ○ | 155 |
| 156 | | | ○ | ○ | ○ | | ○ | | ○ | | ○ | 156 |
| 157 | ○ | | ○ | | | ○ | ○ | | ○ | | ○ | 157 |
| 158 | | ○ | ○ | | | ○ | ○ | | ○ | | ○ | 158 |
| 159 | ○ | | | ○ | | ○ | ○ | | ○ | | ○ | 159 |
| 160 | | ○ | | ○ | | ○ | ○ | | ○ | | ○ | 160 |
| 161 | | | ○ | ○ | | ○ | ○ | | ○ | | ○ | 161 |
| 162 | ○ | | | ○ | ○ | | | ○ | ○ | | ○ | 162 |
| 163 | | ○ | | ○ | ○ | | | ○ | ○ | | ○ | 163 |
| 164 | | | ○ | ○ | ○ | | | ○ | ○ | | ○ | 164 |
| 165 | ○ | | ○ | | | ○ | | ○ | ○ | | ○ | 165 |
| 166 | | ○ | ○ | | | ○ | | ○ | ○ | | ○ | 166 |
| 167 | ○ | | | ○ | | ○ | | ○ | ○ | | ○ | 167 |
| 168 | | ○ | | ○ | | ○ | | ○ | ○ | | ○ | 168 |
| 169 | | | ○ | ○ | | ○ | | ○ | ○ | | ○ | 169 |
| 170 | ○ | | ○ | | ○ | | ○ | | | ○ | ○ | 170 |
| 171 | | ○ | ○ | | ○ | | ○ | | | ○ | ○ | 171 |
| 172 | ○ | | | ○ | ○ | | ○ | | | ○ | ○ | 172 |
| 173 | | ○ | | ○ | ○ | | ○ | | | ○ | ○ | 173 |
| 174 | | | ○ | ○ | ○ | | ○ | | | ○ | ○ | 174 |
| 175 | ○ | | ○ | | | ○ | ○ | | | ○ | ○ | 175 |
| 176 | | ○ | ○ | | | ○ | ○ | | | ○ | ○ | 176 |
| 177 | ○ | | | ○ | | ○ | ○ | | | ○ | ○ | 177 |
| 178 | | ○ | | ○ | | ○ | ○ | | | ○ | ○ | 178 |
| 179 | | | ○ | ○ | | ○ | ○ | | | ○ | ○ | 179 |
| 180 | ○ | | | ○ | ○ | | | ○ | | ○ | ○ | 180 |
| 181 | | ○ | | ○ | ○ | | | ○ | | ○ | ○ | 181 |
| 182 | | | ○ | ○ | ○ | | | ○ | | ○ | ○ | 182 |
| 183 | ○ | | ○ | | | ○ | | ○ | | ○ | ○ | 183 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 138 | ○ | ○ | | ○ | | | ○ | | ○ | ○ | | 122 |
| 139 | ○ | | ○ | ○ | | | ○ | | ○ | ○ | | 123 |
| 140 | | ○ | ○ | ○ | | | ○ | | ○ | ○ | | 124 |
| 141 | ○ | ○ | | | ○ | | ○ | | ○ | ○ | | 125 |
| 142 | ○ | | ○ | | ○ | | ○ | | ○ | ○ | | 126 |
| 143 | | ○ | ○ | | ○ | | ○ | | ○ | ○ | | 127 |
| 144 | ○ | | | ○ | ○ | | ○ | | ○ | ○ | | 128 |
| 145 | | ○ | | ○ | ○ | | ○ | | ○ | ○ | | 129 |
| 146 | | ○ | | ○ | ○ | | ○ | | ○ | ○ | | 129 |
| 147 | | | ○ | ○ | ○ | | ○ | | ○ | ○ | | 130 |
| 148 | ○ | | ○ | | | ○ | ○ | | ○ | ○ | | 131 |
| 149 | | ○ | ○ | | | ○ | ○ | | ○ | ○ | | 132 |
| 150 | ○ | | | ○ | | ○ | ○ | | ○ | ○ | | 133 |
| 151 | | ○ | | ○ | | ○ | ○ | | ○ | ○ | | 134 |
| 152 | | | ○ | ○ | | ○ | ○ | | ○ | ○ | | 135 |
| 153 | ○ | | | ○ | ○ | | | ○ | ○ | ○ | | 136 |
| 154 | | ○ | | ○ | ○ | | | ○ | ○ | ○ | | 137 |
| 155 | | | ○ | ○ | ○ | | | ○ | ○ | ○ | | 138 |
| 156 | ○ | | ○ | | | ○ | | ○ | ○ | ○ | | 139 |
| 157 | ○ | | ○ | | | ○ | | ○ | ○ | ○ | | 139 |
| 158 | | ○ | ○ | | | ○ | | ○ | ○ | ○ | | 140 |
| 159 | ○ | | | ○ | | ○ | | ○ | ○ | ○ | | 141 |
| 160 | | ○ | | ○ | | ○ | | ○ | ○ | ○ | | 142 |
| 161 | ○ | ○ | | ○ | | ○ | | | ○ | | ○ | 143 |
| 162 | ○ | | ○ | ○ | | ○ | | | ○ | | ○ | 144 |
| 163 | | ○ | ○ | ○ | | ○ | | | ○ | | ○ | 145 |
| 164 | ○ | ○ | | | ○ | ○ | | | ○ | | ○ | 146 |
| 165 | ○ | | ○ | | ○ | ○ | | | ○ | | ○ | 147 |
| 166 | ○ | ○ | | ○ | | | ○ | | ○ | | ○ | 148 |
| 167 | ○ | | ○ | ○ | | | ○ | | ○ | | ○ | 149 |
| 168 | ○ | | ○ | ○ | | | ○ | | ○ | | ○ | 149 |
| 169 | | ○ | ○ | ○ | | | ○ | | ○ | | ○ | 150 |
| 170 | ○ | ○ | | | ○ | | ○ | | ○ | | ○ | 151 |
| 171 | ○ | | ○ | | ○ | | ○ | | ○ | | ○ | 152 |
| 172 | | ○ | ○ | | ○ | | ○ | | ○ | | ○ | 153 |
| 173 | ○ | | | ○ | ○ | | ○ | | ○ | | ○ | 154 |
| 174 | | ○ | | ○ | ○ | | ○ | | ○ | | ○ | 155 |
| 175 | | | ○ | ○ | ○ | | ○ | | ○ | | ○ | 156 |
| 176 | ○ | | ○ | | | ○ | ○ | | ○ | | ○ | 157 |
| 177 | | ○ | ○ | | | ○ | ○ | | ○ | | ○ | 158 |
| 178 | ○ | | | ○ | | ○ | ○ | | ○ | | ○ | 159 |
| 179 | ○ | | | ○ | | ○ | ○ | | ○ | | ○ | 159 |
| 180 | | ○ | | ○ | | ○ | ○ | | ○ | | ○ | 160 |
| 181 | | | ○ | ○ | | ○ | ○ | | ○ | | ○ | 161 |
| 182 | ○ | | | ○ | ○ | | | ○ | ○ | | ○ | 162 |
| 183 | | ○ | | ○ | ○ | | | ○ | ○ | | ○ | 163 |

(B) SECOND TABLE (CODING b)

FIG.28

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 184 | | ○ | ○ | | | ○ | | ○ | | ○ | ○ | 184 |
| 185 | ○ | | | ○ | | ○ | | ○ | | ○ | ○ | 185 |
| 186 | | ○ | | ○ | | ○ | | ○ | | ○ | ○ | 186 |
| 187 | | | ○ | ○ | | ○ | | ○ | | ○ | ○ | 187 |
| 188 | ○ | | ○ | ○ | | ○ | | ○ | | ○ | ○ | 188 |
| 189 | | ○ | ○ | ○ | | ○ | | ○ | | ○ | ○ | 189 |
| 190 | ○ | ○ | | | ○ | ○ | | ○ | | ○ | ○ | 190 |
| 191 | ○ | | ○ | | ○ | ○ | | ○ | | ○ | ○ | 191 |
| 192 | ○ | ○ | | ○ | | | ○ | ○ | | ○ | ○ | 192 |
| 193 | ○ | | ○ | ○ | | | ○ | ○ | | ○ | ○ | 193 |
| 194 | | ○ | ○ | ○ | | | ○ | ○ | | ○ | ○ | 194 |
| 195 | ○ | ○ | | | ○ | | ○ | ○ | | ○ | ○ | 195 |
| 196 | ○ | | ○ | | ○ | | ○ | ○ | | ○ | ○ | 196 |
| 197 | | ○ | ○ | | ○ | | ○ | ○ | | ○ | ○ | 197 |
| 198 | ○ | | | ○ | ○ | | ○ | ○ | | ○ | ○ | 198 |
| 199 | | ○ | | ○ | ○ | | ○ | ○ | | ○ | ○ | 199 |
| 200 | | | ○ | ○ | ○ | | ○ | ○ | | ○ | ○ | 200 |
| 201 | ○ | | ○ | | | ○ | ○ | ○ | | ○ | ○ | 201 |
| 202 | | ○ | ○ | | | ○ | ○ | ○ | | ○ | ○ | 202 |
| 203 | ○ | | | ○ | | ○ | ○ | ○ | | ○ | ○ | 203 |
| 204 | ○ | | ○ | | ○ | ○ | | | ○ | ○ | ○ | 204 |
| 205 | ○ | ○ | | ○ | | | ○ | | ○ | ○ | ○ | 205 |
| 206 | ○ | | ○ | ○ | | | ○ | | ○ | ○ | ○ | 206 |
| 207 | | ○ | ○ | ○ | | | ○ | | ○ | ○ | ○ | 207 |
| 208 | ○ | ○ | | | ○ | | ○ | | ○ | ○ | ○ | 208 |
| 209 | ○ | | ○ | | ○ | | ○ | | ○ | ○ | ○ | 209 |
| 210 | | ○ | ○ | | ○ | | ○ | | ○ | ○ | ○ | 210 |
| 211 | ○ | | | ○ | ○ | | ○ | | ○ | ○ | ○ | 211 |
| 212 | | ○ | | ○ | ○ | | ○ | | ○ | ○ | ○ | 212 |
| 213 | | | ○ | ○ | ○ | | ○ | | ○ | ○ | ○ | 213 |
| 214 | ○ | | ○ | | | ○ | ○ | | ○ | ○ | ○ | 214 |
| 215 | | ○ | ○ | | | ○ | ○ | | ○ | ○ | ○ | 215 |
| 216 | ○ | | | ○ | | ○ | ○ | | ○ | ○ | ○ | 216 |
| 217 | ○ | | ○ | | ○ | | | ○ | ○ | ○ | ○ | 217 |
| 218 | | ○ | ○ | | ○ | | | ○ | ○ | ○ | ○ | 218 |
| 219 | ○ | | | ○ | ○ | | | ○ | ○ | ○ | ○ | 219 |
| 220 | | ○ | | ○ | ○ | | | ○ | ○ | ○ | ○ | 220 |
| 221 | | | ○ | ○ | ○ | | | ○ | ○ | ○ | ○ | 221 |
| 222 | ○ | | ○ | | | ○ | | ○ | ○ | ○ | ○ | 222 |
| 223 | | ○ | ○ | | | ○ | | ○ | ○ | ○ | ○ | 223 |
| 224 | ○ | | | ○ | | ○ | | ○ | ○ | ○ | ○ | 224 |
| 225 | | ○ | | ○ | | ○ | | ○ | ○ | ○ | ○ | 225 |
| 226 | ○ | ○ | | ○ | | ○ | | ○ | ○ | ○ | ○ | 226 |
| 227 | ○ | | ○ | ○ | | ○ | | ○ | ○ | ○ | ○ | 227 |
| 228 | | ○ | ○ | ○ | | ○ | | ○ | ○ | ○ | ○ | 228 |
| 229 | ○ | ○ | | | ○ | ○ | | ○ | ○ | ○ | ○ | 229 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 184 | | | ○ | ○ | ○ | | | ○ | ○ | | ○ | 164 |
| 185 | ○ | | ○ | | | ○ | | ○ | ○ | | ○ | 165 |
| 186 | | ○ | ○ | | | ○ | | ○ | ○ | | ○ | 166 |
| 187 | ○ | | | ○ | | ○ | | ○ | ○ | | ○ | 167 |
| 188 | | ○ | | ○ | | ○ | | ○ | ○ | | ○ | 168 |
| 189 | | | ○ | ○ | | ○ | | ○ | ○ | | ○ | 169 |
| 190 | | | ○ | ○ | | ○ | | ○ | ○ | | ○ | 169 |
| 191 | ○ | | ○ | | ○ | | ○ | | | ○ | ○ | 170 |
| 192 | | ○ | ○ | | ○ | | ○ | | | ○ | ○ | 171 |
| 193 | ○ | | | ○ | ○ | | ○ | | | ○ | ○ | 172 |
| 194 | | ○ | | ○ | ○ | | ○ | | | ○ | ○ | 173 |
| 195 | | | ○ | ○ | ○ | | ○ | | | ○ | ○ | 174 |
| 196 | ○ | | ○ | | | ○ | ○ | | | ○ | ○ | 175 |
| 197 | | ○ | ○ | | | ○ | ○ | | | ○ | ○ | 176 |
| 198 | ○ | | | ○ | | ○ | ○ | | | ○ | ○ | 177 |
| 199 | | ○ | | ○ | | ○ | ○ | | | ○ | ○ | 178 |
| 200 | | | ○ | ○ | | ○ | ○ | | | ○ | ○ | 179 |
| 201 | | | ○ | ○ | | ○ | ○ | | | ○ | ○ | 179 |
| 202 | ○ | | | ○ | ○ | | | ○ | | ○ | ○ | 180 |
| 203 | | ○ | | ○ | ○ | | | ○ | | ○ | ○ | 181 |
| 204 | | | ○ | ○ | ○ | | | ○ | | ○ | ○ | 182 |
| 205 | ○ | | ○ | | | ○ | | ○ | | ○ | ○ | 183 |
| 206 | | ○ | ○ | | | ○ | | ○ | | ○ | ○ | 184 |
| 207 | ○ | | | ○ | | ○ | | ○ | | ○ | ○ | 185 |
| 208 | | ○ | | ○ | | ○ | | ○ | | ○ | ○ | 186 |
| 209 | | | ○ | ○ | | ○ | | ○ | | ○ | ○ | 187 |
| 210 | ○ | | ○ | ○ | | ○ | | ○ | | ○ | ○ | 188 |
| 211 | | ○ | ○ | ○ | | ○ | | ○ | | ○ | ○ | 189 |
| 212 | | ○ | ○ | ○ | | ○ | | ○ | | ○ | ○ | 189 |
| 213 | ○ | ○ | | | ○ | ○ | | ○ | | ○ | ○ | 190 |
| 214 | ○ | | ○ | | ○ | ○ | | ○ | | ○ | ○ | 191 |
| 215 | ○ | ○ | | ○ | | | ○ | ○ | | ○ | ○ | 192 |
| 216 | ○ | | ○ | ○ | | | ○ | ○ | | ○ | ○ | 93 |
| 217 | | ○ | ○ | ○ | | | ○ | ○ | | ○ | ○ | 94 |
| 218 | ○ | ○ | | | ○ | | ○ | ○ | | ○ | ○ | 195 |
| 219 | ○ | | ○ | | ○ | | ○ | ○ | | ○ | ○ | 196 |
| 220 | | ○ | ○ | | ○ | | ○ | ○ | | ○ | ○ | 197 |
| 221 | ○ | | | ○ | ○ | | ○ | ○ | | ○ | ○ | 198 |
| 222 | | ○ | | ○ | ○ | | ○ | ○ | | ○ | ○ | 199 |
| 223 | | ○ | | ○ | ○ | | ○ | ○ | | ○ | ○ | 199 |
| 224 | | | ○ | ○ | ○ | | ○ | ○ | | ○ | ○ | 200 |
| 225 | ○ | | ○ | | | ○ | ○ | ○ | | ○ | ○ | 201 |
| 226 | | ○ | ○ | | | ○ | ○ | ○ | | ○ | ○ | 202 |
| 227 | ○ | | | ○ | | ○ | ○ | ○ | | ○ | ○ | 203 |
| 228 | ○ | | ○ | | ○ | ○ | | | ○ | ○ | ○ | 204 |
| 229 | ○ | ○ | | ○ | | | ○ | | ○ | ○ | ○ | 205 |

(B) SECOND TABLE (CODING b)

FIG.29

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 230 | ○ | | ○ | | ○ | ○ | | ○ | ○ | ○ | ○ | 230 |
| 231 | | ○ | ○ | | ○ | ○ | | ○ | ○ | ○ | ○ | 231 |
| 232 | ○ | | | ○ | ○ | ○ | | ○ | ○ | ○ | ○ | 232 |
| 233 | | ○ | | ○ | ○ | ○ | | ○ | ○ | ○ | ○ | 233 |
| 234 | ○ | ○ | | | ○ | | ○ | ○ | ○ | ○ | ○ | 234 |
| 235 | ○ | | ○ | | ○ | | ○ | ○ | ○ | ○ | ○ | 235 |
| 236 | | ○ | ○ | | ○ | | ○ | ○ | ○ | ○ | ○ | 236 |
| 237 | ○ | | | ○ | ○ | | ○ | ○ | ○ | ○ | ○ | 237 |
| 238 | | ○ | | ○ | ○ | | ○ | ○ | ○ | ○ | ○ | 238 |
| 239 | | | ○ | ○ | ○ | | ○ | ○ | ○ | ○ | ○ | 239 |
| 240 | ○ | | ○ | | | ○ | ○ | ○ | ○ | ○ | ○ | 240 |
| 241 | | ○ | ○ | | | ○ | ○ | ○ | ○ | ○ | ○ | 241 |
| 242 | ○ | | | ○ | | ○ | ○ | ○ | ○ | ○ | ○ | 242 |
| 243 | | ○ | | ○ | | ○ | ○ | ○ | ○ | ○ | ○ | 243 |
| 244 | ○ | ○ | | ○ | | ○ | ○ | ○ | ○ | ○ | ○ | 244 |
| 245 | ○ | | ○ | ○ | | ○ | ○ | ○ | ○ | ○ | ○ | 245 |
| 246 | | ○ | ○ | ○ | | ○ | ○ | ○ | ○ | ○ | ○ | 246 |
| 247 | ○ | ○ | | | ○ | ○ | ○ | ○ | ○ | ○ | ○ | 247 |
| 248 | ○ | | ○ | | ○ | ○ | ○ | ○ | ○ | ○ | ○ | 248 |
| 249 | | ○ | ○ | | ○ | ○ | ○ | ○ | ○ | ○ | ○ | 249 |
| 250 | ○ | | | ○ | ○ | ○ | ○ | ○ | ○ | ○ | ○ | 250 |
| 251 | | ○ | | ○ | ○ | ○ | ○ | ○ | ○ | ○ | ○ | 251 |
| 252 | ○ | ○ | | ○ | ○ | ○ | ○ | ○ | ○ | ○ | ○ | 252 |
| 253 | ○ | | ○ | ○ | ○ | ○ | ○ | ○ | ○ | ○ | ○ | 253 |
| 254 | | ○ | ○ | ○ | ○ | ○ | ○ | ○ | ○ | ○ | ○ | 254 |
| 255 | ○ | ○ | ○ | ○ | ○ | ○ | ○ | ○ | ○ | ○ | ○ | 255 |

(A) FIRST TABLE (CODING a)

| INPUT GRAY-SCALE LEVEL | SUBFRAME (SF) SF1 1 | SF2 2 | SF3 3 | SF4 5 | SF5 8 | SF6 13 | SF7 18 | SF8 26 | SF9 39 | SF10 57 | SF11 83 | OUTPUT GRAY-SCALE LEVEL |
|---|---|---|---|---|---|---|---|---|---|---|---|---|
| 230 | ○ | | ○ | ○ | | | ○ | | ○ | ○ | ○ | 206 |
| 231 | | ○ | ○ | ○ | | | ○ | | ○ | ○ | ○ | 207 |
| 232 | ○ | ○ | | | ○ | | ○ | | ○ | ○ | ○ | 208 |
| 233 | ○ | | ○ | | ○ | | ○ | | ○ | ○ | ○ | 209 |
| 234 | ○ | | ○ | | ○ | | ○ | | ○ | ○ | ○ | 209 |
| 235 | | ○ | ○ | | ○ | | ○ | | ○ | ○ | ○ | 210 |
| 236 | ○ | | | ○ | ○ | | ○ | | ○ | ○ | ○ | 211 |
| 237 | | ○ | | ○ | ○ | | ○ | | ○ | ○ | ○ | 212 |
| 238 | | | ○ | ○ | ○ | | ○ | | ○ | ○ | ○ | 213 |
| 239 | ○ | | ○ | | | ○ | ○ | | ○ | ○ | ○ | 214 |
| 240 | | ○ | ○ | | | ○ | ○ | | ○ | ○ | ○ | 215 |
| 241 | ○ | | | ○ | | ○ | ○ | | ○ | ○ | ○ | 216 |
| 242 | ○ | | ○ | | ○ | | | ○ | ○ | ○ | ○ | 217 |
| 243 | | ○ | ○ | | ○ | | | ○ | ○ | ○ | ○ | 218 |
| 244 | ○ | | | ○ | ○ | | | ○ | ○ | ○ | ○ | 219 |
| 245 | ○ | | | ○ | ○ | | | ○ | ○ | ○ | ○ | 219 |
| 246 | | ○ | | ○ | ○ | | | ○ | ○ | ○ | ○ | 220 |
| 247 | | | ○ | ○ | ○ | | | ○ | ○ | ○ | ○ | 221 |
| 248 | ○ | | ○ | | | ○ | | ○ | ○ | ○ | ○ | 222 |
| 249 | | ○ | ○ | | | ○ | | ○ | ○ | ○ | ○ | 223 |
| 250 | ○ | | | ○ | | ○ | | ○ | ○ | ○ | ○ | 224 |
| 251 | | ○ | | ○ | | ○ | | ○ | ○ | ○ | ○ | 225 |
| 252 | ○ | ○ | | ○ | | ○ | | ○ | ○ | ○ | ○ | 226 |
| 253 | ○ | | ○ | ○ | | ○ | | ○ | ○ | ○ | ○ | 227 |
| 254 | | ○ | ○ | ○ | | ○ | | ○ | ○ | ○ | ○ | 228 |
| 255 | ○ | ○ | | | ○ | ○ | | ○ | ○ | ○ | ○ | 229 |

(B) SECOND TABLE (CODING b)

DISPLAY APPARATUS

BACKGROUND OF THE INVENTION

1. Field of the Invention

The present invention relates to a display apparatus, and particularly, to a display apparatus such as a plasma display panel (hereinafter referred to as PDP) that divides a frame period of an image signal into a plurality of subframes and selectively activates the subframes to display gray-scale images.

2. Description of Related Art

The PDP drives each pixel in a binary mode or an ON/OFF mode. To display gray-scale images, the PDP divides a frame period (16.7 ms) of an image signal into subframes having different light emitting periods, respectively. The subframes are selectively driven according to a gray-scale level to display, so that a human eye may observe a gray-scale image due to a visual integration effect. The display apparatus employing the in-frame time division displaying method is disclosed in, for example, Japanese Unexamined Patent Application Publication No. Hei-7-271325.

FIG. 1 is a block diagram showing a display apparatus according to a related art. An image signal to be displayed is supplied to an image processor 1. The image processor 1 conducts image processes including error diffusion, dithering, and inverse gamma correction. The image signal processed by the image processor 1 is transferred to a subframe coordinator 2, which converts the image signal into subframes to drive corresponding red (R), green (G), and blue (B) pixels. At this time, the subframe coordinator 2 refers to a coding table 4 and a weighting table 3 stored in an external storage device. The weighting table 3 is related to the coding table 4 and indicates the number of pulses generated in each subframe to determine the brightness of the subframe.

The signal processed by the subframe coordinator 2 is transferred to a subframe processor 5. The subframe processor temporarily stores the signal, reads a subframe at the display timing thereof, sends a control signal to a drive pulse generator 6, and provides an address electrode driver 7 with pixel data. The drive pulse generator 6 supplies drive pulses to an X-electrode driver 8 and a Y-electrode driver 9, to start sustain discharge and activate pixels selected by the address electrode driver 7. As a result, the selected pixels are activated on a plasma display panel (PDP) 10. These operations are conducted subframe by subframe.

FIG. 2 shows an example of a subframe structure used to display a gray-scale image according to the related art. In FIG. 2, an ordinate indicates display lines Y1 to Yn and an abscissa indicates time. To realize 256 (8-bit) gray-scale levels, the example of FIG. 2 divides a frame into eight subframes SF1 to SF8 having different brightness weights. An LSB (least significant bit) to an MSB (most significant bit) of 8-bit image data are sequentially assigned to the subframes. Namely, the related art divides a frame into M subframes, selects subframes according to a gray-scale level of image data, and displays a gray-scale level of the "M"th power of 2 on the PDP 10, so that a viewer may see a gray-scale image on the PDP 10 due to a visual integration effect.

Each subframe consists of a reset period, an addressing period, and a sustain discharge period. The addressing period is a period to conduct a sequential line-by-line write operation. In FIG. 2, the sustain discharge periods are depicted with patterns and have different lengths from subframe to subframe. This is because each subframe has an individual brightness weight that determines the number of sustain pulses to be generated during the sustain discharge period of the subframe. The weights, i.e., the numbers of pulses generated during the sustain discharge periods of the subframes SF1 to SF8 are 1, 2, 4, 8, 16, 32, 64, and 128, respectively. To increase the brightness of light emission, the numbers of pulses are multiplied by N (a natural number).

The number of subframes may differ depending on display apparatuses. The PDP usually employs 10 to 12 subframes depending on the reset, addressing, and sustain discharge periods to be included in a frame period.

It is known that the display apparatus employing subframes to display gray-scale images shows false contours when displaying dynamic images. The false contours displayed on dynamic images will be explained.

FIG. 3 shows adjacent pixels displaying gray-scale levels of 127 and 128 on the PDP. In FIG. 3, a vertical direction indicates the pixels displaying the gray-scale levels of 127 and 128, and a horizontal direction indicates time. Subframes depicted with patterns are those selected to emit light. In this example, there are eight subframes SF1 to SF8 that are weighted by 1, 2, 4, 8, 16, 32, 64, and 128, respectively.

For the pixel to display the gray-scale level of 127, the subframes SF1, SF2, SF3, SF4, SF5, SF6, and SF7 are driven, so that the total weight of 127 thereof provides the gray-scale level of 127. On the other hand, for the pixel to display the gray-scale level of 128, only the subframe SF8 is driven, so that the weight of 128 thereof provides the gray-scale level of 128.

If a still image is displayed on the PDP at this time, a line of sight of a viewer is immobile. Namely, the line of sight does not move to the next pixel during integration of the weights of the subframes. In this case, the image is correctly viewed, and no false contour appears. If a dynamic image is displayed on the PDP at the time, a line of sight of the viewer moves according to the movement of the image. Namely, the line of sight moves to the next pixel before the weights of the subframes of the first pixel are integrated. Then, the viewer sees a false contour due to the visual integration effect of the eyes.

In FIG. 3, the pixels to display the gray-scale levels of 127 and 128 are adjacent to each other. If a dynamic image moves upwardly and if the eyes of the viewer move from one pixel to another at a speed within a visual integration time, a line of sight of the viewer will be a line "a" shown in FIG. 3. In this case, the viewer sees a black color because there are no subframes to emit light. If the image moves downwardly, the eyes of the viewer will move along a line "b". In this case, the subframes SF1 to SF8 are driven to emit light and their brightness is integrated, so that the viewer sees the total weight of 256, i.e., a gray-scale level of 256. In both cases, the pixels display the gray-scale levels of 127 and 128, respectively. However, the viewer sees a false white or black stripe.

This is a phenomenon called a dynamic image false contour. The phenomenon is specific to the display apparatus employing the in-frame time division displaying method and deteriorates image quality. The phenomenon, therefore, must be eliminated.

To solve the problem, there is a related art that employs two kinds of coding to realize different gray-scale levels with subframes. This related art displays 256 gray-scale levels by averaging the two kinds of coding. This technique is disclosed in, for example, Japanese Unexamined Patent Publication No. 2003-66892. The related art finds first and second gray-scale levels whose average is equal to a given gray-scale level, forms a light emission pattern A of subframes according to the first gray-scale level and a light emission pattern B of subframes according to the second gray-scale level, and alternates the light emission patterns A and B frame by frame.

This related art, however, involves some gray-scale levels each selecting the same subframes in both the light emission patterns A and B to unavoidably cause false contours.

SUMMARY OF THE INVENTION

An object of the present invention is to provide a display apparatus capable of solving the problem of false contours when displaying dynamic or still images.

In order to accomplish the object, a first aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables having different gray-scale-level input/output characteristics; and an image processing unit configured to cyclically and alternately employ the at least two sets of subframe coding tables at intervals of one frame, or one pixel, or one frame and one pixel of the input image signal and provide an output image signal having an output gray-scale level corresponding to the input gray-scale level.

According to the first aspect, the subframe coding tables having different gray-scale-level input/output characteristics are cyclically and alternately employed at intervals of every frame, or every pixel, or every frame and every pixel of an input image signal. As a result, a location where a gray-scale level increases to cause false contours is moved to another location in the next frame, or such a location is temporally distributed to surrounding pixels. Then, the location to cause false contours never moves with a line of sight of a person who watches images displayed on the display apparatus. In this way, the first aspect minimizes false contours and properly displays dynamic images.

A second aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables that nonlinearly increase, according to an increase in gray-scale level, the number of subframes to be selected; and an image processing unit configured to cyclically alternate the at least two sets of subframe coding tables at intervals of one frame, or one pixel, or one frame and one pixel of the input image signal and provide an output image signal having an output gray-scale level corresponding to the input gray-scale level.

According to the second aspect, a display gray-scale level of k involves a first number of subframes to be selected, a display gray-scale level of k+1 involves a second number of subframes to be selected that is equal to or greater than the first number by one, and a display gray-scale level of k+2 involves a third number of subframes to be selected that is equal to or greater than the second number by one. In this way, the second aspect nonlinearly increases the number of subframes to be selected according to an increase in gray-scale level. This configuration minimizes gray-scale steps displayed on a display apparatus such as a PDP that determines a display gray-scale level according to not only sustain pulses generated during sustain discharge periods but also pixel selecting pulses generated during addressing periods.

A third aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables having different gray-scale-level input/output characteristics; and an image processing unit configured to cyclically and alternately employ the at least two sets of subframe coding tables at intervals of one frame, or one pixel, or one frame and one pixel of the input image signal and provide an output image signal having an output gray-scale level corresponding to the input gray-scale level. The at least two sets of subframe coding tables generated by the table generator are configured such that a location in a first set of the at least two sets of subframe coding tables where a first of two adjacent output gray-scale levels involves an "n−1"th subframe ("n" being an integer equal to or greater than 2 and equal to or smaller than the number of the subframes) as a top subframe among subframes selected for the first output gray-scale level and a second thereof involves an "n"th subframe as a top subframe among subframes selected for the second output gray-scale level differs from that in a second set of the at least two sets of subframe coding tables.

According to the third aspect, the at least two sets of subframe coding tables generated by the table generator and alternately used at intervals of every frame, or every pixel, or every frame and every pixel of an input image signal are configured such that a location in a first set of the at least two sets of subframe coding tables where a first of two adjacent output gray-scale levels involves an "n−1"th subframe as a top subframe among subframes selected for the first output gray-scale level and a second thereof involves an "n"th subframe as a top subframe among subframes selected for the second output gray-scale level differs from that in a second set of the at least two sets of subframe coding tables. The location in the first set of subframe coding tables where a first output gray-scale level involves the "n−1"th subframe as a top subframe and a second output gray-scale level involves the "n"th subframe as a top subframe frequently causes false contours due to a gray-scale-level step-up. The third aspect moves this location to another in the next frame and distributes the location of false contours to surrounding pixels, to thereby prevent the location of false contours from moving with a line of sight of a viewer. In this way, the third aspect minimizes false contours and properly displays dynamic images.

A fourth aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables having different gray-scale-level input/output characteristics; and an image processing unit configured to cyclically and alternately employ the at least two sets of subframe coding tables at intervals of one frame, or one pixel, or one frame and one pixel of the input image signal and provide an output image signal having an output gray-scale level corresponding to the input gray-scale level. The at least two sets of subframe coding tables generated by the table generator are configured such that a location in a first set of the at least two sets of subframe coding tables where a first of two adjacent output gray-scale levels involves an "n−1"th subframe ("n" being an integer equal to or greater than 2 and equal to or smaller than the number of the subframes) as a top subframe among subframes selected for the first output gray-scale level and a second thereof involves an "n"th subframe as a top subframe among subframes selected for the second output gray-scale level corresponds to an intermediate location of a range of a second set of the at least two sets of subframe coding tables in which one of "n−1"th and "n"th subframes continuously serves as a top subframe among selected subframes.

A fifth aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables having different gray-scale-level input/output characteristics; and an image processing unit configured to cyclically and alternately employ the at least two sets of subframe coding tables at intervals of one frame, or one pixel, or one frame and one pixel of the input image signal and provide an output image signal having an output gray-scale level corresponding to the input gray-scale level. The at least two sets of subframe coding tables generated by the table generator are configured such that a location in a first set of the at least two sets of subframe coding tables where a first of two adjacent output gray-scale levels involves an "n−1"th subframe ("n" being an integer equal to or greater than 2 and equal to or smaller than the number of the subframes) as a top subframe among subframes selected for the first output gray-scale level and a second thereof involves an "n"th subframe as a top subframe among subframes selected for the second output gray-scale level corresponds to an intermediate location of a range of a second set of the at least two sets of subframe coding tables in which an "m"th subframe ("m" being one of "n−1" and "n") continuously serves as a top subframe among selected subframes and in which a "k"th subframe ("k" being equal to or greater than 1 and equal to or smaller than "m−1") is continuously unselected.

A sixth aspect of the present invention provides a display apparatus for displaying a gray-scale image by dividing a frame period of an input image signal into subframes having different brightness weights and by selecting at least one of the subframes that provides a brightness weight corresponding to an input gray-scale level specified by the input image signal. The display apparatus includes a table generator configured to generate at least two sets of subframe coding tables having different gray-scale-level input/output characteristics; and an image processing unit configured to cyclically and alternately employ the at least two sets of subframe coding tables at intervals of one frame, or one pixel, or one frame and one pixel of the input image signal and provide an output image signal having an output gray-scale level corresponding to the input gray-scale level. The at least two sets of subframe coding tables generated by the table generator are configured such that a location in a first set of the at least two sets of subframe coding tables where a first of two adjacent output gray-scale levels involves an "n−1"th subframe ("n" being an integer equal to or greater than 2 and equal to or smaller than the number of the subframes) as a top subframe among subframes selected for the first output gray-scale level and a second thereof involves an "n"th subframe as a top subframe among subframes selected for the second output gray-scale level corresponds to an intermediate location of a range of a second set of the at least two sets of subframe coding tables in which an "m"th subframe ("m" being one of "n−1" and "n") continuously serves as a top subframe among selected subframes and in which a "k"th subframe ("k" being equal to or greater than 1 and equal to or smaller than "m−1") is continuously selected.

According to the fourth to sixth aspects, the at least two sets of subframe coding tables generated by the table generator and alternately used at intervals of every frame, or every pixel, or every frame and every pixel of the input image signal are configured such that a location in a first set of the at least two sets of subframe coding tables where a first of two adjacent output gray-scale levels involves an "n−1"th subframe as a top subframe among subframes selected for the first output gray-scale level and a second thereof involves an "n"th subframe as a top subframe among subframes selected for the second output gray-scale level differs from that in a second set of the at least two sets of subframe coding tables. The location in the first set of subframe coding tables where a first output gray-scale level involves an "n−1"th subframe as a top subframe and a second output gray-scale level involves an "n"th subframe as a top subframe frequently causes false contours due to a gray-scale-level step-up. The fourth to sixth aspects move this location to another in the next frame and distribute the location of false contours to surrounding pixels.

A seventh aspect of the present invention makes the table generator generate a second set of the at least two sets of subframe coding tables by linearly transforming a first set thereof.

According to the seventh aspect, the two or more sets of subframe coding tables maintain predetermined relationships for images to display with respect to input image signals.

The nature, principle and utility of the invention will become more apparent from the following detailed description when read in conjunction with the accompanying drawings.

BRIEF DESCRIPTION OF THE DRAWINGS

In the accompanying drawings:

FIGS. 7 to 9 show an example of a first coding/weighting table according to the first and second embodiments of the present invention;

FIGS. 10 to 12 show an example of a second coding/weighting table according to the first and second embodiments of the present invention;

FIGS. 24 to 29 show examples of two tables used for coding according to the third and fourth embodiments of the present invention;

DETAILED DESCRIPTION OF EMBODIMENTS

Figure 1:
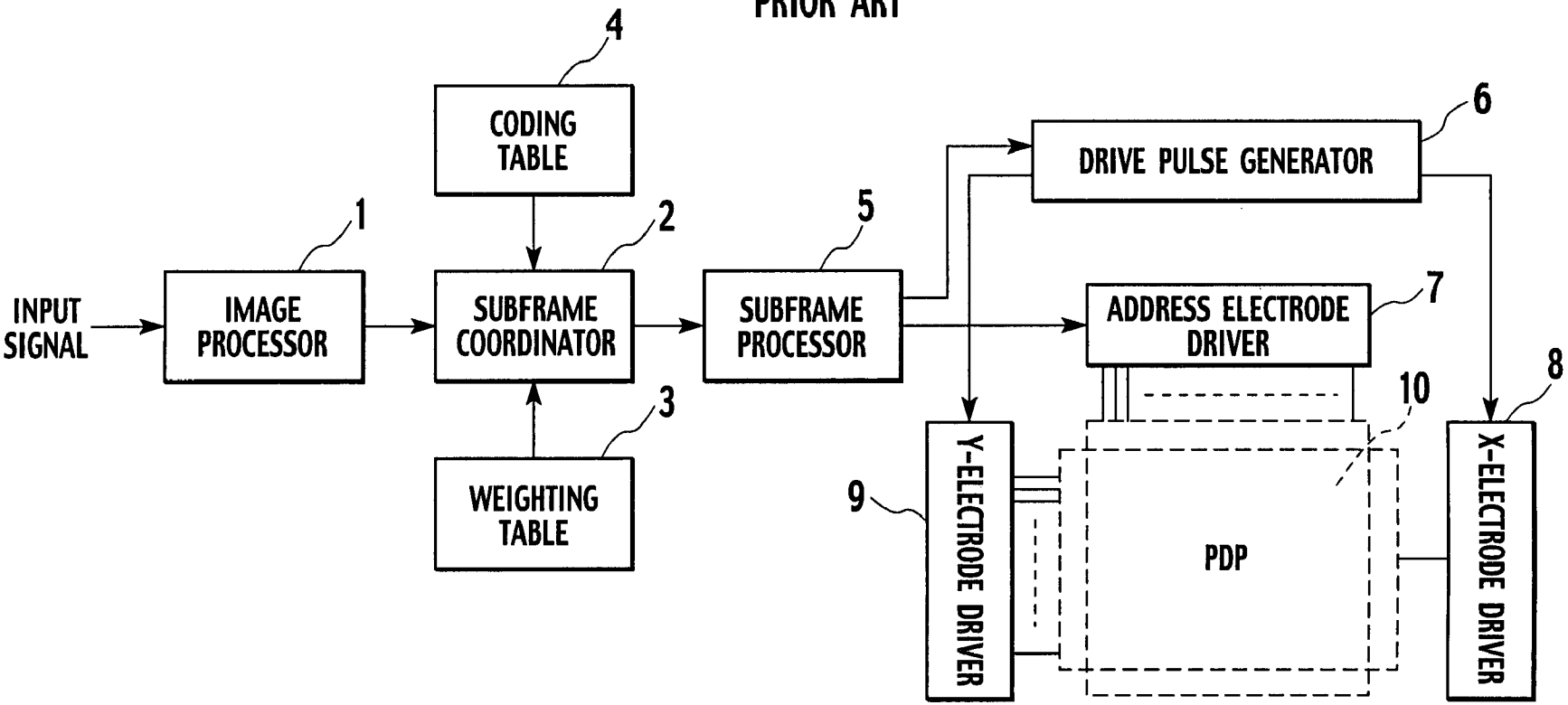
FIG.1 PRIOR ART
FIG. 1 is a block diagram showing an example of a display apparatus according to a related art.
Figure 2:
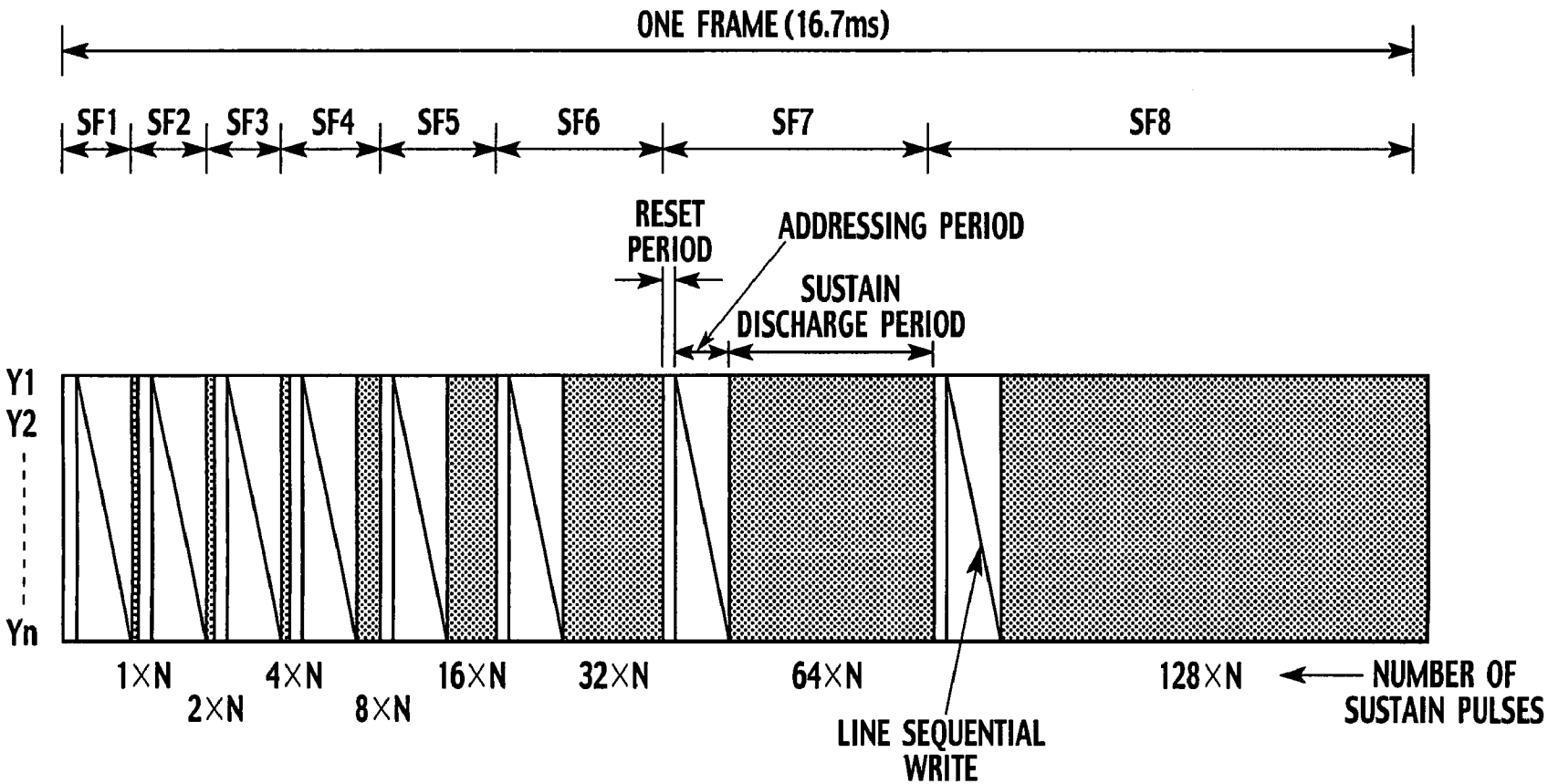
FIG.2 PRIOR ART
FIG. 2 is a view showing an example of a subframe structure according to a related art.
Figure 3:
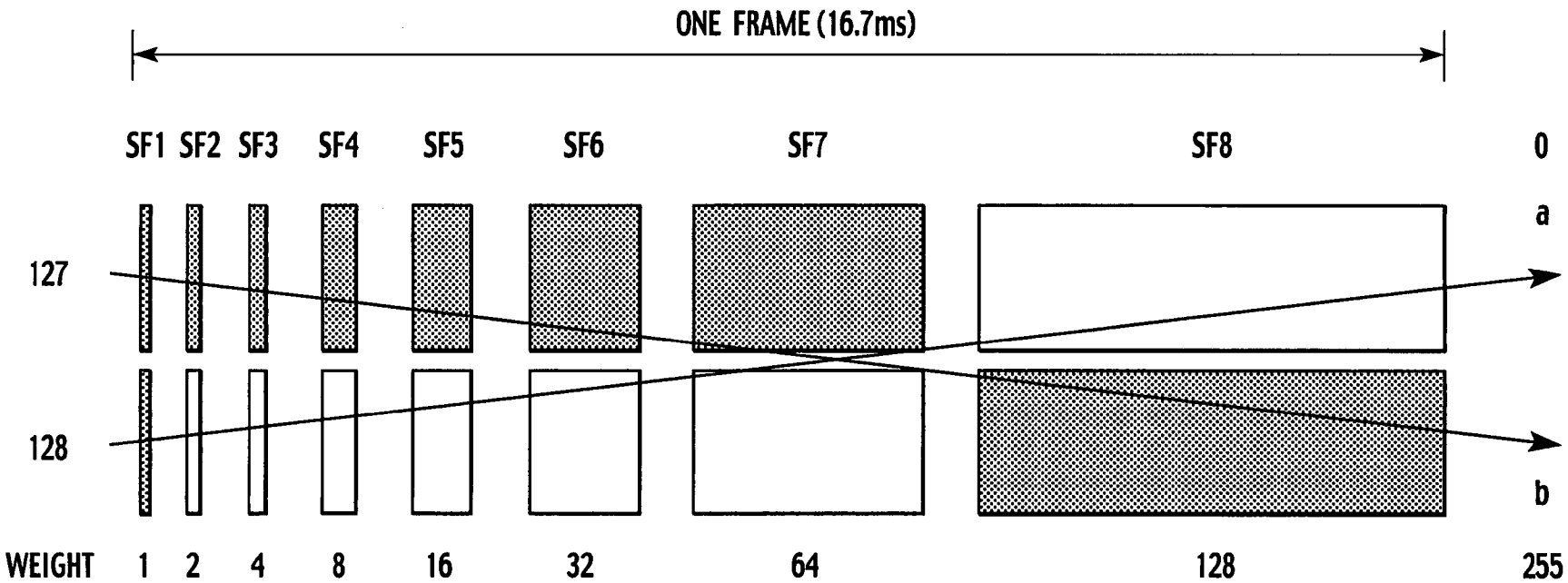
FIG.3 PRIOR ART
FIG. 3 is a view showing a false-contour caused by a subframe driving method according to a related art.
Figure 4:
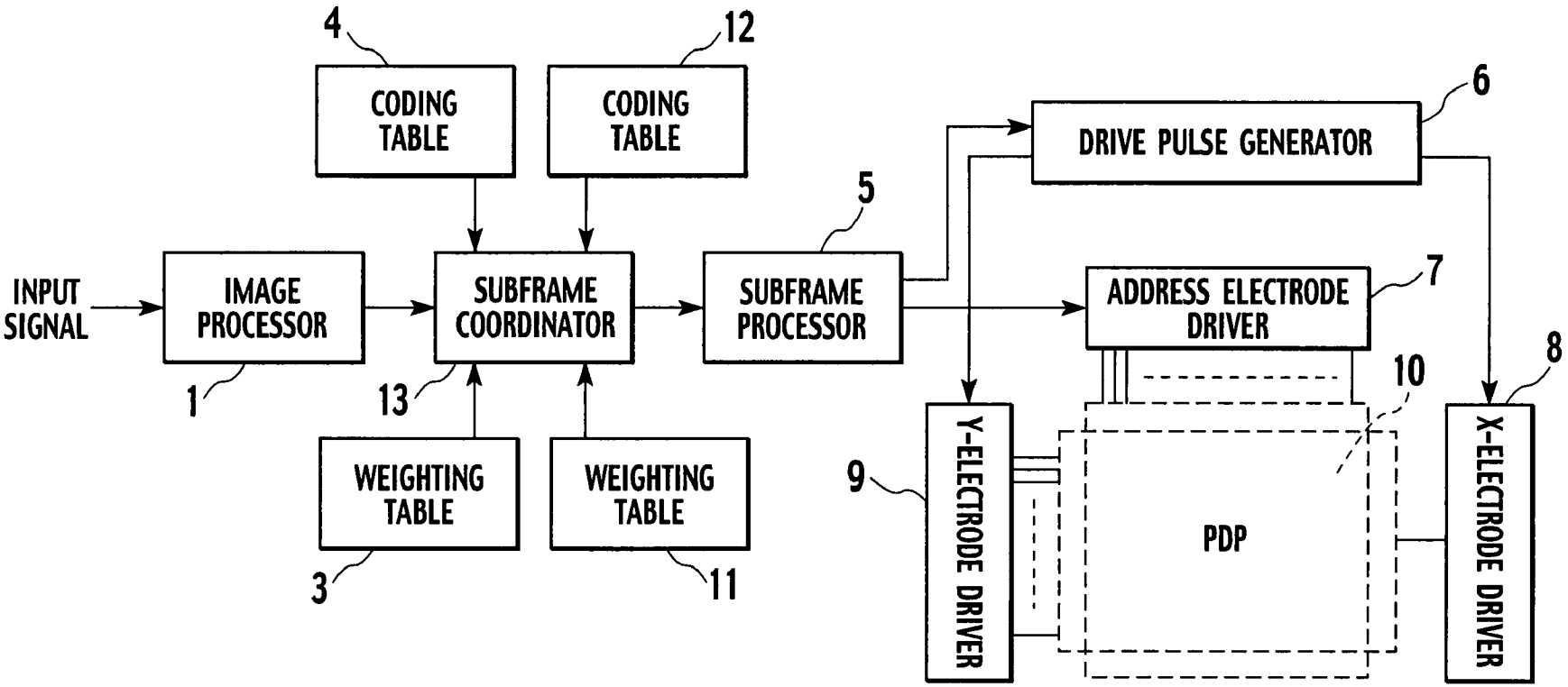
FIG. 4 is a block diagram showing a display apparatus according to first to fourth embodiments of the present invention.

Display apparatuses according to embodiments of the present invention will be explained with reference to the accompanying drawings. FIG. 4 is a block diagram showing a display apparatus according to the first and second embodiments of the present invention. In FIG. 4, the same parts as those of FIG. 1 are represented with the same reference marks. Similar to the display apparatus of the related art of FIG. 1, the display apparatus of FIG. 4 includes an image processor 1, a weighting table 3, a coding table 4, a subframe processor 5, a drive pulse generator 6, an address electrode driver 7, an X-electrode driver 8, a Y-electrode driver 9, and a plasma display panel (PDP) 10. Unlike the related art, the first and second embodiments of FIG. 4 employ a subframe coordinator 13 whose function differs from that of the subframe coordinator 2 of the related art, as well as a weighting table 11 and a coding table 12 related to the weighting table 11. Due to the addition of the weighting table 11 and coding table 12, the first and second embodiments have two sets of subframe coding and weighting tables. The configuration with two coding tables is hereinafter referred to as dual coding.

Generally, the PDP displays images with 256 gray-scale levels. The number of subframes necessary for displaying the 256 gray-scale levels is eight at the minimum. To avoid the problem of false contours, ten to twelve subframes are usually used.

First Embodiment

Figure 5:
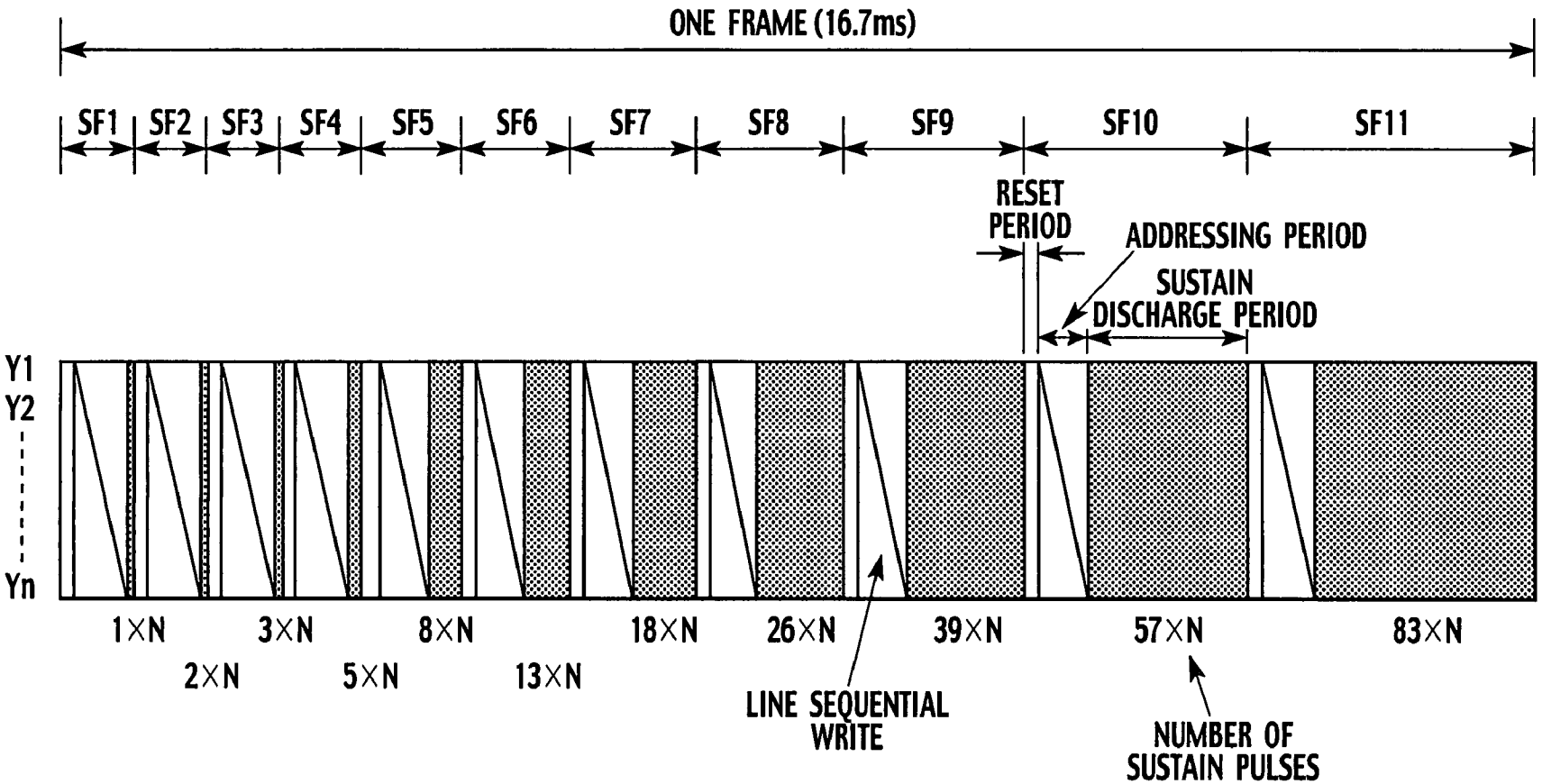
FIG. 5 is a view showing a frame structure according to the first to fourth embodiments of the present invention.

To solve the problem of false contours, the first embodiment of the present invention alternates the number of gray-scale levels from frame to frame. FIG. 5 shows a subframe structure according to the first embodiment. In FIG. 5, the first embodiment employs eleven subframes SF1 to SF11 each including a reset period, an addressing period, and a sustain discharge period. The sustain discharge periods are depicted with patterns. The reset periods of the subframes SF1 to SF11 are equal to one another, and the addressing periods thereof are also equal to one another. The sustain discharge periods of the subframes SF1 to SF11 differ from one to another.

The brightness of an image to be displayed is determined by the number of sustain pulses generated during a sustain discharge period, i.e., the weights of the subframes. In FIG. 5, the subframes SF1 to SF11 are allocated with weights 1, 2, 3, 5, 8, 13, 18, 26, 39, 57, and 83, respectively. The subframes SF1 to SF6 are weighted according to a Fibonacci sequence. The Fibonacci sequence is a regular sequence employing a relationship of "$a_{n+1}=a_n+a_{n-1}$." Applying the Fibonacci sequence to the lightly weighted subframes SF1 to SF6 well prevents an inversion of the number of selected subframes, to thereby prevent a brightness inversion due to light emission by addressing pulses. The subframe structure of FIG. 5 is also employed by the second to fourth embodiments of the present invention.

Figure 6:
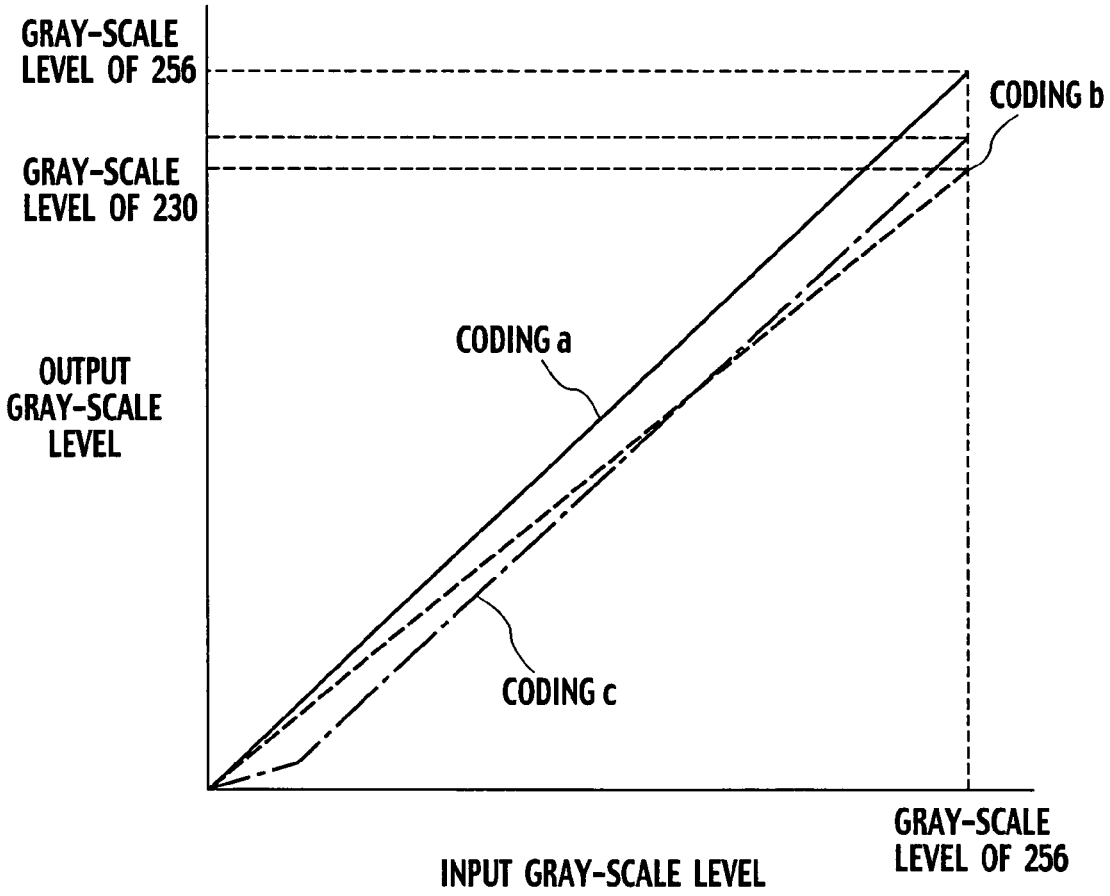
FIG. 6 is a graph showing examples of gray-scale-level input/output characteristics of input and output signals according to the first and second embodiments of the present invention.

FIG. 6 is a graph showing an example of a technique of changing input gray-scale levels according to the first and second embodiments of the present invention. In FIG. 6, an abscissa represents input gray-scale levels and an ordinate represents output gray-scale levels. For an input gray-scale level of 256, coding "a" provides an output gray-scale level of 256 and coding "b" provides an output gray-scale level of 230 which is lower than that provided by the coding a. Each of the coding a and b has a linear gray-scale-level input/output characteristic.

On the other hand, coding "c" selects lower output gray-scale levels than coding b at the lower input gray-scale levels or at the levels having few numbers of selected subframes, and selects output gray-scale levels parallel to the coding a, higher than coding b. When selecting subframes for an input gray-scale level from the coding table to determine an output gray-scale level, it is usual to subtract a gray-scale level corresponding to an addressing pulse from the input gray-scale level.

FIGS. 7 to 9 show an example of the coding table 4 having 256 gray-scale levels, and FIGS. 10 to 12 show an example of the coding table 12 having 230 gray-scale levels. In each of the coding tables 4 and 12 shown in FIGS. 7 to 12, a left end column shows input gray-scale levels provided with input image signals and the second to twelfth columns show the subframes SF1 to SF11 with subframes marked with circles being selected subframes to emit light. The thirteenth column shows output gray-scale levels converted from the input gray-scale levels. A right end column shows the numbers of subframes selected for displaying the corresponding gray-scale levels.

If an input signal has a gray-scale level of 18, the coding table 4 selects the subframes SF2, SF3, and SF6 as shown in FIG. 7. Weights of these subframes are 2, 3, and 13 as shown in cells just below the subframes. The sum of these weights is 18, which is an output gray-scale level provided with an output signal. The number of the selected subframes is three.

On the other hand, the coding table 12 selects, for the input gray-scale level of 18, the subframes SF1, SF3, and SF6 as shown in FIG. 10. Weights of these subframes are 1, 3, and 13 as shown in cells just below the subframes. The sum of these weights is 17, which is an output gray-scale level. The number of the selected subframes is three.

In the PDP, a gray-scale level to be displayed is determined by the number of sustain pulses generated during a sustain discharge period shown in FIG. 5. In addition, discharge occurs in an addressing period when selecting a pixel to emit or not emit light. The discharge during the addressing period is frequently brighter than the brightness of one sustain discharge pulse generated during the addressing period. This will cause a gray-scale step if the number of selected subframes is not increased according to an increase in gray-scale level.

For this, the coding table 4 shown in FIGS. 7 to 9 and the coding table 12 shown in FIGS. 10 to 12 select subframes such that, if required, the number of selected subframes increases according to an increase in gray-scale level. When the number of selected subframes for a given gray-scale level is increased, the number of subframes to be selected for the next gray-scale level is set to be equal to the preceding number or greater than that by one. This technique eliminates gray-scale steps appearing on the PDP.

The coding tables 4 and 12 are formed so that a location in the coding table 4 where a gray-scale level changes to a higher one with a selected top subframe of the latter being higher than that of the former differs from that in the table 12 by at least one output gray-scale level. For example, in the coding table 4 of FIG. 7, an input gray-scale level of 28 has the subframe SF6 as a selected top subframe and an input gray scale level of 29 has the subframe SF7 as a selected top subframe. Namely, the selected top subframe changes from SF6 to SF7 at this location. In the coding table 10, the location where a selected top subframe changes from SF6 to SF7 is between input gray-scale levels 31 and 32. In this way, the location where a selected top subframe changes to causes false contours is moved between the tables to minimize the false contours.

According to the first and second embodiments, the subframe coordinator 13 shown in FIG. 4 handles an image signal processed by the image processor 1 by employing a first table set of the weighting table 3 and coding table 4 to assign 256-gray-scale-level subframes for a given frame and by employing a second table set of the weighting table 11 and coding table 12 to assign 230-gray-scale-level subframes for the next frame. In this way, the first and second embodiments alternately use the first and second table sets frame by frame.

The subframe coordinator 13 divides a frame period of an input image signal into the eleven subframes SF1 to SF11 provided with predetermined brightness weights, respectively. When using the first table set, the subframe coordinator 13 selects, according to an input gray-scale level of each pixel, an optimum display gray-scale level from the table shown in FIGS. 7 to 9, and when using the second table set, from the table shown in FIGS. 10 to 12.

Figure 13:
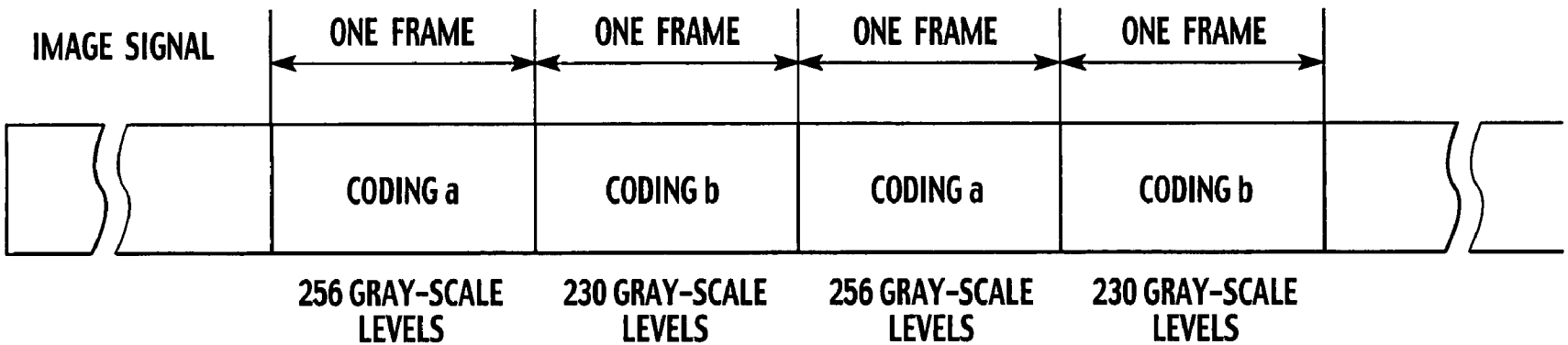
FIG. 13 is a view showing a time series of frames according to the first embodiment of the present invention.

The subframe coordinator 13 alternately provides, at intervals of one frame, an image signal associated with the 256-gray-scale-level subframes selected from the first table set as indicated with "coding a" in FIG. 13 and an image signal associated with the 230-gray-scale-level subframes selected from the second table set as indicated with "codingb" in FIG. 13. The coding a and b shown in FIG. 13 corresponds to the coding a and b shown in FIG. 6.

The weights in the weighting table 3 shown in FIGS. 7 to 9 are the same as those in the weighting table 11 shown in FIGS. 10 to 12. Accordingly, alternating the coding tables 4 and 12 from one to another results in alternating the coding a involving 256 gray-scale levels and the coding b involving 230 gray-scale levels.

Figure 14:
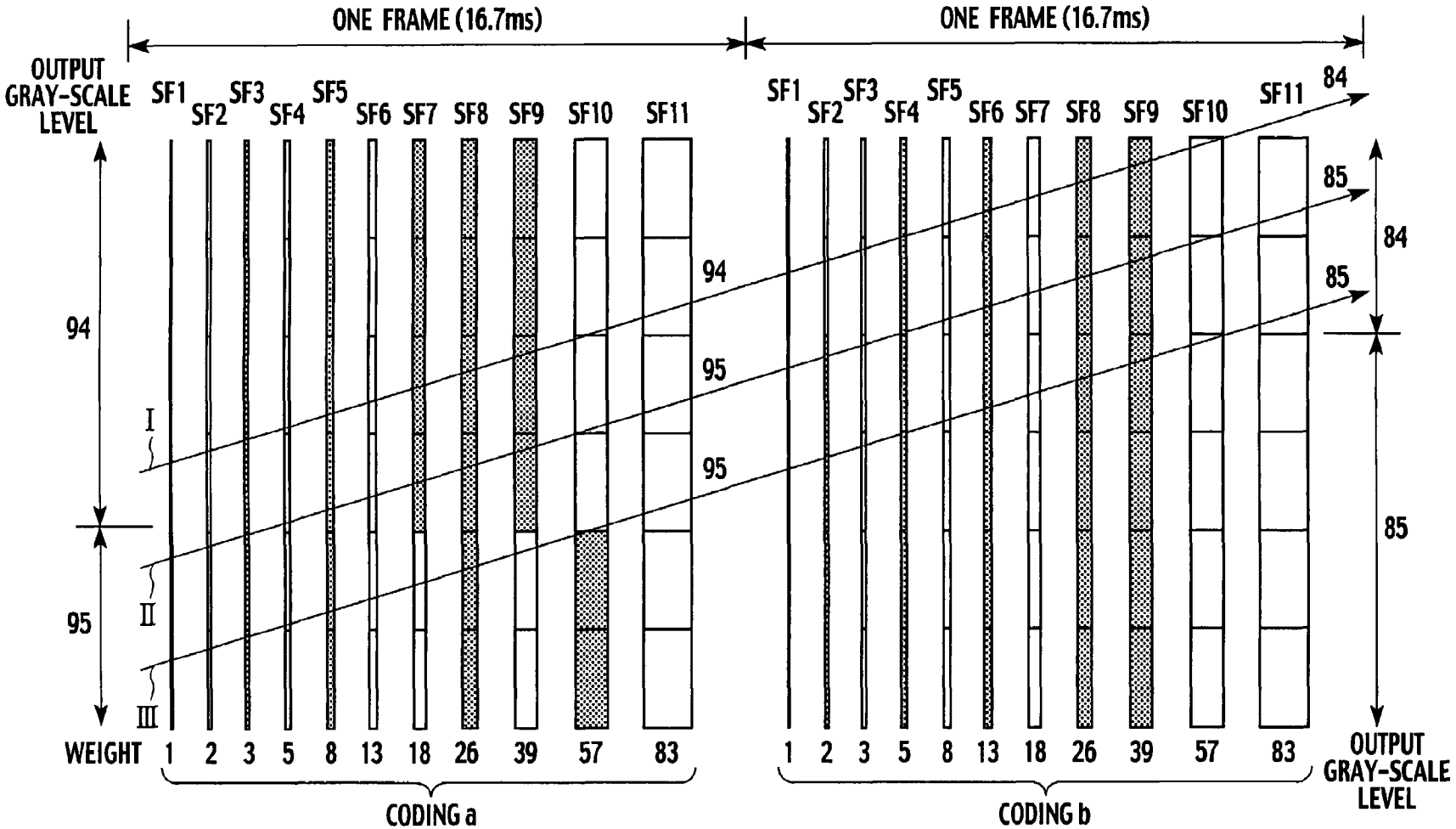
FIG. 14 is a view showing the effect of the first embodiment of the present invention.

The effect of the first embodiment of the present invention will be explained with reference to FIG. 14. An example shown in FIG. 14 receives an input image signal containing gray-scale levels of 94 and 95. A horizontal direction of FIG. 14 represents time. A frame period (16.7 ms) is divided into the eleven subframes SF1 to SF11. A boundary between pixels to display the gray-scale levels of 94 and 95 is moving toward the top of FIG. 14 at a rate of two pixels per frame.

In FIG. 14, a first frame employs the first table set (hereinafter referred to as the coding a) containing the weighting table 3 and coding table 4, so that the input gray-scale levels of 94 and 95 are converted as they are into output gray-scale levels of 94 and 95. At this time, there is a top subframe change. Namely, the selected top subframe changes from SF9 to SF10 between the gray-scale levels of 94 and 95. A second frame of FIG. 14 employs the second table set (hereinafter referred to as the coding b) containing the weighting table 11 and coding table 12, so that the input gray-scale levels of 94 and 95 are converted into output gray-scale levels of 84 and 85, respectively.

In this example, the eyes of a viewer follow a line of sight I shown in FIG. 14. The output gray-scale level of 94 in the first frame is achieved by integrating the subframes SF1 to SF9 according to the coding a. More precisely, the subframes SF3, SF5, SF7, SF8, and SF9 are selected to emit light as shown in FIG. 8, and the total weight of 94 is integrated by the eyes of the viewer to observe the gray-scale level of 94.

In the second frame, the input gray-scale level of 94 is converted into the output gray-scale level of 84 by integrating the subframes SF1 to SF9 according to the coding b. More precisely, the subframes SF1, SF4, SF6, SF8, and SF9 are selected to emit light as shown in FIG. 11, and an integration of the weights of these subframes is observed as the gray-scale level of 84.

When the eyes of the viewer follow a line of sight II of FIG. 14 will be explained. The output gray-scale level of 95 in the first frame is achieved by selecting the subframes SF1, SF3, SF5, SF8, and SF10 according to the coding a. At this time, the line of sight II follows from the subframe SF1 up to the subframe SF4, and then, the subframes SF5 to SF10 of the adjacent pixel displaying the gray-scale level of 94 that is achieved by selecting the subframes SF3, SF5, SF7, SF8, and SF9 according to the coding a. As a result, the eyes of the viewer that follow the line of sight II see the light emitting subframes SF1, SF3, SF5, SF7, SF8, and SF9. Namely, the eyes integrate the weights of these subframes into 95 and see the gray-scale level of 95.

In the second frame, the line of sight II moves on the pixel of the output gray-scale level of 85 from the subframe SF1 up to the subframe SF4. Then, the eyes shift to the adjacent pixel of the output gray-scale level of 84 and follow the subframes SF5 to SF11. Namely, according to the coding b shown in FIG. 11, the line of sight II follows the light emitting subframes SF2, SF4, SF6, SF8, and SF9. As a result, the eyes of the viewer integrate the weights of these subframes into 85 and see the gray-scale level of 85.

When the eyes of the viewer follow a line of sight III of FIG. 14 will be explained. The line of sight III in the first frame is on the pixel of the output gray-scale level of 95 for the subframes SF1 to SF11. According to the coding a of FIG. 8, the subframes SF1, SF3, SF5, SF8, and SF10 are selected to emit light, and therefore, the total weight of 95 is observed as the gray-scale level of 95.

In the second frame, the line of sight III is on the pixel of the output gray-scale level of 85 for the subframes SF1 to SF10. According to the coding b of FIG. 11, the subframes SF2, SF4, SF6, SF8, and SF9 are selected to emit light, and therefore, the total weight of 85 is observed as the gray-scale level of 85.

When the eyes follow the line of sight I, a temporally averaged gray-scale level of the two frames is 89 (=(94+84)/2). When the eyes follow the line of sight II, a temporally averaged gray-scale level of the two frames is 90 (=(95+85)/2). When the eyes follow the line of sight III, a temporally averaged gray-scale level of the two frames is also 90 (=(95+85)/2). From FIGS. 7 to 12, the number of selected subframes of each of the gray-scale levels of 94 and 95 in each of the coding tables 4 and 12 is five. Assuming that light emission brightness in an addressing period is equal to that of one sustain pulse in a sustain discharge period, the output gray-scale levels 89 and 90 become 94 and 95 after adding 5 to each of them. These output gray-scale levels 94 and 95 agree with the input gray-scale levels originally intended to be displayed.

In this way, the first embodiment alternates the coding tables frame by frame to shift a location that causes false contours in one frame to another location in the next frame. As a result, the location to cause false contours never moves with a line of sight and is temporally distributed to surrounding pixels. The first embodiment, therefore, can minimize false contours when displaying dynamic images.

Second Embodiment

Figure 15:
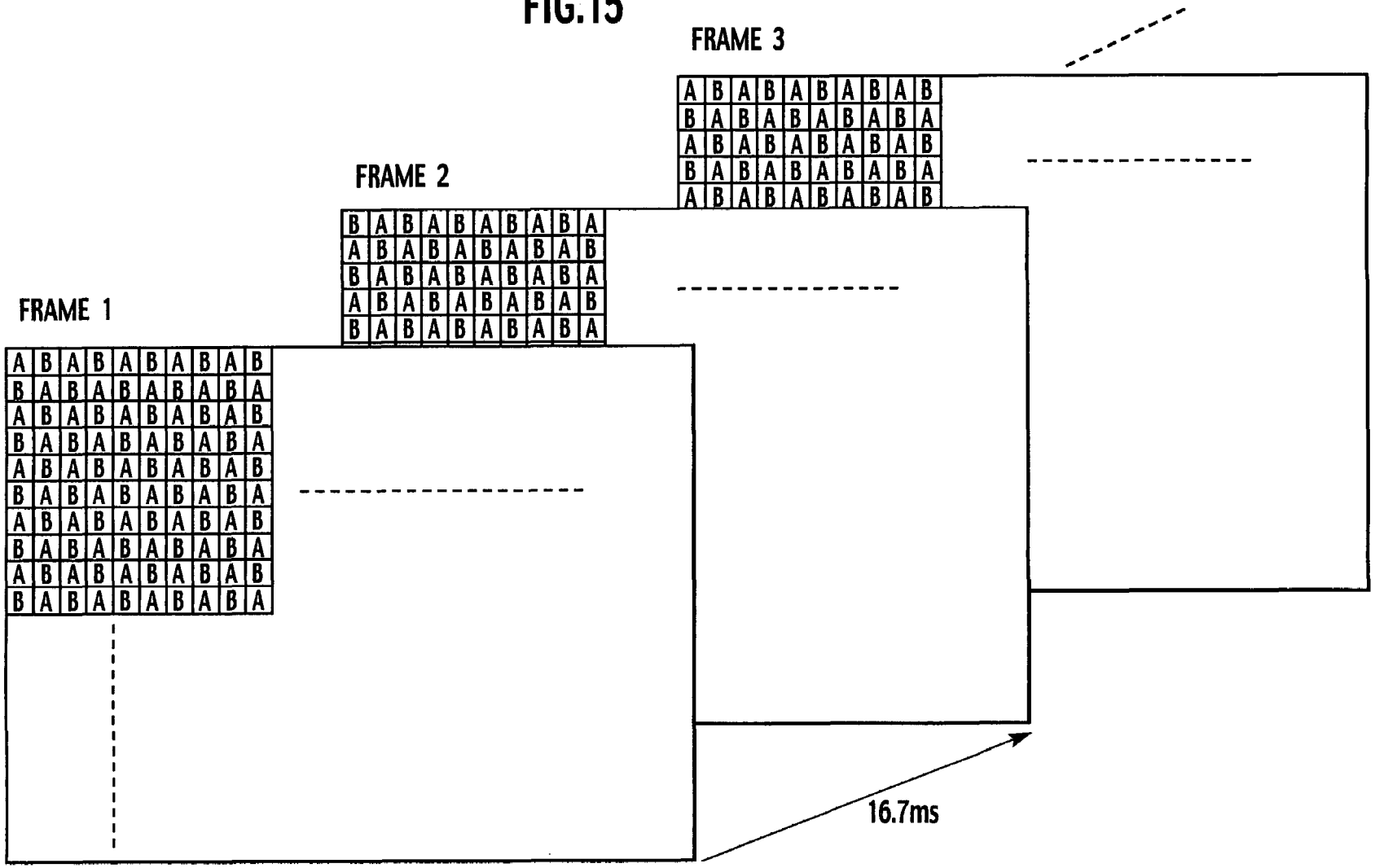
FIG. 15 is a view showing an array of pixels on a display panel according to the second embodiment of the present invention.

The second embodiment of the present invention will be explained with reference to the accompanying drawings. FIG. 15 shows pixel arrangements on a display panel that change from one to another at intervals of one frame according to the second embodiment. In FIG. 15, pixels are divided into groups A and B, and the group-A pixels and group-B pixels are arranged in a hound's-tooth check. Namely, a group-A pixel is surrounded by group-B pixels, and a group-B pixel is surrounded by group-A pixels.

Figure 16:
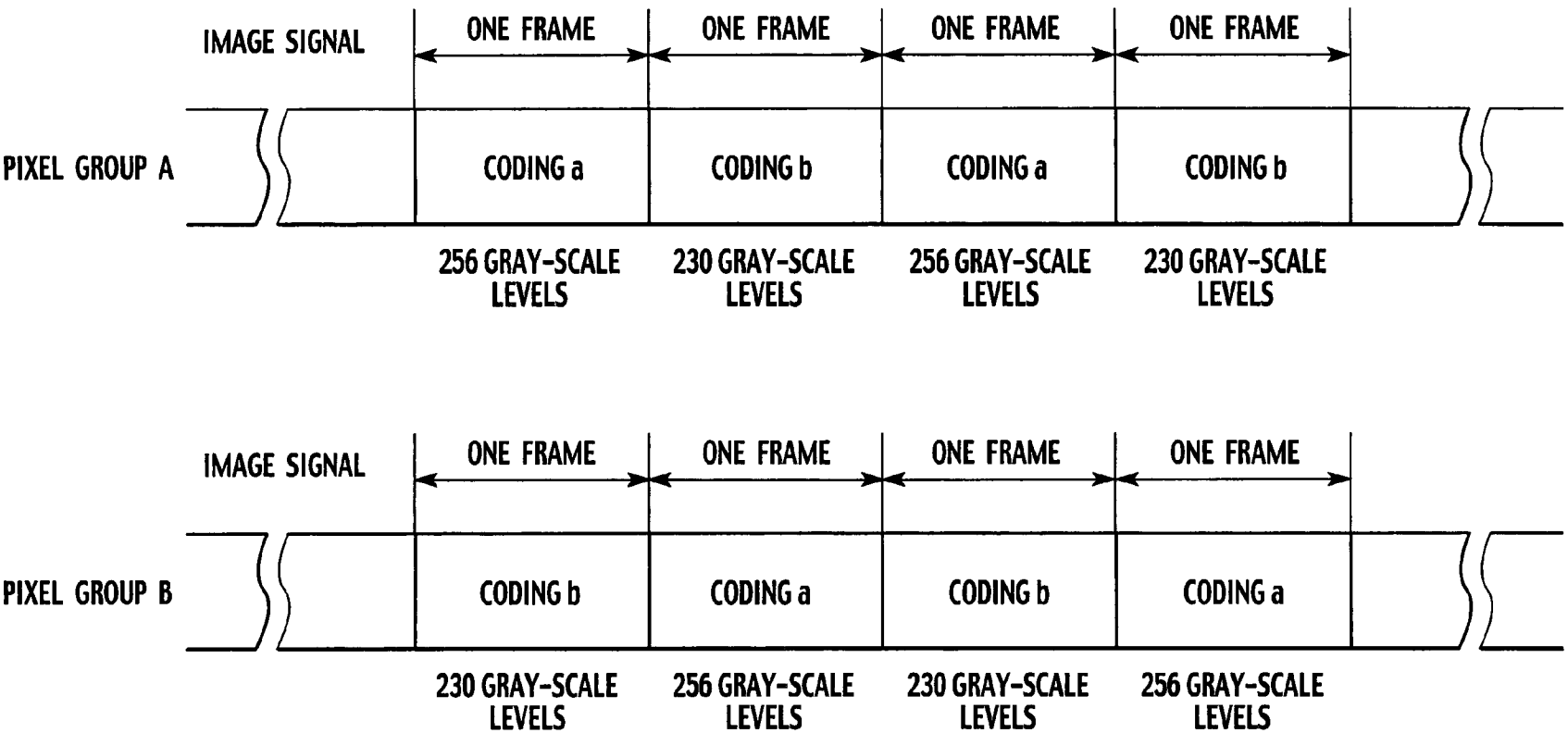
FIG. 16 is a view showing the coding of pixel groups in a series of frames according to the second embodiment of the present invention.

Any pixel that is in the group A in a first frame is changed to the group B in a second frame, and any pixel that is in the group B in the first frame is changed to the group A in the second frame. In this way, the pixel arrangements are alternated frame by frame. FIG. 16 shows temporal changes of the pixel arrangements. The pixels in the group A alternate the coding a of 256 gray-scale levels and the coding b of 230 gray-scale levels frame by frame, and at the same time, the pixels in the group B alternate the coding b and the coding a.

Figure 17:
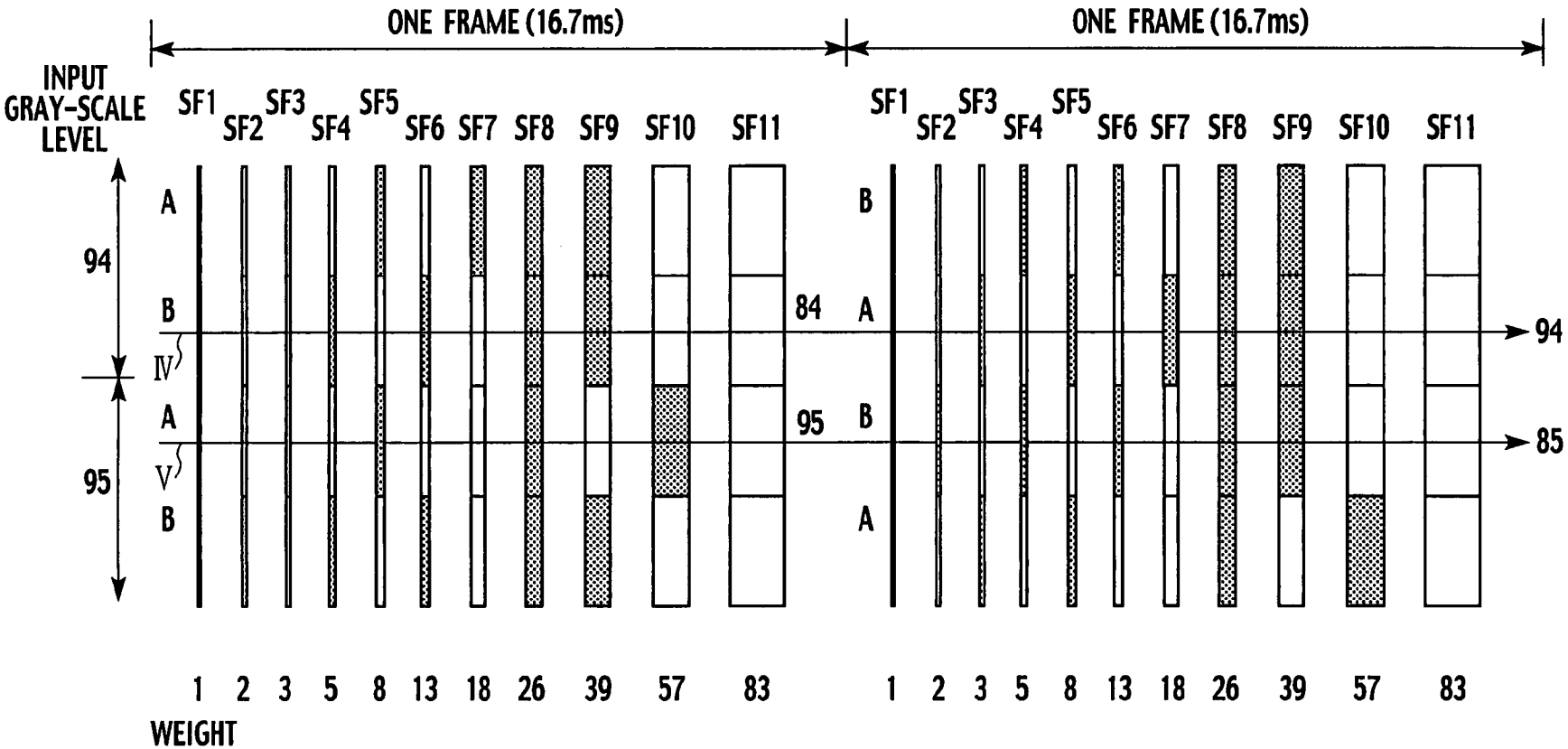
FIG. 17 is a view showing the effect of the second embodiment of the present invention on false contours in a still image.

The effect of the second embodiment will be explained. FIG. 17 explains the effect of the second embodiment on false contours in a still image. A viewer of the PDP sees gray-scale steps on the screen because the gray-scale steps are intrinsic to digital display apparatuses. FIG. 17 shows a boundary between pixels having input gray-scale levels of 94 and 95 and displaying a still image. Between the gray-scale levels of 94 and 95, there is a top subframe step-up. In FIG. 17, an abscissa represents time, and each frame is divided into eleven subframes SF1 to SF11. An ordinate represents pixels. Coding-a pixels and coding-b pixels are alternately arranged and are changed from one to another at intervals of one frame. The subframes depicted with patterns are selected subframes to emit light.

A line of sight IV of the eyes of a viewer will be explained. In a first frame, a pixel under the line of sight IV has an input gray-scale level of 94 and belongs to the group B with the coding b. As shown in FIGS. 11 and 17, the pixel emits light in the subframes SF1, SF4, SF6, SF8, and SF9 among the subframes SF1 to SF11. The total weight of 84 is integrated by the eyes to observe a gray-scale level of 84. In a second frame, the line of sight IV moves on a pixel having an input gray-scale level of 94 and belonging to the group A. According to the coding a assigned to the group A and as shown in FIGS. 8 and 17, the pixel emits light in the subframes SF3, SF5, SF7, SF8, and SF9 among the subframes SF1 to SF11. The total weight of 94 is integrated by the eyes to observe a gray-scale level of 94.

A line of sight V will be explained. In the first frame, the line of sight V moves on a pixel having an input gray-scale level of 95 and belonging to the group A. According to the coding a assigned to the group A and as shown in FIGS. 8 and 17, the pixel emits light in the subframes SF1, SF3, SF5, SF8, and SF10 among the subframes SF1 to SF11. The total weight of 95 is integrated by the eyes to observe a gray-scale level of 95. In the second frame, the line of sight V moves on a pixel having an input gray-scale level of 95 and belonging to the group B. According to the coding b assigned to the group B and as shown in FIGS. 11 and 17, the pixel emits light in the subframes SF2, SF4, SF6, SF8, and SF9 among the subframes SF1 to SF11. The total weight of 85 is integrated by the eyes to observe a gray-scale level of 85.

When the eyes follow the line of sight IV in FIG. 17, a temporally averaged gray-scale level of the two frames is 89 (=(84+94)/2). When the eyes follow the line of sight V, a temporally averaged gray-scale level of the two frames is 90 (=(95+85)/2). From FIGS. 7 to 12, the number of selected subframes of each of the gray-scale levels of 94 and 95 in each of the coding a and b is five. Assuming that light emission brightness in an addressing period is equal to that of one sustain pulse in a sustain discharge period, the output gray-scale levels 89 and 90 become 94 and 95 after adding 5 to each of them. These output gray-scale levels 94 and 95 agree with the input gray-scale levels originally intended to be displayed.

In this way, employing the hound's-tooth check coding according to the second embodiment causes no disturbance in gray-scale levels on displayed images. The hound's-tooth check coding provides dithering and error distribution effects. The second embodiment arranges pixels in the hound's-tooth check and alternates pixel arrangements frame by frame, and therefore, a location where a selected top subframe steps up is distributed to surrounding pixels and along a time axis, to thereby minimize gray-scale steps. As a result, the second embodiment can remarkably reduce still-image false contours specific to the digital display apparatus.

Figure 18:
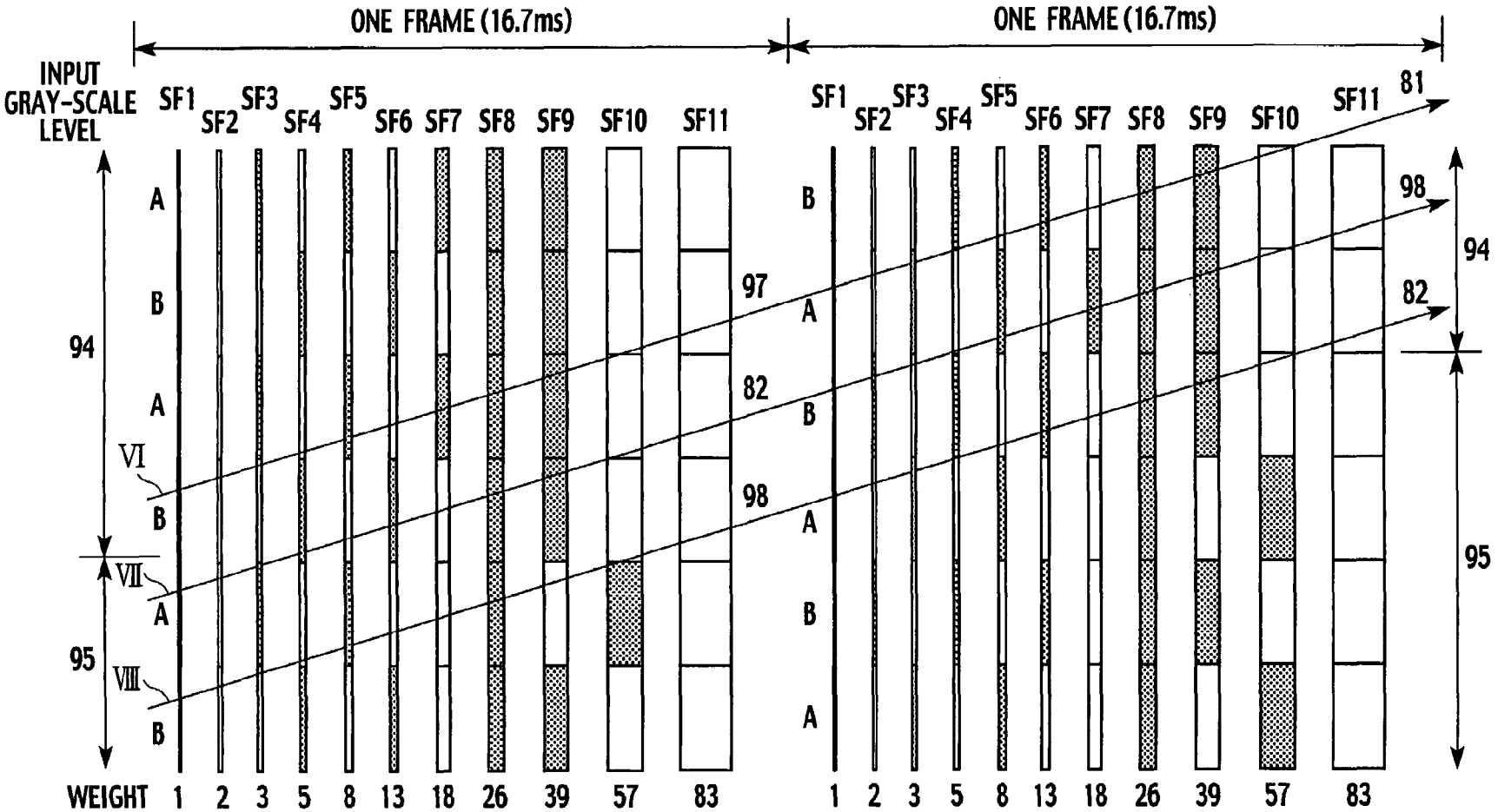
FIG. 18 is a view showing the effect of the second embodiment of the present invention on false contours in a dynamic image.

The effect of the second embodiment on false contours in a dynamic image will be explained with reference to FIG. 18. A horizontal direction of FIG. 18 corresponds to a time axis. A frame period (16.7 ms) is divided into 11 subframes SF1 to SF11. Like the example of FIG. 14, a boundary between pixels to display input gray-scale levels of 94 and 95 is moving toward the top of FIG. 18 at a rate of two pixels per frame. A vertical direction in FIG. 18 represents an array of pixels. Pixels to which the coding a is applied and pixels to which the coding b is applied are alternately arranged. The coding a and the coding b are alternated frame by frame. In FIG. 18, the subframes depicted with patterns are selected subframes to emit light.

A line of sight VI of the eyes of a viewer will be explained. In a first frame, an input gray-scale level of 94 is converted into an output gray-scale level of 84 according to the coding b shown in FIG. 11. At this time, the subframes SF1 to SF4 are integrated to provide the total weight of 6, and the subframes SF1 and SF4 are selected to emit light as shown in FIG. 11. As the line of sight VI moves, the subframes of the adjacent pixel are integrated. More precisely, the subframes SF5 to SF9 for an output gray-scale level of 94 according to the coding a are integrated. At this time, the subframes SF5, SF7, SF8, and SF9 are selected to emit light as shown in FIG. 8. The total weight of these subframes is 91. As a result, the total weight of the light emitting subframes in the first frame becomes 97 (=6+91), and the eyes of the viewer integrate the subframes to see a gray-scale level of 97.

In a second frame, the subframes SF1 to SF4 for a gray-scale level of 94 according to the coding a are integrated. At this time, the subframe SF3 is selected to emit light as shown in FIG. 8. The weigh of this subframe is 3. As the line of sight VI moves, the subframes of the adjacent pixel are integrated. Namely, the subframes SF5 to SF9 for an output gray-scale level of 84 according to the coding b are integrated, and the subframes SF6, SF8, and SF9 among the subframes SF5 to SF9 are selected to emit light as shown in FIG. 11. The sum of the weights of these subframes is 78. As a result, the total weight of the light emitting subframes in the second frame becomes 81 (=3+78), and the eyes of the viewer integrate the subframes to see a gray-scale level of 81.

A line of sight VII of FIG. 18 will be explained. In the first frame, the line of sight VII is on a pixel in the group A having an output gray-scale level of 95. According to the coding a, the subframes SF1, SF3, SF5, SF8, and SF10 are selected to emit light as shown in FIG. 8. At this time, the line of sight VII moves from the subframe SF1 up to the subframe SF4, and then, to the subframes SF5 to SF10 of the adjacent pixel in the group B having an input gray-scale level of 94. For the input gray-scale level of 94, the coding b selects the subframes SF6, SF8, and SF9 to emit light as shown in FIGS. 11 and 18. As a result, the line of sight VII follows the light emitting subframes SF1, SF3, SF6, SF8, and SF9. The weights of these subframes are integrated by the eyes to see a gray-scale level of 82.

In the second frame, the line of sight VII is on a pixel in the group B having an output gray-scale level of 95 and moves from the subframe SF1 up to the subframe SF4. According to the coding b, the subframes SF2, SF4, SF6, SF8, and SF9 are selected to emit light as shown in FIGS. 11 and 18. At this time, the line of sight VII moves from the subframe SF1 up to the subframe SF4, and then, to the adjacent pixel in the group A having an input gray-scale level of 94. For the input gray-scale level of 94, the coding a selects the subframes SF3, SF5, SF7, SF8, and SF9 to emit light. At this time, the line of sight VII moves from the subframe SF5 to the subframe SF10. As a result, the line of sight VII follows the light emitting subframes SF2, SF4, SF5, SF7, SF8, and SF9. The weights of these subframes are integrated by the eyes to see a gray-scale level of 98.

A line of sight VIII of FIG. 18 will be explained. In the first frame, the line of sight VIII is on a pixel in the group B having an input gray-scale level of 95 and moves through the subframes SF1 to SF4. According to the coding b, the subframes SF2 and SF4 are selected to emit light as shown in FIG. 11. Thereafter, the line of sight VIII moves to integrate subframes for an input gray-scale level of 95 of the adjacent pixel in the group A. According to the coding a assigned to the group A, the subframes SF5 to SF10 are integrated for the output gray-scale level of 95. As a result, in the first frame, the subframes SF2, SF4, SF5, SF8, and SF10 are selected to emit light, and the total weight of these subframes of 98 are integrated by the eyes to observe a gray-scale level of 98.

In the second frame, the line of sight VIII is on a pixel in the group A having an input gray-scale level of 95 and moves from the subframe SF1 up to the subframe SF4. According to the coding a, the subframes SF1 and SF3 are selected to emit light as shown in FIG. 8. Thereafter, the line of sight VIII integrates the subframes for the input gray-scale level of 95 of the adjacent pixel in the group B. According to the coding b assigned to the group B, the subframes SF5 to SF10 are integrated for an output gray-scale level of 85. As a result, in the second frame, the subframes SF1, SF3, SF6, SF8, and SF9 are selected to emit light, and the total weight of these subframes of 82 are integrated by the eyes to observe a gray-scale level of 82.

When the eyes follow the line of sight VI of FIG. 18, a temporally averaged gray-scale level of the two frames is 89 (=(97+81)/2). When the eyes follow the line of sight VII, a temporally averaged gray-scale level of the two frames is 90 (=(82+98)/2). When the eyes follow the line of sight VIII, a temporally averaged gray-scale level of the two frames is 90 (=(98+82)/2).

From FIGS. 7 to 12, the number of selected subframes of each of the gray-scale levels of 94 and 95 in each of the coding a and b is five. Assuming that light emission brightness in an addressing period is equal to that of one sustain pulse in a sustain discharge period, the output gray-scale levels become 94 and 95 after adding 5 to each of them. These output gray-scale levels 94 and 95 agree with the input gray-scale levels originally intended to be displayed. Employing the hound's-tooth check coding according to the second embodiment causes no disturbance in gray-scale levels on displayed images.

Between the first and second frames, a location where a top subframe step-up occurs moves by one pixel on a displayed image. As a result, locations where false contours frequently appear are distributed to surrounding pixels and along a time axis. In this way, the second embodiment can remarkably reduce false contours in dynamic-images.

The present invention is not limited to the above-mentioned embodiments. For example, the coding tables 4 and 12 and the weighting tables 3 and 11 may not be stored in an external storage unit. Instead, the values in the tables may internally be calculated. Although the embodiments employ the coding a and b shown in FIG. 6, it is possible to employ the coding c and a (or b) shown in FIG. 6. It is also possible to employ three or more sets of coding tables and corresponding weighting tables. If three sets of coding and weighting tables are employed, coding for 230, 242, and 256 gray-scale levels, for example, will be conducted.

A modification of the present invention may employ a unit for adaptively changing the number of output gray-scale levels during power control. Although the above-mentioned embodiments have been explained in connection with the display apparatus employing the PDP, the present invention is also applicable to display apparatuses employing liquid crystal panels or organic electroluminescence (EL) panels. When employing two coding tables, the present invention can make the number of display gray-scale levels of one table smaller than the other by 1% to 15%. A modification of the present invention may switch a plurality of sets of weighting tables and corresponding coding tables from one to another pixel by pixel.

Third Embodiment

Figure 19:
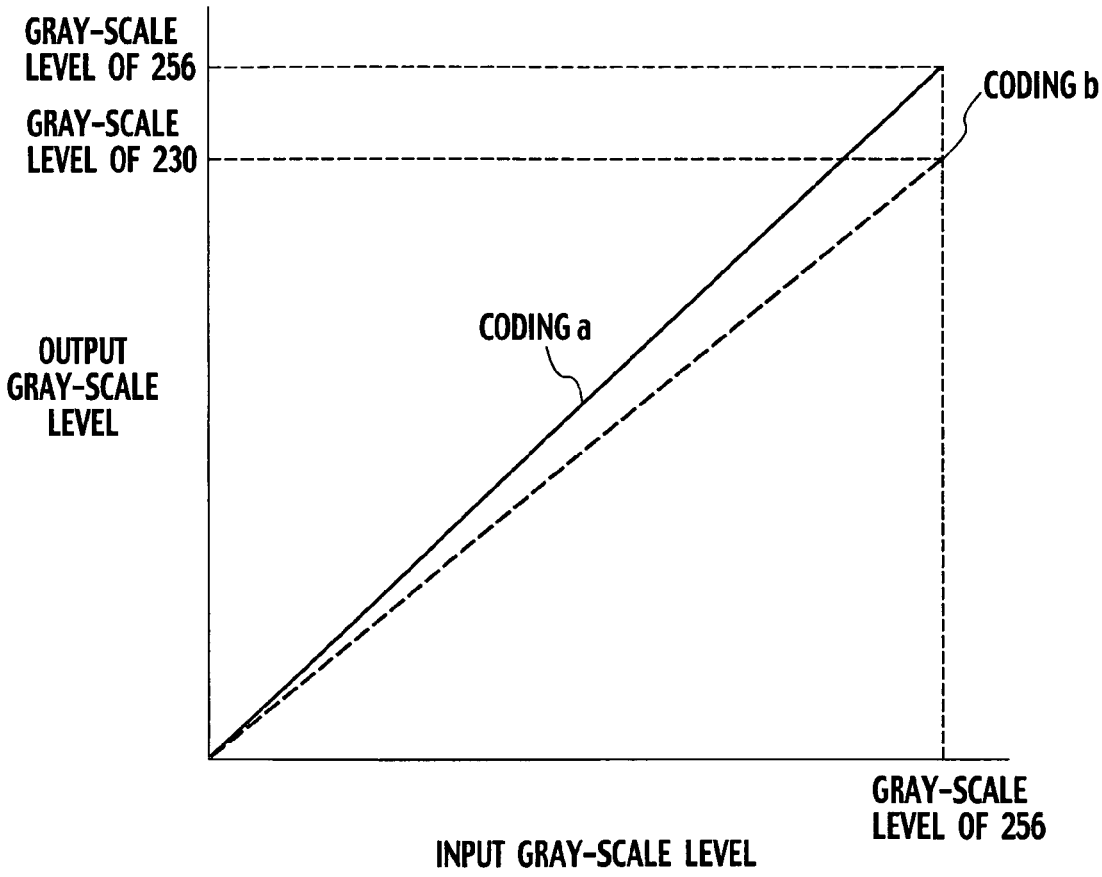
FIG. 19 is a graph showing examples of gray-scale-level input/output characteristics of input and output signals according to the third and fourth embodiments of the present invention.

FIG. 19 is a graph showing an example of a technique of changing the gray-scale level of an input signal according to the third and fourth embodiments of the present invention. In FIG. 19, an abscissa represents the gray-scale level of an input signal, and an ordinate represents the gray-scale level of an output signal. When an input signal has a gray-scale level of 256, coding "a" provides an output signal having a gray-scale level of 256. At this time, coding "b" provides an output signal having a gray-scale level of 230 which is lower than that provided by the coding a. Each of the coding a and b has a linear gray-scale-level input/output characteristic.

The dual coding according to the present invention will briefly be explained with reference to FIG. 20. FIG. 20(A) shows a basic subframe coding table that weights a subframe by the "n"th power of 2. The table involves subframes SF1 to SF5 that are weighted by 1, 2, 4, 8, and 16, respectively. In the table of FIG. 20(A), a left end column shows input gray-scale levels. Any subframe marked with a circle is a subframe to be selected to emit light. Like the coding a of FIG. 19, coding based on the table shown in FIG. 20(A) has a linear characteristic between input gray-scale levels and output gray-scale levels.

If an input signal has a gray-scale level of 10, the coding table of FIG. 20(A) selects the subframes SF2 and SF4 marked with circles. Weights corresponding to these subframes are 2 and 8 as shown in FIG. 20(A). The sum of these weights is 10, which is an output gray-scale level to be displayed.

FIG. 20(B) shows an envelope that plots the selected top subframes of gray-scale levels when the gray-scale levels are sequentially selected from 0 to 31. In FIG. 20(B), an abscissa represents time and an ordinate represents the gray-scale levels shown in FIG. 20(A). To clearly show a temporal relationship among the gray-scale levels, the relative light emitting time of each gray-scale level in one frame is depicted in FIG. 20(B) according to the light emitting time of an actual number of sustain pulses.

In FIG. 20(B), a reference mark "a" indicates a location where a false contour frequently occurs when displaying a dynamic image. Such locations include where the gray-scale level changes from 3 to 4, from 7 to 8, and from 15 to 16. For example, the location where the gray-scale level changes from 3 to 4 in FIG. 20(A) will be studied. The gray-scale level of 3 selects the subframes SF1 and SF2, while the gray-scale level of 4 does not select the subframes SF1 and SF2 and selects only the subframe SF3. Namely, the selected top subframe is changed from SF2 to SF3.

Similarly, the location where the gray-scale level changes from 7 to 8 will be studied. The gray-scale level of 7 selects the subframes SF1, SF2, and SF3, while the gray-scale level of 8 does not select the subframes SF1, SF2, and SF3 and selects only the subframe SF4. Namely, the selected top subframe is changed from SF3 to SF4. Similarly, the location where the gray-scale level changes from 15 to 16 will be studied. The gray-scale level of 15 selects the subframes SF1, SF2, SF3, and SF4, while the gray-scale level of 16 does not select the subframes SF1 to SF4 and selects only the subframe SF5. Namely, the selected top subframe is changed from SF4 to SF5.

Figure 20:
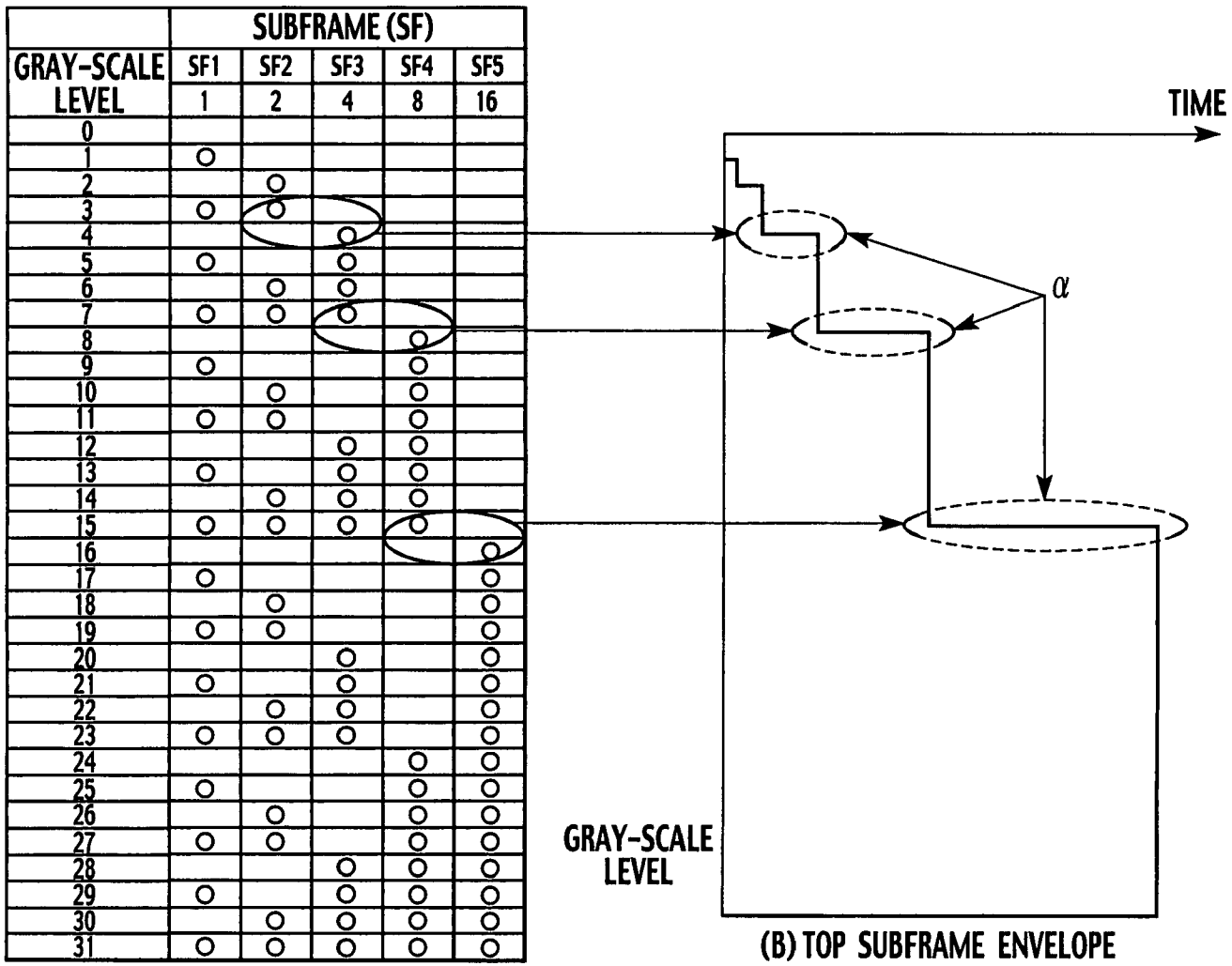
FIG. 20 is a view showing a basic subframe coding table and an envelope plotting top subframes of gray-scale levels according to the third and fourth embodiments of the present invention.

In FIG. 20, there are five subframes weighted by the "n"th power of 2. The number of subframes may be greater than that of FIG. 20, or may be 10 to 12 with the subframes being weighted differently. When an envelope is formed to plot selected top subframes for each case, any location where a steep change occurs on the envelope is evaluated as a top subframe step-up location to cause false contours when displaying a dynamic image.

Figure 21:
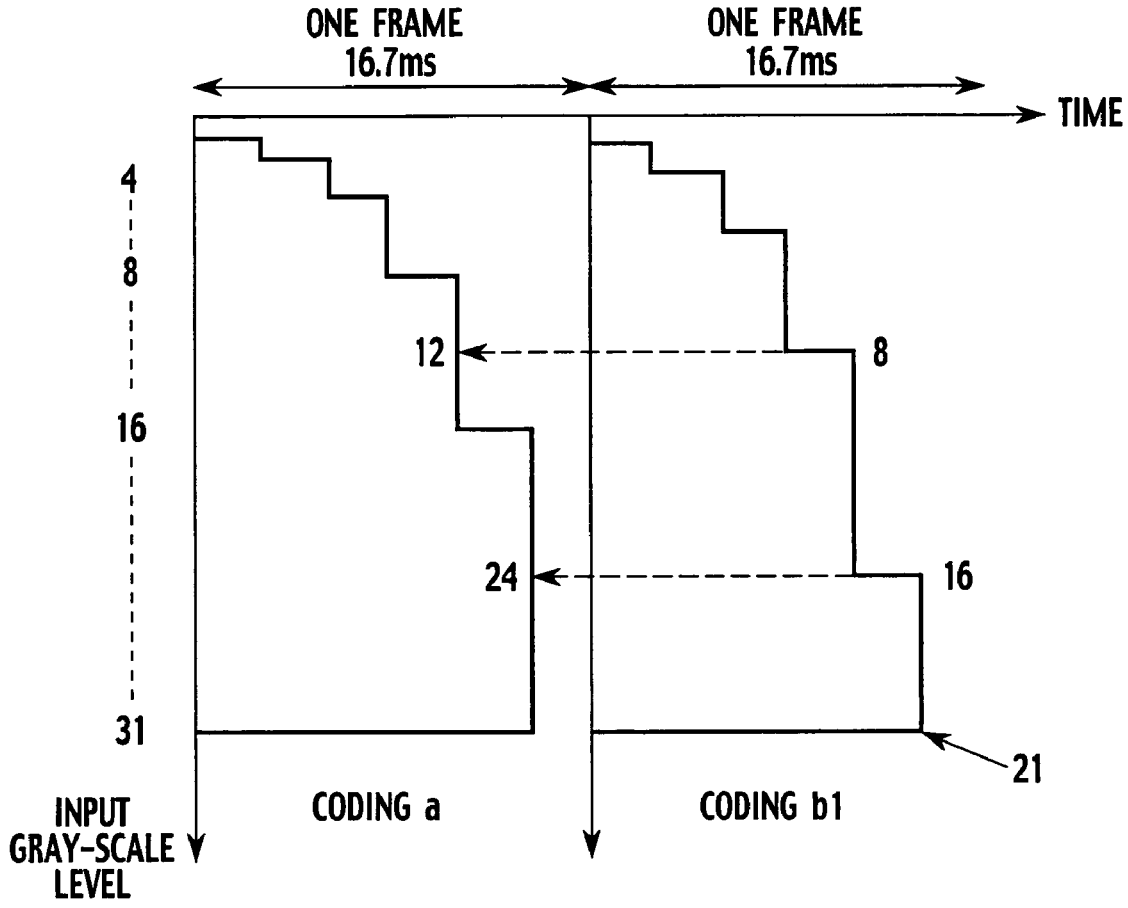
FIG. 21 is an explanatory view showing a first example of dual coding according to the third and fourth embodiments of the present invention.

A first technique according to the third embodiment of the present invention to minimize false contours on a dynamic image will be explained. FIG. 21 explains the first technique to minimize false contours. In FIG. 21, an abscissa represents a temporal change in a selected top subframe of a pixel to be displayed on a display apparatus, and an ordinate represents an input gray-scale level to be displayed on the display apparatus. In a first frame shown in FIG. 21, an envelope plots the top subframes of input gray-scale levels based on coding a of the first coding table shown in FIG. 20(A). This envelope is the same as that of FIG. 20(B).

In a second frame shown in FIG. 21, an envelope plots the top subframes of input gray-scale levels based on coding b1 of a second coding table. The subframes are selected such that a location where a top subframe step-up occurs according to the coding b1 differs from a location where the same occurs according to the coding a. A technique that is most effective to minimize false contours appearing on dynamic images is to bring a top subframe step-up location according to the coding b1 to around an intermediate location of a range of the coding a in which a top subframe step-up does not occur.

In FIG. 21, the coding b1 converts 31 input gray-scale levels of the coding a into 21 output gray-scale levels. Namely, an input gray-scale level is multiplied by about 0.66 and a gray-scale level corresponding to the product is extracted from the coding a as an output gray-scale level of the coding b1. For example, in the first frame of FIG. 21, an input gray-scale level of 12 is provided as it is as an output gray-scale level of 12 according to the coding a. In the second frame, the input gray-scale level of 12 is converted into a gray-scale level of 8 ($\approx 12 \times 0.66$), and this gray-scale coding level of 8 according to the coding a is provided as an output gray-scale level of the coding b1. In practice, coding conversion tables are internally prepared to reduce and simplify circuit scale, and these tables are properly selected and used.

In FIG. 21, a location of the coding b1 where the output gray-scale level is 8 and the selected top subframe steps up to SF4 corresponds to the center of a range between the gray-scale levels of 8 and 16 of the coding a where the selected top subframe SF4 is unchanged and is continuously selected. Similarly, a location of the coding b1 where the selected top subframe of the gray-scale level of 16 steps up to SF5 corresponds to the center of a range between the gray-scale levels of 16 and 31 of the coding a where the selected top subframe SF5 is unchanged and is continuously selected.

Alternating the two subframe coding sets a and b having the above-mentioned relationship frame by frame can distribute a location where false contours occur on dynamic images to a different position in an output image on the display apparatus frame by frame. This results in remarkably reducing false contours on dynamic images. According to this technique, the coding b1 is obtained by linearly transforming the coding a, to maintain a relationship between an input image signal and an output image signal. Namely, a linear relationship between a displayed brightness and an input gray-scale level is maintained in each of the coding a and b1. Even if a temporal range to be integrated by the eyes of a viewer is not within two frames (for example, three frames), disturbance hardly occurs in an output image because the two codes maintain a constant relationship.

Figure 22:
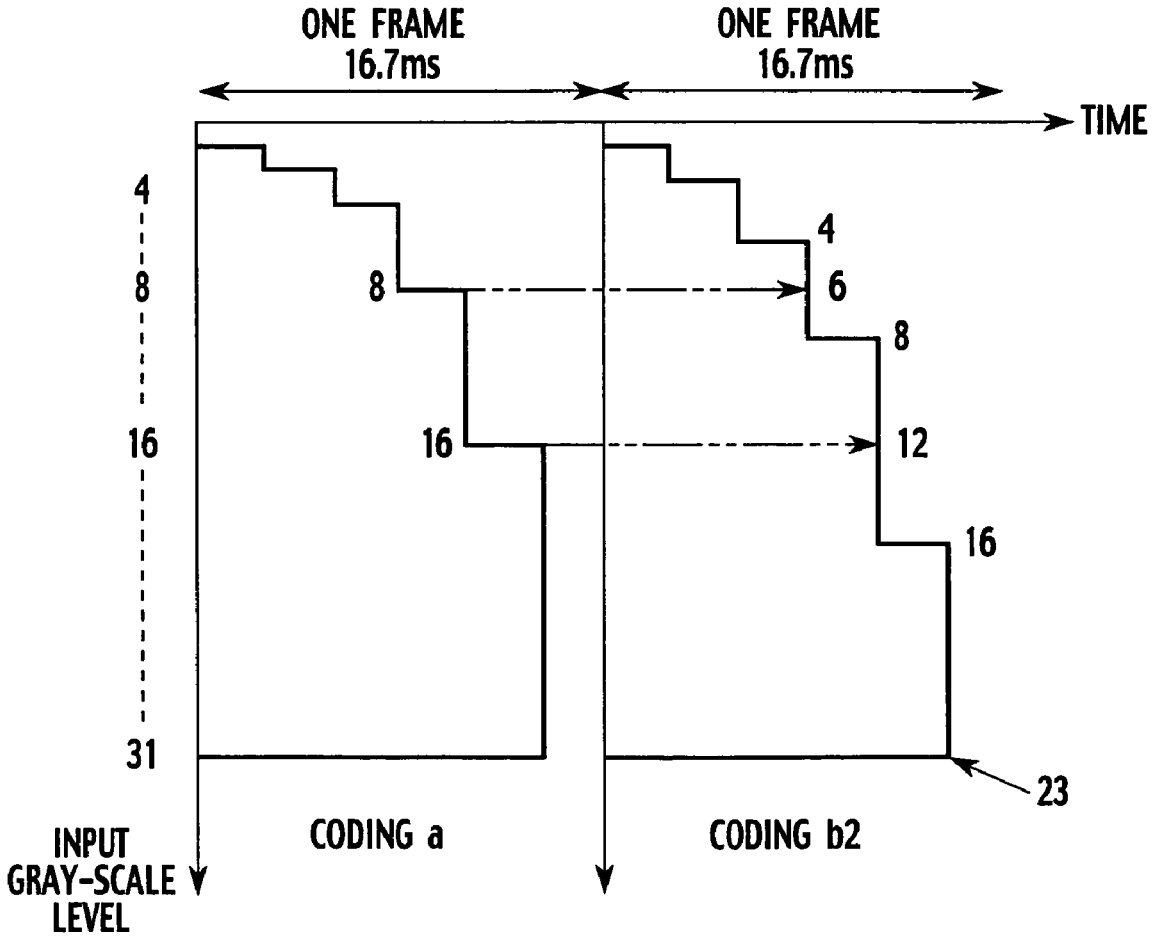
FIG. 22 is an explanatory view showing a second example of dual coding according to the third and fourth embodiments of the present invention.

A second technique according to the third embodiment of the present invention to minimize false contours when displaying a dynamic image will be explained. FIG. 22 explains the second technique to minimize false contours. In FIG. 22, an abscissa represents a temporal change in a selected top subframe of a pixel to be displayed on a display apparatus, and an ordinate represents an input gray-scale level to be displayed on the display apparatus. In a first frame shown in FIG. 22, an envelope plots the top subframes of input gray-scale levels based on the coding a of the first coding table shown in FIG. 20(A). This envelope is the same as that of FIG. 20(B).

In a second frame shown in FIG. 22, an envelope plots the top subframes of input gray-scale levels based on coding b2 of a second coding table. The subframes are selected such that a location where a top subframe step-up occurs according to the coding b2 differs from a location where the same occurs according to the coding a. A top subframe step-up location according to the coding a is brought to around an intermediate location of a range of the coding b2 in which a top subframe step-up does not occur.

In FIG. 22, the coding b2 converts 31 input gray-scale levels of the coding a into 23 output gray-scale levels. Namely, an input gray-scale level is multiplied by about 0.75 and a gray-scale level corresponding to the product is extracted from the coding a as an output gray-scale level of the coding b2. For example, in the first frame of FIG. 22, an input gray-scale level of 8 is provided as it is as an output gray-scale level of 8 according to the coding a. In the second frame, the input gray-scale level of 8 is converted into a gray-scale level of 6 ($\approx 8\times 0.75$), and this gray-scale coding level of 6 according to the coding a is provided as an output gray-scale level of the coding b2. In practice, coding conversion tables are internally prepared to reduce and simplify circuit scale, and these tables are properly selected and used.

In FIG. 22, a location in the coding a where the output gray-scale level is 8 and the selected top subframe steps up to SF4 corresponds to the center of a range between the gray-scale levels of 4 and 8 of the coding b2 where the selected top subframe SF3 is unchanged and is continuously selected. Similarly, a location of the coding a where the selected top subframe of the gray-scale level of 16 steps up to SF5 corresponds to the center of a range between the gray-scale levels of 8 and 16 of the coding b2 where the selected top subframe SF4 is unchanged and is continuously selected.

The second technique of the third embodiment brings a gray-scale level at which a top subframe step-up occurs according to the coding a to an intermediate location of a range of gray-scale levels of the coding b2 in which a top subframe is unchanged and is continuously selected. Alternating the two subframe coding sets a and b2 having such a relationship frame by frame can distribute a location where false contours occur on a dynamic image to a different position in an output image on the display apparatus frame by frame. This results in remarkably reducing false contours on dynamic images. According to second technique, the coding b2 is obtained by linearly transforming the coding a, to maintain a relationship between an input image signal and an output image signal. Like the first technique, the second technique hardly causes disturbance in an output image.

Figure 23:
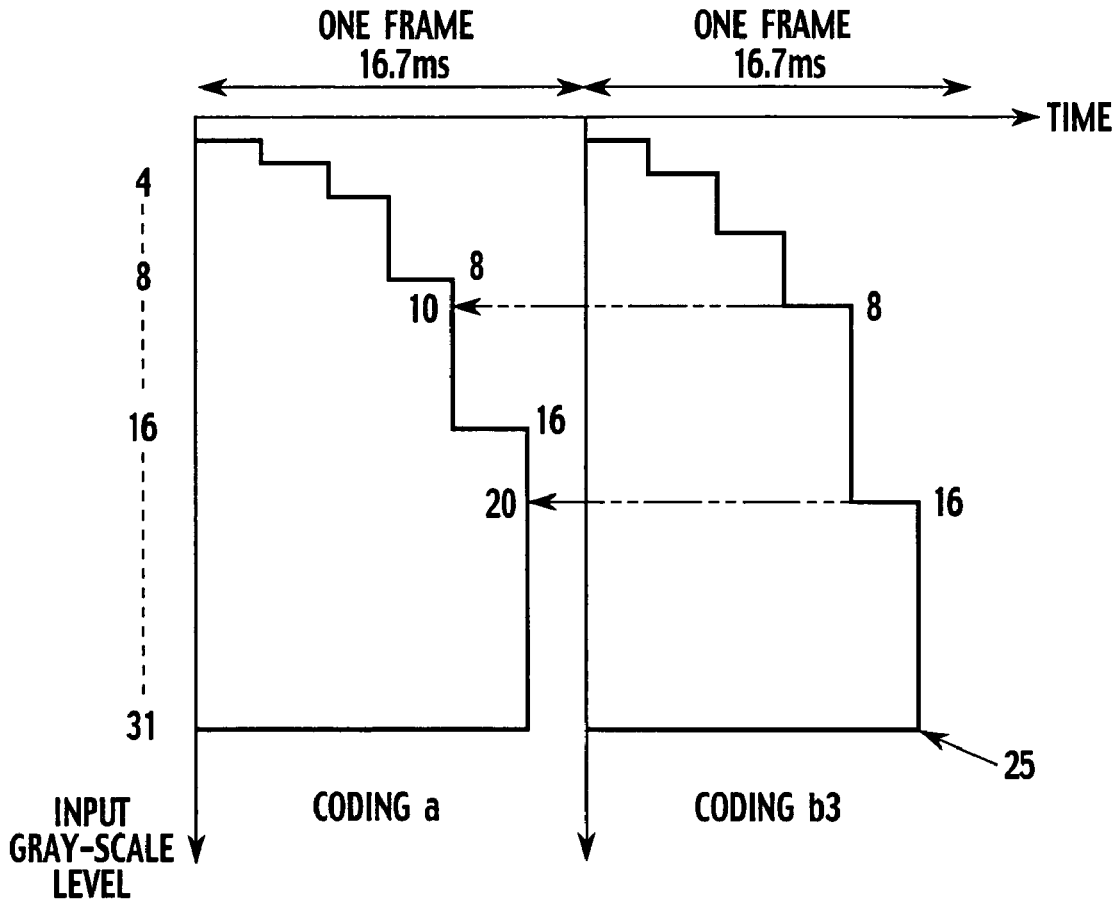
FIG. 23 is an explanatory view showing a third example of dual coding according to the third and fourth embodiments of the present invention.

A third technique according to the third embodiment of the present invention to minimize false contours when displaying a dynamic image will be explained. FIG. 23 explains the third technique to minimize false contours. In FIG. 23, an abscissa represents a temporal change in a selected top subframe of a pixel to be displayed on a display apparatus, and an ordinate represents an input gray-scale level to be displayed on the display apparatus. In a first frame shown in FIG. 23, an envelope plots the top subframes of input gray-scale levels based on the coding a of the first coding table shown in FIG. 20(A). This envelope is the same as that of FIG. 20(B).

In a second frame shown in FIG. 23, an envelope plots the top subframes of input gray-scale levels based on coding b3 of a second coding table. The subframes are selected such that a location of the coding b3 where a top subframe step-up occurs corresponds to an intermediate location of a range of the coding a in which a selected top subframe is unchanged and is continuously selected and in which a subframe just below the selected top subframe is unselected. This location is about a quarter from the start of the range of the coding a in which the selected top subframe is unchanged and is continuously selected.

In FIG. 23, the coding b3 converts 31 input gray-scale levels of the coding a into 25 output gray-scale levels. Namely, an input gray-scale level is multiplied by about 0.8 and a gray-scale level corresponding to the product is extracted from the coding a as an output gray-scale level of the coding b3. For example, in the first frame of FIG. 23, an input gray-scale level of 10 is provided as it is as an output gray-scale level of 10 according to the coding a. In the second frame, the input gray-scale level of 10 is converted into a gray-scale level of 8 ($\approx 10\times 0.8$), and this gray-scale level of 8 according to the coding a is provided as an output gray-scale level of the coding b3. In practice, coding conversion tables are internally prepared to reduce and simplify circuit scale, and these tables are properly selected and used.

In FIG. 23, a location of the coding b3 where the output gray-scale level is 8 and the selected top subframe steps up to SF4 corresponds to a gray-scale level of 10 of the coding a that is about a quarter from the start of a range between the gray-scale levels of 8 and 16 of the coding a in which the selected top subframe SF4 is unchanged and is continuously selected. Similarly, a location of the coding b3 where the output gray-scale level is 16 and the selected top subframe steps up to SF5 corresponds to a gray-scale level of 20 of the coding a that is about a quarter from the start of a range between the gray-scale levels of 16 and 31 of the coding a in which the selected top subframe SF5 is unchanged and is continuously selected.

The third technique brings a gray-scale level of the coding b3 at which a top subframe step-up occurs to an intermediate location of a gray-scale-level range of the coding a in which a selected top subframe is unchanged and is continuously selected and in which a subframe just below the selected top subframe is unselected. This technique is used when the subframe just below the selected top subframe is influential to cause false contours on dynamic images. This technique differs a top subframe step-up location of the coding b3 from a second-top subframe step-up location of the coding a.

The same false contour minimizing effect is obtainable by bringing a gray-scale level of the coding b at which a top subframe step-up occurs to an intermediate location of a gray-scale-level range of the coding a in which a selected top subframe is unchanged and is continuously selected and in which a subframe just below the selected top subframe is selected.

The techniques of changing gray-scale-level input/output characteristics between two coding tables are not limited to those explained above. For example, a gray-scale level of the coding bat which a top subframe step-up occurs can be brought to an intermediate location of a gray-scale-level range of the coding a in which a selected top subframe "n" ("n" being a natural number equal to or smaller than the number of subframes) is unchanged and is continuously selected and in which a subframe "m" ("m" being an integer equal to or greater than 1 and equal to or smaller than "n−1") is continuously selected or unselected.

Alternating the two sets of subframe coding having such a relationship frame by frame can distribute a location where false contours occur on dynamic images to a different position in an output image on the display apparatus frame by frame. This results in remarkably reducing false contours on dynamic images. According to this technique, the coding b3 is obtained by linearly transforming the coding a, to maintain a relationship between an input image signal and an output image signal. Like the first and second techniques, the third technique hardly causes disturbance in an output image.

FIGS. 24(A), 25(A), 26(A), 27(A), 28(A), and 29(A) show a first table realizing the coding a of FIG. 19 involving 256 input gray-scale levels and 256 output gray-scale levels. This first coding table consists of a combination of the coding table 4 and weighting table 3 of FIG. 4.

FIGS. 24(B), 25(B), 26(B), 27(B), 28(B), and 29(B) show a second table realizing the coding b of FIG. 19 involving 256 input gray-scale levels and 230 output gray-scale levels. This second table consists of a combination of the coding table 12 and weighting table 11 of FIG. 4 and is made by linearly transforming the first table.

In each of the first and second tables shown in FIGS. 24 to 29, a left end column shows input gray-scale levels provided with input image signals and the second to twelfth columns show subframes SF1 to SF11 with subframes marked with circles being selected subframes to emit light. Values just below the subframes SF1 to SF11 in the second to twelfth columns are weights of the weighting tables 3 and 11. A right end (thirteenth) column shows output gray-scale levels provided with output image signals to be displayed on the display apparatus.

If an input signal has a gray-scale level of 18, the first table for the coding a selects the subframes SF2, SF3, and SF6 as shown in FIG. 24(A). Weights corresponding to these subframes are 2, 3, and 13 as shown in FIG. 24(A). The sum of these weights is 18, which is the gray-scale level of an output signal.

On the other hand, the second table for the coding b selects, for the input signal having a gray-scale level of 18, the subframes SF1, SF3, and SF6 as shown in FIG. 24(B). Weights corresponding to these subframes are 1, 3, and 13 as shown in FIG. 24(B). The sum of these weights is 17, which is the gray-scale level of an output signal.

The first table for the coding a and the second table for the coding b are formed so that a top subframe step-up location in the first table differs from that in the second table (by at least one output gray-scale level). For example, in the first table (coding table 4 and weighting table 3) of FIG. 25(A), a top subframe among the selected subframes marked with circles steps up from SF8 to SF9 when the gray-scale level of an input image signal changes from 65 to 66.

On the other hand, in the second table (coding table 12 and weighting table 11) of FIG. 25(B), a top subframe among the selected subframes marked with circles steps up from SF8 to SF9 when the gray-scale level of an input image signal changes from 73 to 74 that is different from that of the first table. The location between the input gray-scale levels of 73 and 74 of the second table corresponds to an intermediate location of a range of gray-scale levels of 66 to 78 of the first table in which the subframe SF9 is continuously selected as a top subframe and in which the subframe SF8 just below the selected top subframe SF9 is unselected.

In the first table (coding table 4 and weighting table 3) of FIG. 26(A), a top subframe among the selected subframes marked with circles steps up from SF9 to SF10 at a location where the gray-scale level of an input signal changes from 94 to 95. On the other hand, in the second table (coding table 12 and weighting table 11) of FIG. 26(B), a top subframe among the selected subframes marked with circles steps up from SF9 to SF10 at a location where the input gray-scale level changes from 105 to 106, which is different from that of the first table.

The location between the input gray-scale levels of 105 and 106 of the second table corresponds to an intermediate location of a range of gray-scale levels of 95 to 116 of the first table in which the subframe SF10 is continuously selected as a top subframe and in which the subframe SF9 just below the selected top subframe SF10 is unselected.

In the first table (coding table 4 and weighting table 3) of FIG. 27(A), a top subframe among the selected subframes marked with circles steps up from SF10 to SF11 at a location where the gray-scale level of an input image signal changes from 142 to 143. On the other hand, in the second table (coding table 12 and weighting table 11) of FIG. 27(B), a top subframe among the selected subframes marked with circles steps up from SF10 to SF11 at a location where the input gray-scale level changes from 160 to 161, which is different from that of the first table.

The location between the input gray-scale levels of 160 and 161 of the second table corresponds to an intermediate location of a range of gray-scale levels of 143 to 169 of the first table in which the subframe SF11 is continuously selected as a top subframe and in which the subframe SF10 just below the selected top subframe SF11 is unselected.

According to the third embodiment, the subframe coordinator 13 of FIG. 4 employs the first table consisting of the weighting table 3 and corresponding coding table 4 in a given frame period, to assign the subframes of 256 gray-scale levels for an image signal processed by the image processor 1, and in the next frame period, employs the second table consisting of the weighting table 11 and corresponding coding table 12 to assign the subframes of 230 gray-scale levels for an image signal processed by the image processor 1. The first and second tables are alternately employed frame by frame.

The subframe coordinator 13 divides a frame period of an input image signal into eleven subframes SF1 to SF11 provided with individual brightness weights. When using the first table, the subframe coordinator 13 selects, according to the gray-scale level of each pixel of an input image signal, an optimum display gray-scale level from FIGS. 24(A) to 29(A), and when using the second table, from FIGS. 24(B) to 29(B).

The subframe coordinator 13 alternately provides, at intervals of one frame, an image signal associated with the 256-gray-scale-level subframes selected from the coding a of the first table and an image signal associated with the 230-gray-scale-level subframes selected from the coding b of the second table. These coding a and coding b correspond to the coding a and coding b shown in FIG. 19.

The weights in the first table shown in FIGS. 24(A) to 29(A) are the same as those in the second table shown in FIGS. 24(B) to 29(B). Accordingly, only by changing the coding tables 3 and 12, anyone of the coding a involving 256 gray-scale levels and the coding b involving 230 gray-scale levels is realized.

In this way, the third embodiment alters coding frame by frame to shift a location that causes false contours in a first frame to another in a second frame. As a result, the location of false contours never moves with a line of sight and is temporally distributed to surrounding pixels. The third embodiment, therefore, can suppress false contours when displaying dynamic images.

Fourth Embodiment

Figure 30:
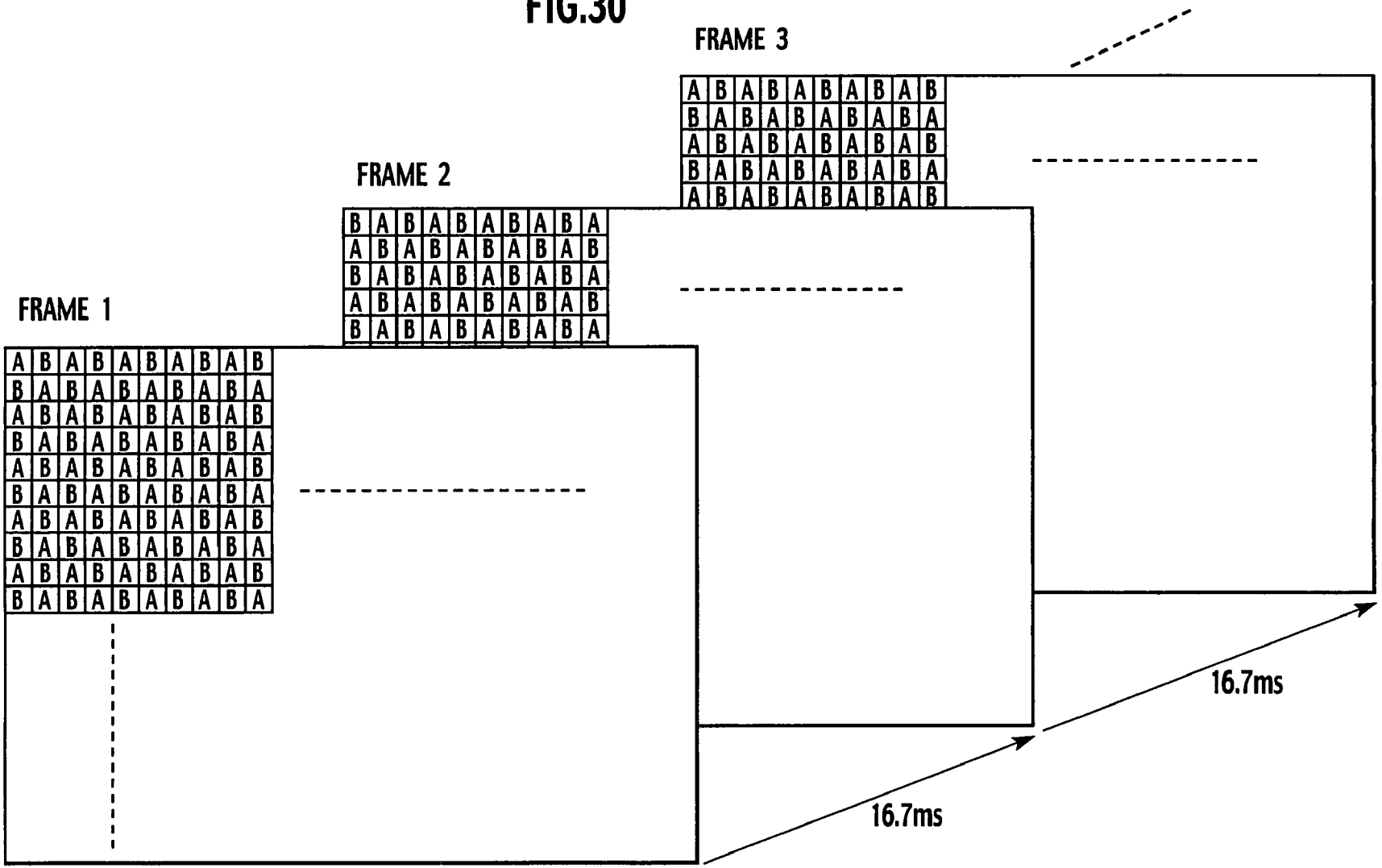
FIG. 30 is a view showing an array of pixels on a display panel according to the fourth embodiment of the present invention.

The fourth embodiment of the present invention will be explained with reference to the accompanying drawings. FIG. 30 shows pixel arrangements on a display panel that change from one to another at intervals of every frame according to the fourth embodiment. In FIG. 30, pixels are divided into groups A and B, and the group-A pixels and group-B pixels are arranged in a hound's-tooth check. Namely, a group-A pixel is surrounded by group-B pixels, and a group-B pixel is surrounded by group-A pixels.

Figure 31:
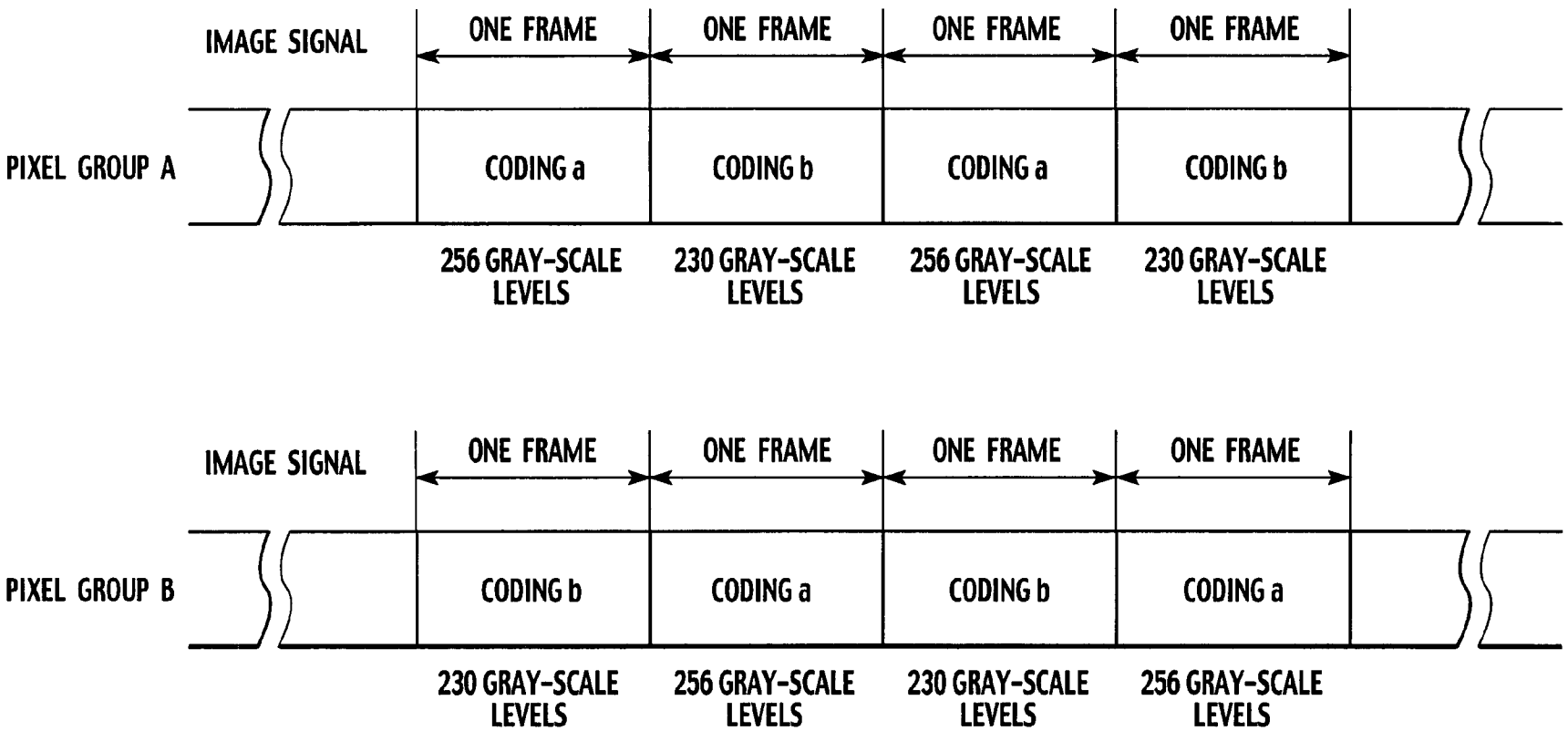
FIG. 31 is a view showing the coding of pixel groups in a series of frames according to the fourth embodiment of the present invention.

FIG. 31 shows temporal changes of the pixel arrangements. The pixels in the group A alternate the coding a and coding b frame by frame, and at the same time, the pixels in the group B alternate the coding b and coding a. The coding a is based on the first table consisting of the coding table 4 and weighting table 3 of FIG. 4, and the coding b is based on the second table consisting of the coding table 12 and weighting table 11. The coding a and coding b are the subframe coding having the relationship of any one of the first to third techniques of the third embodiment.

Like the third embodiment, the fourth embodiment can distribute locations to cause false contours along a time axis and to surrounding pixels frame by frame. The fourth embodiment, therefore, can remarkably reduce false contours on dynamic images.

The number of coding sets is not limited to two. It is possible to employ three or more sets of coding and weighting tables. In this case, the pixel groups A and B may cyclically or randomly select combinations of coding and weighting tables and may be switched from one to another, to further improve the effect of the present invention.

The present invention is not limited to the embodiments mentioned above. For example, the coding tables 4 and 12 and the weighting tables 3 and 11 may not be stored in an external storage unit. Instead, the values in the tables may internally be calculated. Although the embodiments employ the coding a of FIG. 19 and the coding b linearly transformed from the coding a, any other coding sets are employable if selected top subframes differ between the coding sets.

Although the first to third techniques of the third embodiment employ two sets of coding and weighting tables, the number of sets of coding and weighting tables may be three or more, if selected top subframes differ between the coding sets. These sets may cyclically or randomly be switched from one to another frame by frame.

Although the above-mentioned embodiments have been explained in connection with the display apparatus employing a PDP, the present invention is also applicable to display apparatuses employing liquid crystal panels or organic electroluminescence (EL) panels. According to the present invention, it is possible to switch a plurality of sets of weighting tables and corresponding coding tables from one to another pixel by pixel.

It should be understood that many modifications and adaptations of the invention will become apparent to those skilled in the art and it is intended to encompass such obvious modifications and changes in the scope of the claims appended hereto.

What is claimed is:

1. A display apparatus comprising:

a subframe coordinator configured to divide a frame period of an input image signal into subframes, brightness weights thereof increasing as a number of bits of the input image signal increases, and selecting at least one of the subframes that provides a brightness weight corresponding to an input gray-scale level specified by the input image signal, the subframes including a first subframe having a minimum brightness weight and a second subframe having a maximum brightness weight;

a table generator configured to generate first and second sets of subframe coding tables having the same gray-scale-level input/output characteristics in the first gray-scale-level range of 0 to a first value of input gray-scale level and having different gray-scale-level input/output characteristics in the second gray-scale-level range of a second value to a third value of input gray-scale level, the second value being one level larger than the first value and the third value being a maximum value of input gray-scale level; and an image processing unit configured to cyclically and alternately employ the first and second sets of subframe coding tables at intervals of one frame, or one pixel, or one frame and one pixel of the input image signal and provide an output image signal having an output gray-scale level corresponding to the input gray-scale level, wherein:

the first and second sets of subframe coding tables generated by the table generator include data for selecting any subframes from the first subframe to the second subframe to emit light, a subframe having a maximum brightness weight among subframes selected to emit light from the first subframe to the second subframe being the same for each group of input gray-scale levels in the second gray-scale-level range between the first and second sets of subframe coding tables, the second gray-scale-level range of each set of subframe coding tables includes a plurality of groups each including input gray-scale levels including the same subframe selected to emit light and having the maximum brightness weight, when the subframe selected to emit light and having the maximum brightness weight of a first group, which is a given group among the plurality of groups, is n, which is an integer indicating any subframe from the first subframe to the second subframe, the subframe selected to emit light and having the maximum brightness weight of a second group that is one next to the first group toward the second value is n−1, any location of boundaries between the plurality of groups included in the second gray-scale-level range of the first set of subframe coding tables does not coincide with locations of boundaries of the second set of subframe coding tables.

2. The display apparatus of claim 1, wherein:

the table generator generates the second set of subframe coding tables by linearly transforming the first set thereof of subframe coding tables.

* * * * *